US008622514B2

(12) United States Patent
Inoue

(10) Patent No.: US 8,622,514 B2
(45) Date of Patent: Jan. 7, 2014

(54) HEAD CLEANING METHOD AND HEAD CLEANING APPARATUS

(71) Applicant: Fujifilm Corporation, Tokyo (JP)
(72) Inventor: Hiroshi Inoue, Ashigarakami-gun (JP)
(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/666,789
(22) Filed: Nov. 1, 2012

(65) Prior Publication Data

US 2013/0057613 A1 Mar. 7, 2013

Related U.S. Application Data

(62) Division of application No. 12/750,345, filed on Mar. 30, 2010, now Pat. No. 8,342,639.

(30) Foreign Application Priority Data

Mar. 31, 2009 (JP) ..... 2009-085584
Mar. 31, 2009 (JP) ..... 2009-085585
Mar. 31, 2009 (JP) ..... 2009-085586

(51) Int. Cl.
*B41J 2/165* (2006.01)

(52) U.S. Cl.
USPC ..... 347/33; 347/28; 347/34; 347/35; 347/32

(58) Field of Classification Search
USPC ..... 347/33, 28, 34, 35, 32
See application file for complete search history.

(56) References Cited

U.S. PATENT DOCUMENTS 5,905,514 A * 5/1999 Rhoads et al. ..... 347/33
6,382,767 B1 5/2002 Greive

FOREIGN PATENT DOCUMENTS

JP 6-270413 A 9/1994
JP 11-192715 A 7/1999
JP 2001-18409 A 1/2001
JP 2003-270426 A 9/2003
JP 2006-198509 A 8/2006
JP 2006-205712 A 8/2006
JP 2007-41092 A 2/2007
JP 2009-29047 A 2/2009
JP 2009-226717 A 10/2009

OTHER PUBLICATIONS

Japanese Office Action dated Sep. 21, 2012, issued in related Japanese patent application No. 2009-085584 (English translation is provided).
Japanese Office Action dated Nov. 20, 2012 issued in Japanese Patent Application No. 2009-085585 (English translation is provided).
Japanese Office Action dated Nov. 20, 2012 issued in Japanese Patent Application No. 2009-085586 (English translation is provided).

* cited by examiner

*Primary Examiner* — Henok Legesse
(74) *Attorney, Agent, or Firm* — Birch, Stewart, Kolasch & Birch, LLP

(57) ABSTRACT

A head cleaning method of wiping and cleaning a nozzle surface of a head with a band-shaped liquid absorbing body by, while pressing and abutting a pressing member on which the liquid absorbing body that travels is wrapped against the nozzle surface of the head, sliding the pressing member over the nozzle surface of the head, includes: a first cleaning step of wiping and cleaning the nozzle surface of the head with a non-wet region of the liquid absorbing body; a wet region forming step of forming a wet region on the liquid absorbing body; and a second cleaning step of wiping and cleaning the nozzle surface of the head with the wet region of the liquid absorbing body.

8 Claims, 41 Drawing Sheets

PRESSING POSITION

WITHDRAWN POSITION

PRESSING POSITION

WITHDRAWN POSITION

FIRST DIRECTION (LIQUID ABSORPTION CAPABILITY : HIGH)

SECOND DIRECTION (LIQUID ABSORPTION CAPABILITY : LOW)

PRESSING POSITION

WITHDRAWN POSITION

AIR SUCTIONING ON

AIR SUCTIONING OFF

HEAD CLEANING METHOD AND HEAD CLEANING APPARATUS

BACKGROUND OF THE INVENTION

1. Field of the Invention

The present invention relates to a head cleaning method and a head cleaning apparatus, and more particularly, to a head cleaning method and a head cleaning apparatus for wiping and cleaning a nozzle surface with a liquid absorbing body.

2. Description of the Related Art

In an inkjet recording apparatus which carries out image recording by ejecting very fine ink droplets from nozzles, if a recording operation is performed continuously, then ink in the form of a mist ejected from the nozzles adheres to and accumulates on the vicinity of the nozzles, and can give rise to nozzle blockages. Consequently, in an inkjet recording apparatus, cleaning of the nozzle surface is carried out periodically.

Japanese Patent Application Publication No. 2006-205712 discloses, as a method for cleaning the nozzle surface, a method in which the nozzle surface is wiped with a blade and then the nozzle surface is further wiped with an ink absorbing body (wiping member).

However, in a method where a nozzle surface is wiped with an ink absorbing body as in Japanese Patent Application Publication No. 2006-205712, if the absorption capability of the ink absorbing body used is high, then ink is drawn out from the nozzles by the ink absorbing body and there is a possibility that small liquid droplets are left after the passage of the ink absorbing body (hereinafter, a phenomenon of this kind is called "wiping trace").

If, on the other hand, the absorption capability of the ink absorbing body used is low, then the liquid droplets on the nozzle surface are not absorbed completely and there is a possibility that large liquid droplets are left on the nozzle surface (hereinafter, a phenomenon of this kind is called "wiping omission").

Wiping traces or wiping omissions of this kind have an adverse effect on the flight of the liquid droplets ejected from the nozzles and cause deterioration of the image.

A conceivable method of avoiding this might be to wipe the nozzle surface using an ink absorbing body having an optimal absorption capability, but this is problematic in that it places restrictions on the choice of the ink absorbing body. Furthermore, depending on conditions such as the nozzle hole diameter and the resistance of the lyophobic film on the nozzle surface, there may not exist any ink absorbing body which fulfils the desired properties.

SUMMARY OF THE INVENTION

The present invention has been contrived in view of these circumstances, an object thereof being to provide a head cleaning method and a head cleaning apparatus whereby the range of selection of usable ink absorbing bodies can be increased, and a nozzle surface can be cleaned without giving rise to wiping traces or wiping omissions.

One aspect of the invention is directed to a head cleaning method of wiping and cleaning a nozzle surface of a head with a band-shaped liquid absorbing body by, while pressing and abutting a pressing member on which the liquid absorbing body that travels is wrapped against the nozzle surface of the head, sliding the pressing member over the nozzle surface of the head, the head cleaning method comprising: a first cleaning step of wiping and cleaning the nozzle surface of the head with a non-wet region of the liquid absorbing body; a wet region forming step of forming a wet region on the liquid absorbing body; and a second cleaning step of wiping and cleaning the nozzle surface of the head with the wet region of the liquid absorbing body.

According to this aspect, firstly, the nozzle surface of the head is wiped and cleaned using a non-wet region of the liquid absorbing body (first cleaning step). Thereupon, a wet region is formed on the liquid absorbing body (wet region forming step) and the nozzle surface of the head is wiped and cleaned using the wet region thus formed (second cleaning step). By this means, it is possible to clean the nozzle surface without the occurrence of wiping traces or wiping omissions. In other words, since the non-wet region of the liquid absorbing body has not yet absorbed liquid, then the liquid absorption capability is high and by wiping and cleaning the nozzle surface using this non-wet region having a high liquid absorption capability, it is possible to prevent wiping omissions. On the other hand, if the nozzle surface is wiped and cleaned using a liquid absorbing body having a high liquid absorption capability in this way, then there is a possibility of creating wiping traces on the nozzle surface. However, according to the present aspect, since the nozzle surface is wiped and cleaned using a non-wet region and the absorption capability of the liquid absorbing body is then reduced by wetting the liquid absorbing body and the nozzle surface is wiped and cleaned again using this liquid absorbing body having reduced absorption capability, then even if wiping traces have occurred in the first wiping and cleaning actions, these traces can be wiped away. By this means, it is possible to clean the nozzle surface without the occurrence of wiping traces or wiping omissions. Furthermore, by this means, it is possible to ease the conditions relating to the liquid absorbing body which can be used, and therefore the range of selection of the liquid absorbing body can be increased.

Desirably, in the wet region forming step, the wet region is formed by depositing liquid from a liquid deposition device onto the liquid absorbing body on an upstream side of the pressing member in terms of a direction of travel of the liquid absorbing body.

According to this aspect, a wet region is formed by depositing liquid from the liquid deposition device onto the liquid absorbing body on the upstream side of the pressing member, in other words, the liquid absorbing body before sliding in contact with the nozzle surface of the head. Therefore, it is possible to form a wet region in a prescribed region of the liquid absorbing body, in a straightforward fashion.

Desirably, the first cleaning step is carried out after previously depositing liquid onto the nozzle surface of the head, and the wet region is formed by causing the liquid absorbing body to absorb the liquid which has been deposited onto a region of the nozzle surface other than a nozzle forming region of the nozzle surface.

According to the present aspect, the first cleaning step is carried out after previously depositing liquid (for example, a prescribed cleaning liquid) onto the nozzle surface of the head. The wet region is formed by causing the liquid absorbing body to absorb liquid which has been deposited onto the region of the nozzle surface other than the nozzle forming region. In other words, normally, there is a region where nozzles are not formed on the nozzle surface, and since this region is relatively clean compared to the region where nozzles are formed, then a wet region is formed on the liquid absorbing body by making the liquid absorbing body absorb the liquid that has been deposited onto this region. By this means, it is possible to form a wet region on the liquid absorbing body, in a straightforward fashion. In this case, the liquid absorbing body is used by being wound back according to requirements.

Desirably, the wet region forming step forms the wet region by causing liquid to seep out from nozzles formed in the nozzle surface of the head and causing the liquid absorbing body to absorb the liquid that has seeped out from the nozzles.

According to the present aspect, the wet region is formed by causing liquid to seep out from the nozzles formed on the nozzle surface of the head and causing the liquid absorbing body to absorb this seeped liquid. By this means, it is possible to form a wet region on the liquid absorbing body, in a straightforward fashion. In this case, the liquid absorbing body is used by being wound back according to requirements.

Desirably, in the first cleaning step, the liquid absorbing body is caused to travel in a direction opposite to a direction of relative movement of the head with respect to the pressing member.

According to this aspect, the first cleaning step is carried out by causing the liquid absorbing body to travel in the opposite direction to the direction of relative movement of the head with respect to the pressing member. By this means, it is possible to increase the relative speed of travel of the liquid absorbing body with respect to the nozzle surface and the cleaning effect can be enhanced.

Desirably, in the second cleaning step, the liquid absorbing body is caused to travel in a direction opposite to a direction of relative movement of the head with respect to the pressing member.

According to this aspect, the second cleaning step is carried out by causing the liquid absorbing body to travel in the opposite direction to the direction of relative movement of the head with respect to the pressing member.

Desirably, in the second cleaning step, the liquid absorbing body is caused to travel in a same direction as a direction of relative movement of the head with respect to the pressing member.

According to this aspect, the second cleaning step is carried out by causing the liquid absorbing body to travel in the same direction as the direction of relative movement of the head with respect to the pressing member.

Desirably, in the wet region forming step, the wet region is formed by increasing an amount of wetting, as a relative speed differential between the head and the liquid absorbing body increases in the second cleaning step.

According to this aspect, a wet region is formed by increasing the amount of wetting, the greater the relative speed differential between the head and the liquid absorbing body in the second cleaning step. In other words, since the liquid absorption capability becomes greater, the faster the relative speed of the liquid absorbing body with respect to the head, then the amount of wetting is increased so as to restrict the absorption capability. By this means, it is possible to carry out the second cleaning step by setting the liquid absorbing body to a suitable absorption capability, and wiping traces can be removed appropriately.

Another aspect of the invention is directed to a head cleaning apparatus which wipes and cleans a nozzle surface of a head with a band-shaped liquid absorbing body by, while pressing and abutting a pressing member on which the liquid absorbing body that travels is wrapped against the nozzle surface of the head, sliding the pressing member over the nozzle surface of the head, the head cleaning apparatus comprising: a liquid deposition device which deposits liquid on the liquid absorbing body on an upstream side of the pressing member in terms of a direction of travel of the liquid absorbing body so as to wet the liquid absorbing body with the liquid; and a control device which controls the travel of the liquid absorbing body, sliding of the pressing member and deposition of the liquid by the liquid deposition device, wherein the control device implements control in such a manner that, after the nozzle surface of the head is wiped and cleaned with a non-wet region of the liquid absorbing body, a wet region is formed on the liquid absorbing body by depositing the liquid on the liquid absorbing body from the liquid deposition device, and the nozzle surface of the head is wiped and cleaned with the wet region.

According to this aspect, the nozzle surface is firstly wiped and cleaned by using a non-wet region of the liquid absorbing body. Thereupon, liquid is applied to the liquid absorbing body from the liquid deposition device to form a wet region on the liquid absorbing body. The nozzle surface is then wiped again using the wet region thus formed. By this means, it is possible to clean the nozzle surface without the occurrence of wiping traces or wiping omissions. Furthermore, by this means, it is also possible to ease the conditions relating to the liquid absorbing body which can be used, and therefore the range of selection of the liquid absorbing body can be increased.

Desirably, an amount of the liquid deposited by the liquid deposition device can be altered in accordance with a relative speed differential between the head and the liquid absorbing body.

According to this aspect, the amount of liquid deposited onto the liquid absorbing body from the liquid deposition device, in other words, the amount of wetting, is set in accordance with the relative speed differential between the head and the liquid absorbing body when the nozzle surface is wiped and cleaned with the wetted liquid absorbing body. By this means, it is possible to remove wiping traces suitably.

Another aspect of the invention is directed to a head cleaning apparatus which wipes and cleans a nozzle surface of a head with a band-shaped liquid absorbing body by, while pressing and abutting a pressing member on which the liquid absorbing body that travels is wrapped against the nozzle surface of the head, sliding the pressing member over the nozzle surface of the head, the head cleaning apparatus comprising: a liquid deposition device which deposits liquid onto the nozzle surface of the head; and a control device which controls travel of the liquid absorbing body, sliding of the pressing member and deposition of the liquid by the liquid deposition device, wherein the control device implements control in such a manner that, after the liquid is deposited onto the nozzle surface of the head from the liquid deposition device, the nozzle surface of the head is wiped and cleaned with a non-wet region of the liquid absorbing body, and then after this wiping and cleaning action, the nozzle surface of the head is wiped and cleaned again with a wet region formed by wiping a region of the nozzle surface other than a nozzle forming region of the nozzle surface.

According to this aspect, after depositing liquid from the liquid deposition device onto the nozzle surface of the head, the nozzle surface of the head is wiped and cleaned by using a non-wet region of the liquid absorbing body. After this wiping and cleaning action using the non-wet region, the nozzle surface is wiped and cleaned again using a wet region formed by wiping over a region of the nozzle surface other than the nozzle forming region. Accordingly, it is possible to clean the nozzle surface without the occurrence of wiping traces or wiping omissions. Furthermore, by this means, it is also possible to ease the conditions relating to the liquid absorbing body which can be used, and therefore the range of selection of the liquid absorbing body can be increased.

Desirably, the head cleaning apparatus further comprises a wet region determination device which determines the wet region of the liquid absorbing body.

According to this aspect, it is possible to determine a wet region of the liquid absorbing body. By this means, it is possible to wipe and clean the nozzle surface by switching the wet region and the non-wet region appropriately.

Another aspect of the invention is directed to a head cleaning method of wiping and cleaning a nozzle surface of a head with a wiping member by, while pressing and abutting the wiping member against the nozzle surface of the head, sliding the wiping member over the nozzle surface of the head, the head cleaning method comprising: a first cleaning step of wiping and cleaning the nozzle surface of the head with a wiping member having a first liquid absorption capability; and a second cleaning step of wiping and cleaning the nozzle surface of the head with a wiping member having a second liquid absorption capability which is lower than the first liquid absorption capability, after the first cleaning step.

According to this aspect, when the nozzle surface of the head is wiped using a wiping member having a high liquid absorption capability, wiping omissions can be prevented, but there is a possibility of the occurrence of wiping traces due to ink being drawn out from the nozzles during wiping. On the other hand, when the nozzle surface is wiped using a wiping member having a low liquid absorption capability, wiping traces can be prevented, but there is a possibility of the occurrence of wiping omissions. Therefore, according to the this aspect, after wiping and cleaning the nozzle surface of the head with a wiping member having a first liquid absorption capability, the nozzle surface of the head is wiped and cleaned with a wiping member having a second liquid absorption capability, which is lower than the first liquid absorption capability. By this means, it is possible to wipe and clean the nozzle surface without the occurrence of wiping traces or wiping omissions. Furthermore, by wiping the nozzle surface a plurality of times while changing the liquid absorption capability in this way, it is possible to increase the range of selection of the wiping member and cost reductions can be made, compared to a case where wiping is performed using a wiping member having an optimal liquid absorption capability.

This aspect includes an aspect where the liquid absorption capability is switched in a stepwise fashion. More specifically, this aspect includes an aspect where, between the first cleaning step and the second cleaning step, the nozzle surface of the head is wiped and cleaned by a wiping member having an intermediate liquid absorption capability between the first liquid absorption capability and the second liquid absorption capability. Furthermore, this aspect also includes an aspect where the first cleaning step is carried out a plurality of times using a wiping member having a high liquid absorption capability, whereupon the second cleaning step is carried out. More specifically, according to the aspect, the nozzle surface of the head is wiped and cleaned with a wiping member having a first liquid absorption capability at least once, and the nozzle surface of the head is wiped and cleaned finally with a wiping member having a second liquid absorption capability.

Desirably, the first liquid absorption capability is set to a high liquid absorption capability of a level which avoids creating wiping omissions when the nozzle surface of the head is wiped; and the second liquid absorption capability is set to a low liquid absorption capability of a level which avoids drawing out ink from nozzles when the nozzle surface of the head is wiped.

According to the present aspect, the first liquid absorption capability is set to a liquid absorption capability of a level which avoids the occurrence of wiping omissions when the nozzle surface of the head is wiped, and the second liquid absorption capability is set to a liquid absorption capability of a level which avoids drawing out ink from the nozzles when the nozzle surface of the head is wiped. By this means, it is possible to prevent wiping omissions in the first cleaning step and it is possible to remove wiping traces produced during wiping, in the second cleaning step.

Desirably, the wiping member having the first liquid absorption capability and the wiping member having the second liquid absorption capability are arranged, and the first cleaning step and the second cleaning step are carried out by switching the wiping member to be used.

According to this aspect, a wiping member having a first liquid absorption capability and a wiping member having a second liquid absorption capability are provided and the nozzle surface of the head is wiped and cleaned by switching the wiping member used. In this case, after wiping and cleaning the nozzle surface of the head with a wiping member having a first liquid absorption capability, the nozzle surface of the head is wiped and cleaned by switching to the wiping member having a second liquid absorption capability. By this means, it is possible to wipe and clean the nozzle surface of the head without the occurrence of wiping traces or wiping omissions.

Desirably, the liquid absorption capability displayed by the wiping member switches between the first liquid absorption capability and the second liquid absorption capability according to orientation of the wiping member with respect to a direction in which the wiping member is slid, and the orientation of the wiping member is changed between in the first cleaning step and in the second cleaning step.

According to this aspect, a wiping member of which the liquid absorption capability switches between a first liquid absorption capability and a second liquid absorption capability by changing orientation is used, and the nozzle surface of the head is wiped and cleaned while changing the orientation of the wiping member. In this case, after wiping and cleaning the nozzle surface of the head in the orientation set to the first liquid absorption capability, the nozzle surface of the head is wiped and cleaned by switching the orientation of the wiping member to the orientation set to the second liquid absorption capability. For example, the wiping member used is set to have a first liquid absorption capability when the member is wiped in a longitudinal direction and is set to have a second liquid absorption capability when wiped in a lateral direction; after wiping and cleaning in a longitudinal orientation, wiping and cleaning is then carried out by switching the orientation of the wiping member to a lateral orientation. By this means, it is possible to wipe and clean the nozzle surface of the head without the occurrence of wiping traces or wiping omissions, in a simple fashion.

Desirably, the wiping member is formed in a band shape, and the nozzle surface of the head is wiped and cleaned with the wiping member by sliding the wiping member over the nozzle surface of the head by causing the wiping member to travel in a lengthwise direction while changing a slide portion in contact with the nozzle surface of the head.

According to this aspect, the wiping member is formed in a band shape and is slid over the nozzle surface of the head while changing the portion sliding in contact with the nozzle surface of the head, by causing the wiping member to travel in the lengthwise direction. By this means, it is possible to increase the relative speed of the wiping member with respect to the nozzle surface of the head, and the cleaning effect can be enhanced.

Desirably, the nozzle surface of the head is wiped and cleaned with the wiping member by sliding the wiping member over the nozzle surface of the head while causing the wiping member to travel in a direction opposite to a direction of sliding.

According to this aspect, the wiping member is slid over the nozzle surface of the head while causing the wiping member to travel in the opposite direction to the direction of sliding. By this means, it is possible further to increase the relative speed of the wiping member with respect to the nozzle surface of the head, and the cleaning effect can be enhanced yet further.

Another aspect of the invention is directed to a head cleaning apparatus which cleans a nozzle surface of a head, comprising: a plurality of wiping members having different liquid absorption capabilities; a pressing device which presses and abuts the wiping member against the nozzle surface of the head; a switching device which switches the wiping member pressed and abutted against the nozzle surface of the head by the pressing device; and a movement device which causes the head and the wiping member pressed and abutted against the nozzle surface of the head to move relatively in such a manner the wiping member pressed and abutted against the nozzle surface of the head slides over the nozzle surface of the head, wherein the nozzle surface of the head is wiped and cleaned a plurality of times while switching from the wiping member having a high liquid absorption capability to the wiping member having a low liquid absorption capability.

According to this aspect, a plurality of wiping members having different liquid absorption capabilities are provided, and the nozzle surface of the head is wiped and cleaned a plurality of times by switching from a wiping member having a high liquid absorption capability to a wiping member having a low liquid absorption capability. By this means, it is possible to wipe and clean the nozzle surface without the occurrence of wiping traces or wiping omissions.

At least two wiping members having different liquid absorption capabilities should be used. Therefore, it is also possible to wipe the nozzle surface using three or more wiping members having different liquid absorption capabilities. In this case, the wiping member used is switched in a stepwise fashion. Furthermore, the number of times wiping is carried out with each wiping member should be at least once and may be several times. More specifically, according to this aspect, a composition should be adopted in which the nozzle surface is wiped at least once with a wiping member having high liquid absorption capability and is wiped finally with a wiping member having the lowest liquid absorption capability.

Desirably, the plurality of wiping members include a wiping member having a high liquid absorption capability which does not give rise to wiping omissions when the nozzle surface of the head is wiped, and a wiping member having a low liquid absorption capability which does not draw out ink from nozzles when the nozzle surface of the head is wiped, and the nozzle surface of the head is wiped and cleaned with the wiping member having the high liquid absorption capability, and then the nozzle surface of the head is wiped and cleaned with the wiping member having the low liquid absorption capability.

According to this aspect, a wiping member having a high liquid absorption capability which does not give rise to wiping omissions when the nozzle surface of the head is wiped and a wiping member having a low liquid absorption capability which avoids drawing out ink from the nozzles when the nozzle surface of the head is wiped are provided, and after wiping and cleaning the nozzle surface of the head with a wiping member having a high liquid absorption capability, the nozzle surface of the head is wiped and cleaned with a wiping member having a low liquid absorption capability. By this means, it is possible to wipe and clean the nozzle surface without the occurrence of wiping traces or wiping omissions.

Desirably, the plurality of wiping members are formed in a band shape, a wiping member travel drive device which causes each of the plurality of wiping members to travel in a lengthwise direction is provided, and each of the wiping member is pressed and abutted against the nozzle surface of the head while each of the wiping member is caused to travel by the wiping member travel drive device.

According to this aspect, the wiping member is pressed and abutted against the nozzle surface of the head while traveling. By this means, it is possible to increase the relative speed of the wiping member with respect to the nozzle surface of the head, and the cleaning effect can be enhanced.

Another aspect of the invention is directed to a head cleaning apparatus which cleans a nozzle surface of a head, comprising: a wiping member whose liquid absorption capability switches by changing orientation with respect to a direction in which the wiping member is slid; a switching device which changes the orientation of the wiping member; a pressing device which presses and abuts the wiping member against the nozzle surface of the head; and a movement device which causes the head and the wiping member pressed and abutted against the nozzle surface of the head to move relatively in such a manner that the wiping member pressed and abutted against the nozzle surface of the head slides over the nozzle surface of the head, wherein the nozzle surface of the head is wiped and cleaned a plurality of times by switching the liquid absorption capability of the wiping member from a high state to a low state by switching the orientation of the wiping member.

According to this aspect, a wiping member of which the liquid absorption capability alters by changing orientation is provided, and by changing the orientation of the wiping member, the liquid absorption capability of the wiping member is switched from a high state to a low state and the nozzle surface of the head is wiped and cleaned a plurality of times. For example, the wiping member used is able to wipe with a high liquid absorption capability when wiped in a longitudinal direction and is able to wipe with a low liquid absorption capability when wiped in a lateral direction; after wiping and cleaning in a longitudinal orientation, the orientation of the wiping member is switched to a lateral orientation and wiping and cleaning is carried out. By this means, it is possible to clean the nozzle surface without the occurrence of wiping traces or wiping omissions.

The liquid absorption capability of the wiping member should be switched in at least two steps. Therefore, it is also possible to use a wiping member which switches liquid absorption capability in three or more steps. In this case, the liquid absorption capability is switched so as to reduce in a stepwise fashion. Furthermore, if the liquid absorption capability is switched in a plurality of steps, then at least the final wiping action should be carried out in a state of low liquid absorption capability.

Desirably, the wiping member is set to displaying a high liquid absorption capability which does not give rise to wiping omissions when the nozzle surface of the head is wiped, when set to a first orientation, and the wiping member is set to displaying a low liquid absorption capability which does not draw ink out from nozzles when the nozzle surface of the head is wiped, when set to a second orientation.

According to this aspect, the wiping member is set to a high liquid absorption capability which does not give rise to wiping omissions when the nozzle surface of the head is wiped, when set to a first orientation, and the wiping member is set to a low liquid absorption capability which avoids drawing ink out from the nozzles when the nozzle surface of the head is wiped, when set to a second orientation. After setting the wiping member to a first orientation and carrying out a first wiping and cleaning action, the wiping member is set to a second orientation and a second wiping and cleaning action is carried out. By this means, it is possible to switch the liquid absorption capability in a simple fashion.

Desirably, the wiping member is formed in a band shape, a wiping member travel drive device which causes the wiping member to travel in a lengthwise direction is provided, and the wiping member is pressed and abutted against the nozzle surface of the head while the wiping member is caused to travel by the wiping member travel drive device.

According to this aspect, the wiping member is pressed and abutted against the nozzle surface of the head while traveling. By this means, it is possible to increase the relative speed of the wiping member with respect to the nozzle surface of the head, and the cleaning effect can be enhanced.

Another aspect of the invention is directed to a head cleaning method of wiping and cleaning a nozzle surface of a head with a wiping member by, while causing a pressing member having a pressing portion in which a suction hole is formed to press and abut the wiping member against the nozzle surface of the head, sliding the pressing member over the nozzle surface of the head, the head cleaning method comprising: a first cleaning step of wiping and cleaning the nozzle surface of the head with the wiping member while suctioning the wiping member at a first suctioning force via the suction hole; and a second cleaning step of wiping and cleaning the nozzle surface of the head with the wiping member while suctioning the wiping member at a second suctioning force which is set to be weaker than the first suctioning force, via the suction hole, or without suctioning the wiping member via the suction hole.

According to this aspect, firstly, the nozzle surface of a head is wiped and cleaned by sliding a wiping member over the nozzle surface of the head while suctioning at a first suctioning force (first cleaning step). By suctioning the wiping member at a first suctioning force in this way, it is possible to raise the suctioning force of the wiping member and wiping omissions can be prevented. On the other hand, when the nozzle surface is wiped with a wiping member having a high absorption capability in this way, there is a possibility of the occurrence of wiping traces due to ink being drawn out from the nozzles. Therefore, according to the present aspect, after the first cleaning step, the wiping member is slid over the nozzle surface of the head while suctioning at a second suctioning force which is weaker than the first suctioning force, or without suctioning, thereby wiping and cleaning the nozzle surface of the head with the wiping member (second cleaning step). By wiping and cleaning the nozzle surface of the head in this way by sliding the wiping member over the nozzle surface of the head while suctioning at a second suctioning force which is set to be weaker than the first suctioning force, or without suctioning, it is possible to prevent the drawing out of ink from the nozzles, while being able to remove wiping traces caused by the first cleaning step, and therefore the nozzle surface can be cleaned without the occurrence of wiping traces or wiping omissions. Furthermore, by switching the suctioning force from the suction hole and thus switching the suctioning force applied to the wiping member in this way, it is possible to ease the conditions relating to the wiping members which can be used, and therefore the range of selection of usable wiping members can be increased. According to the present aspect, since the suctioning force of the wiping member is switched by means of the suctioning force acting via the suction hole in this way, desirably, the wiping member is one which inherently has a low liquid absorption capability.

Desirably, the wiping member is formed in a band shape, and the nozzle surface of the head is wiped and cleaned with the wiping member by sliding the wiping member over the nozzle surface of the head by causing the wiping member to travel in a lengthwise direction while changing a slide portion in contact with the nozzle surface of the head.

According to this aspect, the nozzle surface of the head is wiped and cleaned with a wiping member formed in the shape of a band, which is slid over the nozzle surface of the head while being caused to travel in the lengthwise direction. By this means, it is possible to wipe and clean the nozzle surface by using a clean part of the wiping member at all times, and therefore the cleaning effect can be enhanced.

Desirably, the nozzle surface of the head is wiped and cleaned with the wiping member by sliding the wiping member over the nozzle surface of the head while the wiping member is caused to travel in a direction opposite to a direction of sliding.

According to this aspect, the nozzle surface of the head is wiped and cleaned with a wiping member formed in the shape of a band, which is slid over the nozzle surface of the head while being caused to travel in the lengthwise direction. Accordingly, it is possible to increase the relative differential velocity between the head and the wiping member, and the cleaning effect can be improved yet further.

Desirably, the pressing member includes a hollow roller having a circumferential surface in which the suction hole is formed, and the wiping member wrapped on the circumferential surface is suctioned via the suction hole by setting an interior of the hollow roller to a negative pressure.

According to this aspect, a wiping member is wrapped about a roller having a suction hole formed in the circumferential surface thereof, and the wiping member is pressed and abutted against the nozzle surface of the head. Furthermore, the wiping member wrapped about the roller (the wiping member which is pressed and abutted against the nozzle surface) is suctioned by setting the interior of the roller to a negative pressure. By this means, it is possible to press and abut the wiping member formed in a band shape against the nozzle surface of the head, in a suitable fashion, as well as being able to suction the wiping member which is pressed and abutted against the nozzle surface.

Desirably, a head cleaning apparatus which cleans a nozzle surface of a head; comprising: a wiping member; a pressing member which presses and abuts the wiping member against the nozzle surface of the head and has a pressing portion in which a suction hole is formed; a movement device which causes the pressing member and the head to move relatively in such a manner that the wiping member slides over the nozzle surface of the head; a suction device which suctions the wiping member via the suction hole formed in the pressing member; and a control device which controls driving of the movement device and the suction device so as to implement a cleaning process of the nozzle surface of the head, wherein the control device implements the cleaning process of the nozzle surface of the head by executing a first cleaning process of wiping and cleaning the nozzle surface of the head with the wiping member by sliding the wiping member over the nozzle surface of the head while suctioning the wiping member at a first suctioning force, and a second cleaning process of wiping and cleaning the nozzle surface of the head with the wiping member by sliding the wiping member over the nozzle surface of the head while suctioning the wiping member at a second suctioning force which is weaker than the first suctioning force or without suctioning the wiping member.

According to this aspect, the nozzle surface of a head is wiped and cleaned with a wiping member by sliding the wiping member over the nozzle surface of the head while suctioning at a first suctioning force (first cleaning step). Thereupon, the wiping member is slid over the nozzle surface of the head while suctioning at a second suctioning force which is weaker than the first suctioning force, or without suctioning, thereby wiping and cleaning the nozzle surface of the head with the wiping member (second cleaning step). By wiping and cleaning the nozzle surface of the head with a wiping member while switching the suctioning force applied to the wiping member in this way, it is possible to clean the nozzle surface without giving rise to wiping traces or wiping omissions. Furthermore, by switching the suctioning force from the suction hole and thus switching the suctioning force applied to the wiping member in this way, it is possible to ease the conditions relating to the wiping members which can be used, and therefore the range of selection of usable wiping members can be increased.

Desirably, the wiping member is formed in a band shape, and a wiping member travel drive device which winds the wiping member from one reel to another reel so as to cause the wiping member to travel in a direction of sliding is provided.

According to this aspect, the wiping member is formed in a band shape and is slid over the nozzle surface of the head while traveling in the sliding direction. By this means, it is possible to improve the cleaning efficiency.

Desirably, the wiping member travel drive device causes the wiping member to travel in a direction opposite to the direction of sliding.

According to this aspect, the wiping member which is formed in a band shape is slid over the nozzle surface of the head while traveling in the opposite direction to the sliding direction. Accordingly, it is possible to increase the relative differential velocity between the head and the wiping member, and the cleaning effect can be improved yet further.

Desirably, the pressing member includes a hollow roller having a circumferential surface in which the suction hole is formed, the wiping member is wrapped on the circumferential surface of the hollow roller and pressed and abutted against the nozzle surface of the head, and the suction device suctions the wiping member via the suction hole by setting an interior of the hollow roller to a negative pressure.

According to this aspect, a wiping member is wrapped about a roller having a suction hole formed in the circumferential surface thereof, and the wiping member is pressed and abutted against the nozzle surface of the head. Furthermore, the wiping member wrapped about the circumferential surface is suctioned by setting the interior of the roller to a negative pressure. By this means, it is possible to press and abut the wiping member formed in a band shape against the nozzle surface of the head, in a suitable fashion, as well as being able to suction the wiping member which is pressed and abutted against the nozzle surface.

Desirably, the hollow roller is constituted by an elastic body.

According to this aspect, the roller is constituted by an elastic body. Therefore, it is possible to press and abut the wiping member against the nozzle surface of the head in a suitable fashion.

Another aspect of the invention is directed to a head cleaning method of wiping and cleaning a nozzle surface of a head with a wiping member by, while pressing and abutting the wiping member against the nozzle surface of the head by a pressing member having a pressing portion in which a suction hole is formed, sliding the pressing member over the nozzle surface of the head, wherein the nozzle surface of the head is wiped and cleaned with the wiping member by sliding the pressing member over the nozzle surface of the head while suctioning the wiping member via the suction hole with a suctioning force being set to a force which does not give rise to wiping traces and wiping omissions on the nozzle surface after wiping.

According to this aspect, the nozzle surface of the head is wiped and cleaned by pressing and abutting a wiping member against the nozzle surface of the head and sliding a wiping member over the nozzle surface of the head while suctioning the wiping member via a suction hole. In this, the wiping member is suctioned via the suction hole by setting a suctioning force which does not give rise to wiping traces or wiping omissions on the nozzle surface after wiping. Accordingly, it is possible to clean the nozzle surface without the occurrence of wiping traces or wiping omissions in a single wiping action. Furthermore, by this means, it is also possible to ease the conditions relating to the wiping member which can be used, and therefore the range of selection of the wiping member used can be increased.

According to one mode of the present invention, it is possible to increase the range of selection of the ink absorbing body which can be used. Furthermore, it is also possible to clean the nozzle surface without the occurrence of wiping traces or wiping omissions.

According to another mode of the present invention, it is possible to clean the nozzle surface without the occurrence of wiping traces or wiping omissions. Furthermore, the range of selection of the usable wiping member can be increased.

According to another mode of the present invention, it is possible to clean the nozzle surface without the occurrence of wiping traces or wiping omissions. Furthermore, the range of selection of the usable wiping members can be increased.

BRIEF DESCRIPTION OF THE DRAWINGS

FIGS. 38A to 39F are step diagrams of a head cleaning method using the head cleaning apparatus according to the third mode; and FIG. 39 is a front view diagram of a further embodiment of the head cleaner according to the third mode.

DESCRIPTION OF THE PREFERRED EMBODIMENTS

Below, first to third modes of the present invention are described with reference to the accompanying drawings. Desirable embodiments of each mode are described below.

First Mode

A desirable head cleaning method and head cleaning apparatus relating to embodiments of a first mode of the present invention is described below with reference to the accompanying drawings.

Composition of Inkjet Recording Apparatus (Image Formation Unit)

Figure 1:
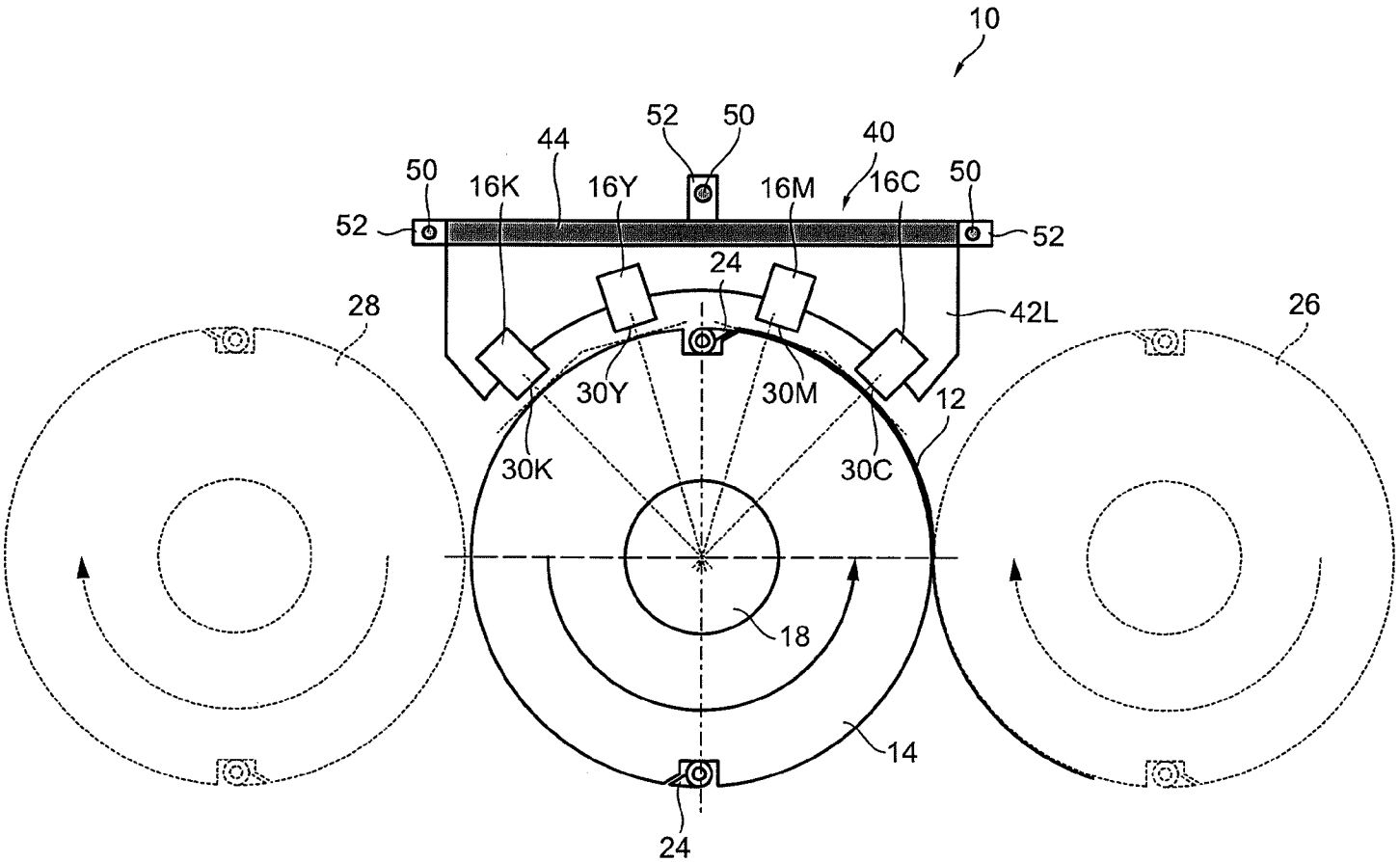
FIG. 1 is a side view diagram showing the general composition of an image formation unit.

FIG. 1 is a side view diagram showing the approximate composition of an image formation unit of an inkjet recording apparatus to which an embodiment of the present invention is applied.

As shown in FIG. 1, in an image formation unit 10 of the inkjet recording apparatus according to the present embodiment, paper (recording medium) 12 is conveyed in rotation by being held by suction on the circumferential surface of an image formation drum 14. A color image is formed on a recording surface of the paper 12 by ejecting liquid droplets of inks of respective colors of cyan (C), magenta (M), yellow (Y) and black (K) onto paper 12 conveyed in rotation by the image formation drum 14, from four line heads 16C, 16M, 16Y and 16K which are arranged about the periphery of the image formation drum 14 (a so-called drum conveyance line printer).

The image formation drum 14 which conveys the paper 12 in rotation is formed in a round cylindrical shape and a rotating shaft 18 provided so as to project from either end thereof is supported on bearings 22 provided in the main frame 20 of the inkjet recording apparatus (see FIG. 2), whereby the image formation drum 14 is installed in a horizontal attitude. A motor is coupled to the rotating shaft 18 via a rotation transmission mechanism (not illustrated), and the image formation drum 14 is rotated by being driven by this motor.

Furthermore, grippers 24 are provided on the circumferential surface of the image formation drum 14 (in the present example, at two locations on the outer circumferential surface thereof). The leading end portion of the paper 12 is gripped by a gripper 24 and thereby held on the outer circumferential surface of the image formation drum 14.

Moreover, a large number of suction holes (not illustrated) are formed in a prescribed arrangement pattern in the circumferential surface of the image formation drum 14, and air is suctioned to the interior of the drum. The paper 12 wrapped about the circumferential surface of the image formation drum 14 is held by suction on the outer circumferential surface of the image formation drum 14 by the suctioning of air toward the interior of the drum via the suction holes.

In the inkjet recording apparatus according to the present embodiment, the paper 12 is transferred to the image formation drum 14 via a conveyance drum 26 from a previous step (for example, a step of depositing treatment liquid having a function of aggregating the coloring material in the ink onto the recording surface of the paper 12). The conveyance drum 26 is disposed in parallel with the image formation drum 14 and transfers paper 12 onto the image formation drum 14 in a synchronized fashion.

Furthermore, the paper 12 after image formation is transferred to a subsequent step (for example, a step of drying the ink) via the conveyance drum 28. The conveyance drum 28 is disposed in parallel with the image formation drum 14 and receives paper 12 from the image formation drum 14 in a synchronized fashion.

The four line heads 16C, 16M, 16Y and 16K (hereinafter called "heads") are formed so as to correspond to the paper width, and are arranged in a radiating fashion at uniform intervals apart on a circle which is concentric with the rotating shaft 18 of the image formation drum 14. The four heads 16C, 16M, 16Y and 16K are installed on a head supporting frame 40 which is arranged above the image formation drum 14.

Figure 2:
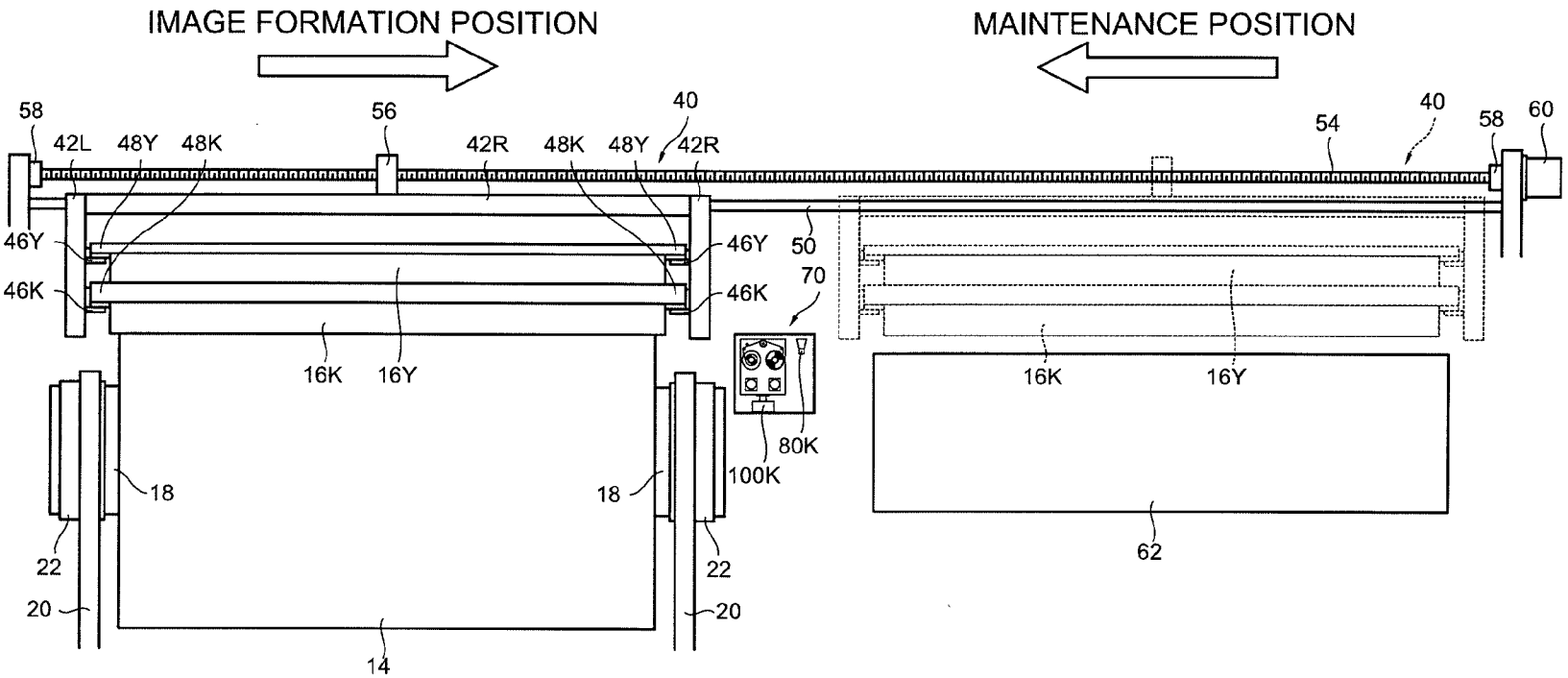
FIG. 2 is a front view diagram showing the general composition of an image formation unit.

As shown in FIG. 2, the head supporting frame 40 is composed by a pair of side plates 42L and 42R which are arranged perpendicularly with respect to the rotating shaft 18 of the image formation drum 14, and a linking frame 44 which links this pair of side plates 42L and 42R together at the upper end portions thereof.

The pair of side plates 42L and 42R is formed in a plate shape, and is disposed so as to be mutually opposing via the image formation drum 14. Installation sections 46C, 46M, 46Y and 46K for installing the respective heads 16C, 16M, 16Y and 16K are provided on the inner side faces of the pair of side plates 42L and 42R (only the installation sections 46Y and 46K are depicted in FIG. 2).

The installation sections 46C, 46M, 46Y and 46K are disposed in a radiating fashion at a uniform spacing apart on a circle concentric with the center of the rotating shaft 18 of the image formation drum 14. The heads 16C, 16M, 16Y and 16K are installed on the head supporting frame 40 by screw fixing attachment sections 48C, 48M, 48Y and 48K which are formed on the respective ends of the heads (only the attachment sections 48Y and 48K are depicted in FIG. 2) onto the installation sections 46C, 46M, 46Y and 46K.

The heads 16C, 16M, 16Y and 16K installed on the head supporting frame 40 in this way are arranged in a radiating fashion at a uniform spacing apart on a circle which is concentric with the rotating shaft 18 of the image formation unit 14, and the nozzle surfaces 30C, 30M, 30Y and 30K of the heads are arranged to oppose the outer circumferential surface of the image formation unit 14. Furthermore, the nozzle surfaces 30C, 30M, 30Y and 30K are provided in positions at a prescribed height from the outer circumferential surface of the image formation unit 14 (a prescribed gap is formed between the outer circumferential surface of the image formation unit 14 and the nozzle surfaces 30C, 30M, 30Y and 30K), and the nozzle rows formed on the nozzle surfaces 30C, 30M, 30Y and 30K are arranged perpendicularly with respect to the direction of conveyance of the paper 12.

Ink droplets are ejected from the heads 16C, 16M, 16Y and 16K arranged in this way, perpendicularly toward the outer circumferential surface of the image formation unit 14 from the nozzle rows formed in the nozzle surfaces 30C, 30M, 30Y and 30K.

The head supporting frame 40 is provided movably in a direction parallel to the rotating shaft 18 of the image formation unit 14 (namely, in the lengthwise direction of the heads 16C, 16M, 16Y and 16K installed thereon) and is composed in such a manner that the heads 16C, 16M, 16Y and 16K can be withdrawn to a prescribed maintenance position. This point is described below.

The image formation unit 10 has the composition described above. In this image formation unit 10, paper 12 is received onto the image formation drum 14 from a previous step via the conveyance drum 26, and is conveyed in rotation while being held by suction on the circumferential surface of the image formation drum 14. The paper 12 passes below the heads 16C, 16M, 16Y and 16K during this conveyance and ink droplets are ejected from the heads 16C, 16M, 16Y and 16K onto the recording surface of the paper as the paper passes, thereby forming a color image on the recording surface. After having completed image recording, the paper 12 is transferred from the image formation drum 14 to the conveyance drum 28 and is conveyed to a subsequent step.

The driving of the heads 16C, 16M, 16Y and 16K (ink ejection) and the driving of the image formation unit 14, and the like, are controlled by a system controller, which is not illustrated. This system controller performs overall control of the operations of the whole inkjet recording apparatus and controls the driving of the respective units in accordance with a prescribed control program.

Movement Mechanism of Head Supporting Frame

As described above, the head supporting frame 40 is provided movably in the direction parallel to the rotating shaft 18 of the image formation drum 14. Below, the movement mechanism of the head supporting frame 40 will be described.

This head supporting frame 40 is supported slidably via sliders 52, 52 on a pair of guide rails 50, 50 which are arranged in parallel with the rotating shaft 18 of the image formation drum 14. The head supporting frame 40 slides in a direction parallel to the rotating shaft 18 of the image formation drum 14 by sliding along the guide rails 50, 50.

Furthermore, a nut section 56 which screws onto a screw bar 54 is coupled to the head supporting frame 40. The screw bar 54 is arranged in parallel with the guide rail 50 and the respective end portions thereof are supported rotatably on bearings 58, 58 which are provided in the main body frame of the inkjet recording apparatus. A head feed motor 60 is coupled to this screw bar 54, which is driven to rotate by the head feed motor 60. The head supporting frame 40 slides along the guide rails 50, 50 by driving the head feed motor 60 and turning the screw bar 54. In other words, the head supporting frame 40 slides in a direction parallel to the axis of rotation of the image formation drum 14.

A system controller, which is not illustrated, causes the heads 16C, 16M, 16Y and 16K to move from a prescribed image formation position to a maintenance position by controlling the driving of the head feed motor 60 and controlling the movement of the head supporting frame 40. Alternatively, the heads are moved from the maintenance position to the image formation position.

When disposed in the image formation position, the heads 16C, 16M, 16Y and 16K are arranged about the periphery of the image formation drum 14, as indicated by the solid lines in FIG. 2, and are able to record an image onto paper 12 conveyed in rotation by the image formation drum 14.

On the other hand, when the heads are disposed in the maintenance position, as indicated by the dotted lines in FIG. 2, then the heads are withdrawn from the periphery of the image formation drum 14. By this means, it is possible to carry out maintenance of both the image formation drum 14 and the heads 16C, 16M, 16Y and 16K.

A moisturizing unit 62 for moisturizing the heads 16C, 16M, 16Y and 16K is provided in this maintenance position. When not used for a long period of time, the nozzle surfaces 30C, 30M, 30Y and 30K of the heads 16C, 16M, 16Y and 16K are kept moist by the moisturizing unit 62, thereby preventing ejection failures due to drying.

A head cleaning apparatus 70 for wiping and cleaning the nozzle surfaces 30C, 30M, 30Y and 30K of the heads 16C, 16M, 16Y and 16K is provided between the image formation position and the maintenance position.

The nozzle surfaces 30C, 30M, 30Y and 30K of the heads 16C, 16M, 16Y and 16K are wiped and cleaned by means of a wiping web (ink absorbing body) being pressed and abutted respectively against the nozzle surfaces 30C, 30M, 30Y and 30K in the process of moving the heads from the image formation position to the maintenance position (or moving the heads from the maintenance position to the image formation position). Below, the composition of the head cleaning apparatus 70 will be described.

Composition of Head Cleaning Apparatus

Figure 3:
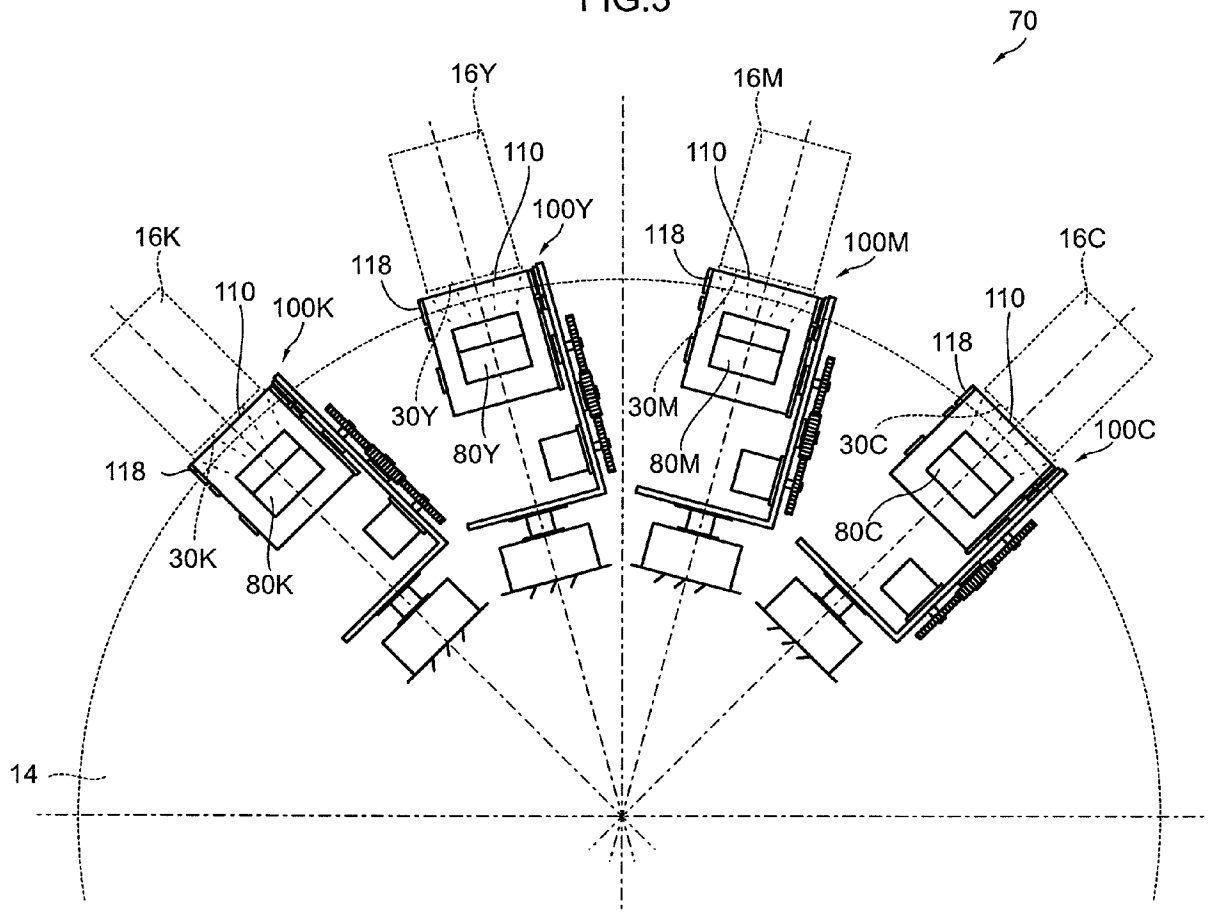
FIG. 3 is a side view diagram showing the composition of a head cleaning apparatus.

FIG. 3 is a side view diagram showing the composition of a head cleaning apparatus.

As shown in FIG. 3, the head cleaning apparatus 70 comprises cleaning liquid application nozzles 80C, 80M, 80Y and 80K and head cleaners 100C, 100M, 100Y and 100K. The cleaning liquid application nozzles 80C, 80M, 80Y and 80K and the head cleaners 100C, 100M, 100Y and 100K are provided so as to correspond to the heads 16C, 16M, 16Y and 16K, and are installed on a supporting frame which is not illustrated. The head cleaning apparatus 70 is disposed at a prescribed installation position set between the image formation position and the maintenance position, by attaching the supporting frames on which the cleaning liquid application nozzles 80C, 80M, 80Y and 80K and the head cleaners 100C, 100M, 100Y and 100K are installed to a main body frame (not illustrated) of the inkjet recording apparatus.

Composition of Cleaning Liquid Application Nozzles

The cleaning liquid application nozzles 80C, 80M, 80Y and 80K are provided so as to oppose the nozzle surfaces 30C, 30M, 30Y and 30K of the corresponding heads 16C, 16M, 16Y and 16K. These cleaning liquid application nozzles 80C, 80M, 80Y and 80K have emission ports corresponding to the width of the nozzle surfaces 30C, 30M, 30Y and 30K and emit cleaning liquid toward the nozzle surfaces 30C, 30M, 30Y and 30K of the corresponding heads 16C, 16M, 16Y and 16K.

The cleaning liquid is supplied from a cleaning liquid tank via a cleaning liquid supply pipe (not illustrated) and by driving a cleaning liquid spraying pump which is provided at an intermediate point of the cleaning liquid supply pipe, cleaning liquid is sprayed from the cleaning liquid application nozzles 80C, 80M, 80Y and 80K.

Cleaning liquid is applied to the nozzle surfaces 30C, 30M, 30Y and 30K by spraying cleaning liquid from the cleaning liquid application nozzles 80C, 80M, 80Y and 80K toward the nozzle surfaces 30C, 30M, 30Y and 30K while the heads 16C, 16M, 16Y and 16K are moved from the image formation position to the maintenance position (or from the maintenance position to the image formation position).

The system controller controls the application of cleaning liquid to the nozzle surfaces 30C, 30M, 30Y and 30K by controlling the driving of the cleaning liquid spraying pump and the head feed motor 60.

Composition of Head Cleaner

The head cleaners 100C, 100M, 100Y and 100K are provided so as to oppose the nozzle surfaces 30C, 30M, 30Y and 30K of the corresponding heads 16C, 16M, 16Y and 16K, and respectively press and abut a wiping web 110 formed in a band shape against the nozzle surface 30C, 30M, 30Y and 30K of the corresponding head 16C, 16M, 16Y and 16K by means of a pressing roller 118. The nozzle surfaces 30C, 30M, 30Y and 30K of the heads 16C, 16M, 16Y and 16K are wiped and cleaned by means of the respective wiping webs 110 being pressed and abutted against the nozzle surfaces 30C, 30M, 30Y and 30K in the process of moving the heads from the image formation position to the maintenance position (or moving the heads from the maintenance position to the image formation position).

The head cleaners 100C, 100M, 100Y and 100K each have the same composition and therefore the composition of one head cleaner 100 will be described here.

Figure 4:
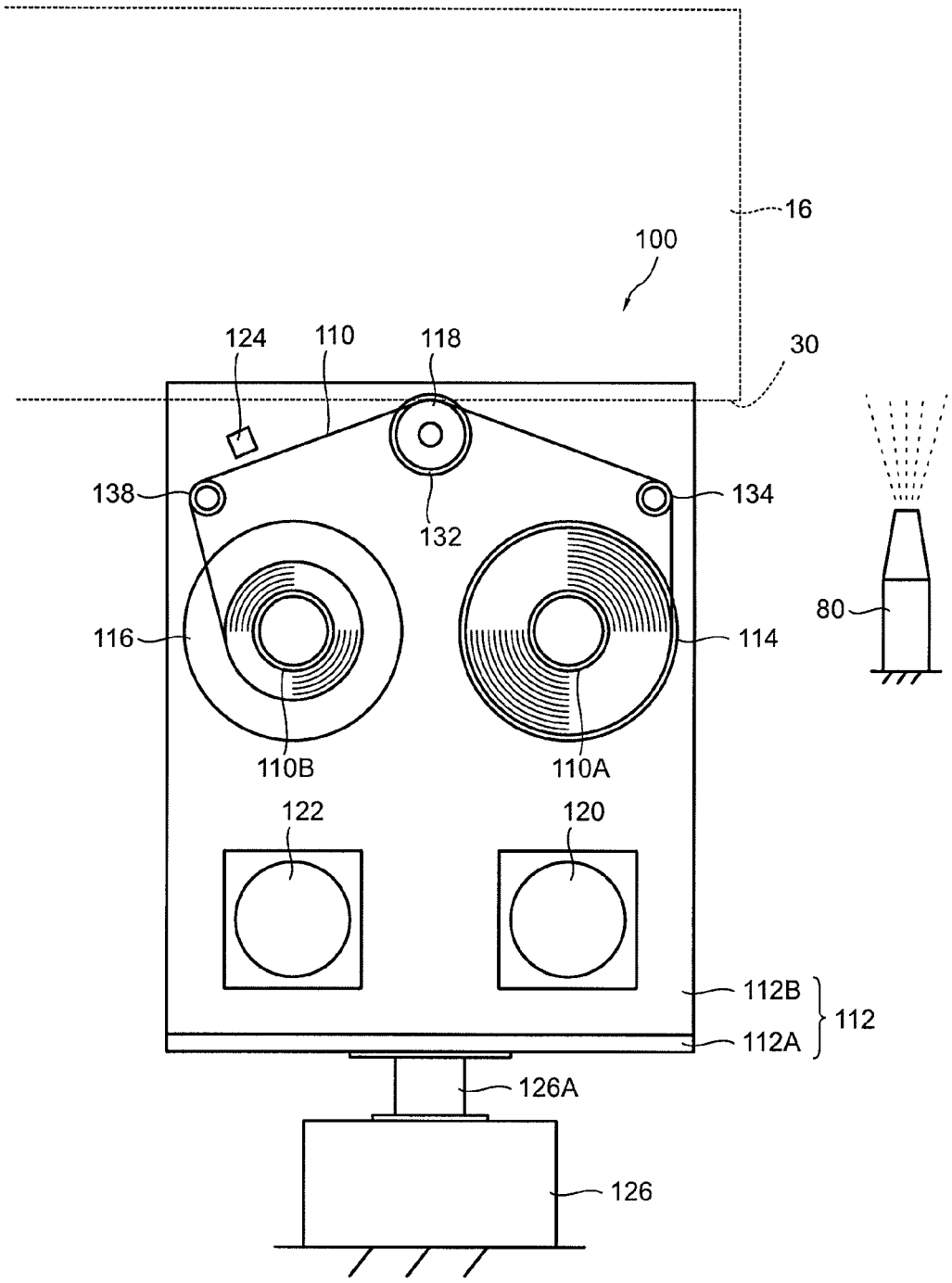
FIG. 4 is a front view diagram of a head cleaner according to a first mode.
Figure 5:
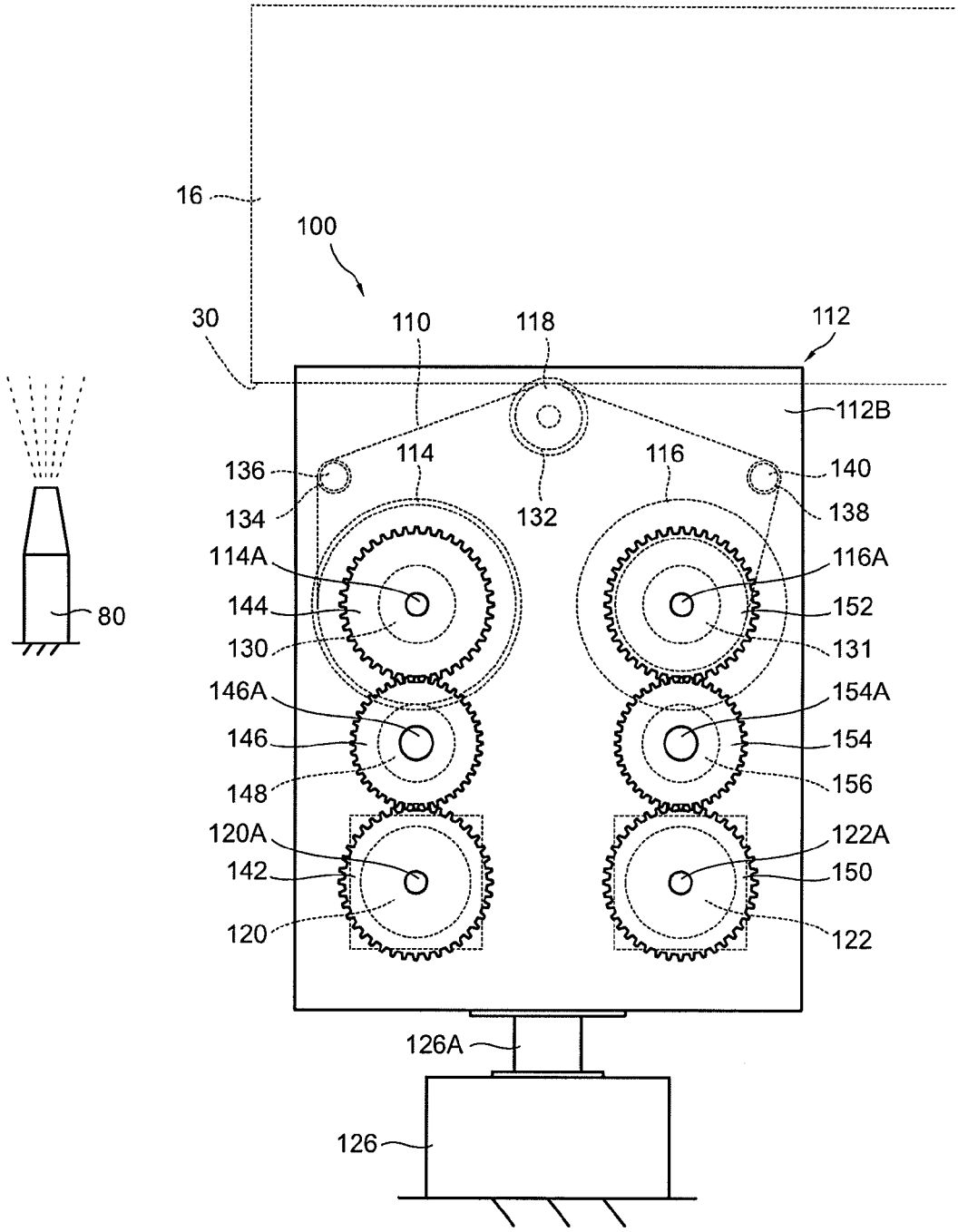
FIG. 5 is a rear view diagram of a head cleaner according to the first mode.
Figure 6:
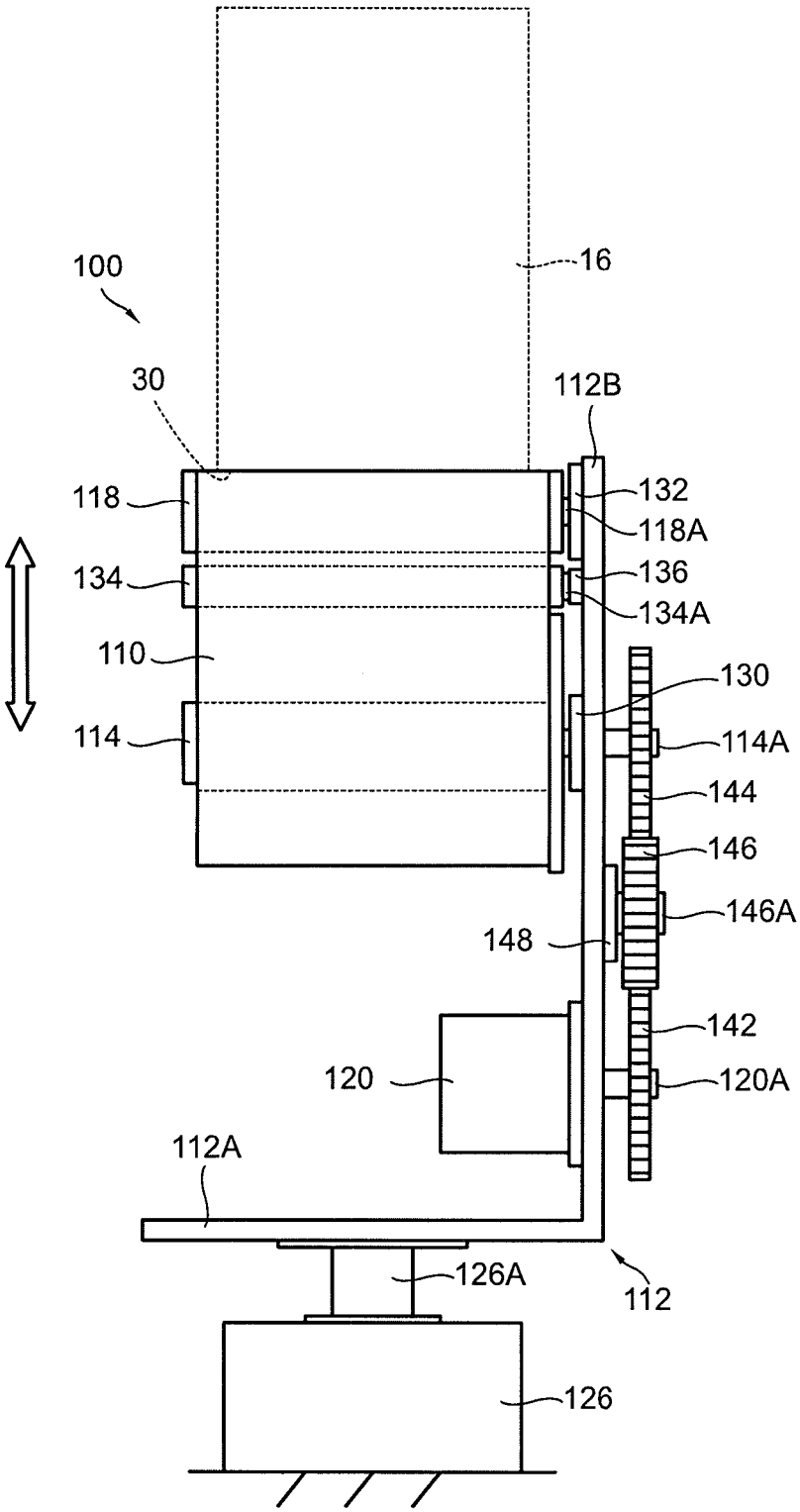
FIG. 6 is a side view diagram of a head cleaner according to the first mode.

FIG. 4 is a front view diagram of a head cleaner, FIG. 5 is a rear view diagram of a head cleaner, and FIG. 6 is a side view diagram of a head cleaner.

As shown in FIGS. 4 to 6, the head cleaner 100 wipes and cleans the nozzle surface 30 of the head 16 by wrapping a band-shaped wiping web 110 about a pressing roller 118 and pressing and abutting the wiping web 110 wrapped about the pressing roller 118 against the nozzle surface 30 (30C, 30M, 30Y and 30K) of the corresponding head 16 (16C, 16M, 16Y and 16K).

This head cleaner 100 principally comprises a main body frame 112, a pay-out reel 114 which pays out a wiping web 110, a take-up reel 116 which takes up the wiping web 110, a pressing roller 118 which presses and abuts the wiping web 110 against the nozzle surface 30 of the head 16, a wind-back motor (back-winding motor) 120 which winds the wiping web 110 back onto the pay-out reel 114 by driving the pay-out reel 114 to rotate, a take-up motor 122 which takes up the wiping web 110 onto the take-up reel 116 by driving the take-up reel 116 to rotate, a wet region determination sensor 124 which determines the wet region of the wiping web 110, and an elevator cylinder 126 which causes the main body frame 112 to advance or retract perpendicularly with respect to the nozzle surface 30 of the head 16.

The main body frame 112 is formed in an L shape and is constituted by a bottom surface section 112A provided in parallel with the nozzle surface 30 of the head 16 and a wall surface section 112B provided perpendicularly with respect to the bottom surface section 112A.

The pay-out reel 114 is provided perpendicularly with respect to the wall surface section 112B of the main body frame 112 (namely, in parallel with the nozzle surface of the corresponding head), and the axle section 114A of the reel is supported rotatably on a bearing 130 provided on the inner side of the wall surface section 112B of the main body frame 112. As described below, a winding core 110A on the pay-out side of the wiping web 110 is installed on the pay-out reel 114.

Similarly to the pay-out reel 114, the take-up reel 116 is provided perpendicularly with respect to the wall surface section 112B of the main body frame 112, and the axle section 116A of the reel is supported rotatably on a bearing 131 provided on the inner side of the wall surface section 112B of the main body frame 112. As described below, a winding core 110B on the take-up side of the wiping web 110 is installed on the take-up reel 116.

The take-up reel 116 and the pay-out reel 114 are disposed in parallel in the lateral direction at a uniform spacing apart.

The pressing roller 118 is disposed above an intermediate position between the pay-out reel 114 and the take-up reel 116, and the wiping web 110 which travels between the pay-out reel 114 and the take-up reel 116 is wrapped about the pressing roller 118. The pressing roller 118 is provided perpendicularly with respect to the wall surface section 112B of the main body frame 112, and an axle section 118A of the roller is supported rotatably on a bearing 132 provided on the inner side of the wall surface section 112B of the main body frame 112.

The wiping web 110 paid out from the pay-out reel 114 is wrapped about the pressing roller 118 via a pay-out guide roller 134 which is disposed between the pay-out reel 114 and the pressing roller 118. The pay-out guide roller 134 is provided perpendicularly with respect to the wall surface section 112E of the main body frame 112, and an axle section 134A of the roller is supported rotatably on a bearing 136 provided on the inner side of the wall surface section 112B of the main body frame 112.

Furthermore, the wiping web 110 wrapped about the pressing roller 118 is wrapped onto the take-up reel 116 via an installation guide roller 138 which is disposed between the pressing roller 118 and the take-up reel 116. The take-up guide roller 138 is provided perpendicularly with respect to the wall surface section 112B of the main body frame 112, and an axle section 138A of the roller is supported rotatably on a bearing 140 provided on the inner side of the wall surface section 112B of the main body frame 112.

The wind-back motor 120 is disposed below the pay-out reel 114 and is installed perpendicularly on the inner side of the wall surface section 112B of the main body frame 112. The output axle 120A of the wind-back motor 120 is provided so as to project to the outer side of the wall surface section 112B, and a wind-back drive gear 142 is fixed to the front end of this axle.

The axle section 114A of the pay-out reel 114 is provided so as to project to the outer side of the wall surface section 112B, and a wind-back passive gear 144 is fixed to the front end of this axle. This wind-back passive gear 144 meshes with the wind-back drive gear 142 via the wind-back idle gear 146.

The wind-back idle gear 146 is disposed on the outer side of the wall surface section 112B of the main body frame 112, and an axle section 146A of the gear is supported rotatably on a bearing 148 provided on the outer side of the wall surface section 112B of the main body frame 112.

When the wind-back motor 120 is driven, the wind-back drive gear 142 is rotated and this rotation is transmitted to the wind-back passive gear 144 via the wind-back idle gear 146. By this means, the pay-out reel 114 is turned in the opposite direction to the pay-out direction, in other words, in a direction which takes up the wiping web 110.

The take-up motor 122 is disposed below the take-up reel 116 and is installed perpendicularly on the inner side of the wall surface section 112B of the main body frame 112. The output axle 122A of the take-up motor 122 is provided so as to project to the outer side of the wall surface section 112B, and a take-up drive gear 150 is fixed to the front end of this axle.

The axle section 116A of the take-up reel 116 is provided so as to project to the outer side of the wall surface section 112B, and a take-up passive gear 152 is fixed to the front end of this axle. This take-up passive gear 152 meshes with the take-up drive gear 150 via a take-up idle gear 154.

The take-up idle gear 154 is disposed on the outer side of the wall surface section 112B of the main body frame 112, and an axle section 154A thereof is supported rotatably on a bearing 156 provided on the outer side of the wall surface section 112B of the main body frame 112.

When the take-up motor 122 is driven, the take-up drive gear 150 is rotated and this rotation is transmitted to the take-up passive gear 152 via the take-up idle gear 154. By this means, the take-up reel 116 is turned in a direction which takes up the wiping web 110.

The wet region determination sensor 124 is arranged between the pressing roller 118 and the take-up guide roller 138, and determines the wet region of the wiping web 110 traveling between same. The wet region determination sensor 124 is constituted by a photosensor comprising a light emitting section and a light receiving section, for example, and determines the wet region of the wiping web 110 by receiving the reflected light of the light which is emitted toward the wiping web 110 from the light emitting section. Furthermore, the wet region determination sensor 124 operates in accordance with instructions from the system controller, and the determination result is output to the system controller.

Figure 7A:
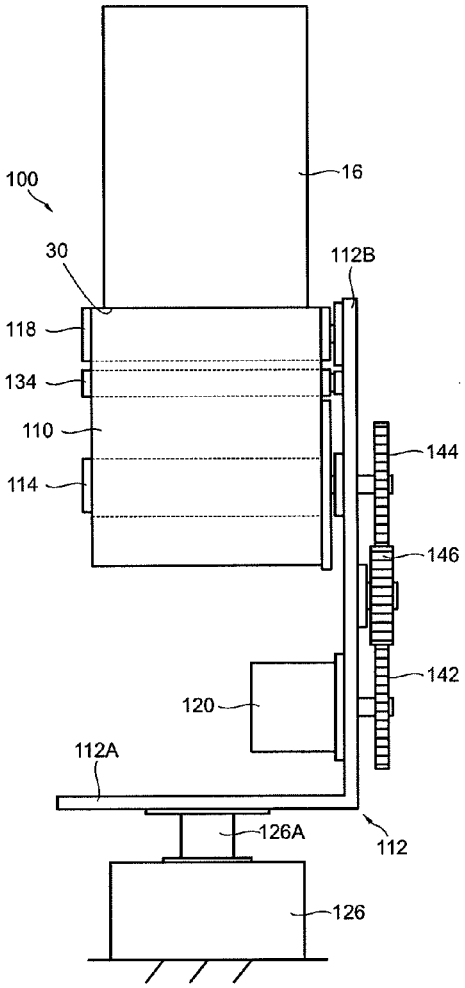
FIGS. 7A and 7B are illustrative diagrams of the operation of a head cleaner.
Figure 7B:
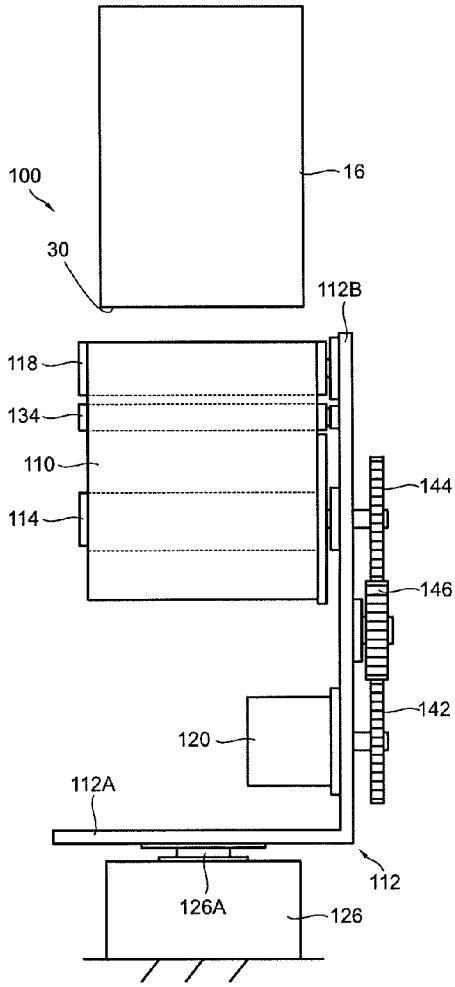

An elevator cylinder 126 is fixed to the head cleaning apparatus main body (not illustrated), and a main body frame 112 is fixed to the front end of the rod 126A. The main body frame 112 is advanced and retracted perpendicularly to the nozzle surface 30 of the corresponding head 16, by driving this elevator cylinder 126. By advancing and retracting the main body frame 112 with respect to the nozzle surface 30, the pressing roller 118 is moved between a prescribed "pressing position" and "withdrawn position", as shown in FIGS. 7A and 7B.

The wiping web 110 wrapped about the pressing roller 118 is pressed and abutted against the nozzle surface 30 of the corresponding head 16, when the pressing roller 118 is disposed at the pressing position. When the pressing roller 118 is disposed at the withdrawn position, the wiping web 110 is withdrawn from the nozzle surface 30 of the corresponding head 16. More specifically, the wiping web 110 is separated from the nozzle surface 30 so as not to make contact with the nozzle surface 30.

The head cleaner 100 has the composition described above.

The wiping web 110 is made of high-density fibers, such as polyester, acrylic, nylon, or the like, and is installed on the head cleaner 100 as described below. The wiping web 110 is supplied in a state where the respective ends thereof are attached to the winding cores 110A and 110B, and the web is wound up in the form of a roll on one of the winding cores (the pay-out side winding core) 110A. When this wiping web 110 is installed on the head cleaner 100, firstly, the winding core 110A on the pay-out side is installed on the pay-out reel 114. The wiping web 110 installed on the pay-out reel 114 is paid out a small amount at a time and wrapped in sequence about the pay-out guide roller 134, the pressing roller 118 and the take-up guide roller 138, and the winding core on the front end (the take-up side winding core) 110B is installed on the take-up reel 116. By this means, the wiping web 110 is installed on the head cleaner 100.

The head cleaner 100 on which the wiping web 110 is installed winds the wiping web 110 up from the pay-out reel 114 to the take-up reel 116 by driving the winding motor 122 to rotate. By this means, the wiping web 110 which is wrapped about the pressing roller 118 is caused to travel.

The wiping web 110 wrapped about the pressing roller 118 travels in parallel with the direction of movement of the head 16, and travels in the opposite direction when the head 16 is moved from the image formation position to the maintenance position. Furthermore, the wiping web 110 travels in the same direction when the head 16 is moved from the maintenance position to the image formation position.

The wiping web 110 can be wound back onto the pay-out reel 114 and is wound back onto the pay-out reel 114 when the wind-back motor 120 is driven to rotate.

The system controller cleans the nozzle surface 30 of the head 16, by controlling the driving of the wind-back motor 120, the take-up motor 122, the elevator cylinder 126 and the head feed motor 60.

Head Cleaning Method

Next, a cleaning method for a head using the head cleaning apparatus 70 according to the present embodiment will be described.

The cleaning of the heads 16C, 16M, 16Y and 16K is carried out by wiping respectively with a wiping web 110 after applying a cleaning liquid to the whole area of the nozzle surfaces 30C, 30M, 30Y and 30K. In the head cleaning apparatus 70 according to the present embodiment, the operation of wiping the nozzle surfaces 30C, 30M, 30Y and 30K with the wiping webs 110 is divided into two separate actions. More specifically, the first wiping action involves wiping with a wiping web 110 in a normal state of high absorption capability, and the second wiping action involves wiping with a wiping web 110 in a state of low absorption capability. In this way, by wiping the nozzle surfaces 30C, 30M, 30Y and 30K in two separate wiping actions, it is possible to prevent wiping traces and wiping omissions. In other words, the first wiping action prevents wiping omissions by wiping the nozzle surface with a wiping web 110 in a state of normal high absorption capability, thereby removing large liquid droplets on the nozzle surface. The subsequent second wiping action removes the wiping trace produced by the first wiping action as well as preventing ink from being drawn out from the nozzle holes, by wiping with a wiping web 110 in a state of low absorption capability. By this means, it is possible to clean the nozzle surfaces 30C, 30M, 30Y and 30K without the occurrence of wiping traces or wiping omissions.

Here, the switching of the absorption capability of the wiping web 110 is achieved by wetting the wiping web 110 and lowering the absorption capability by making the wiping web 110 absorb a prescribed amount of cleaning liquid. Therefore, the second wiping action is carried out using a wetted region (wet region) of the wiping web 110.

Figure 8:
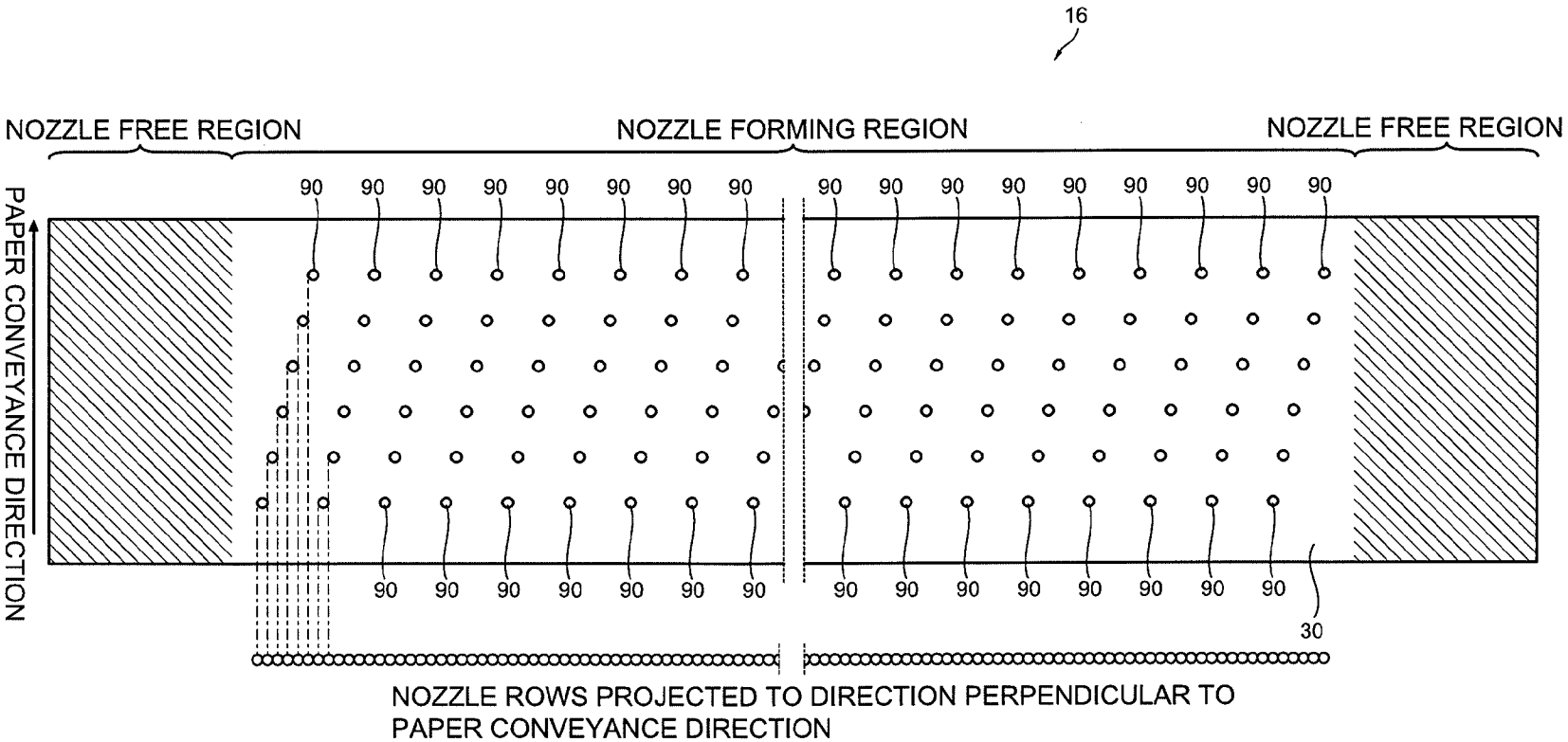
FIG. 8 is a bottom view diagram of a line head according to the first mode.

In the head cleaning apparatus 70 according to the present embodiment, the wet region used for the second wiping action is created by wiping the wiping web 110 on a region of the nozzle surface 30C where nozzles are not formed. More specifically, as shown in FIG. 8, the nozzles 90 are not formed over the whole of the breadthways direction of the nozzle surface 30, but rather are formed so as to correspond to the width of the paper that is to be recorded on. Therefore, normally, there is a region at either end where nozzles are not formed (nozzle free region). The nozzle free regions (in FIG. 8, the obliquely shaded regions at either end of the head) are in a relatively clean state and therefore the wiping web 110 does not become soiled even after wiping these regions. Consequently, even if the wiping web 110 is reused, the nozzle surface 30 is not soiled thereby.

In this way, in the head cleaning apparatus 70 according to the present embodiment, a second wiping action is carried out using a wet region of a wiping web 110 which is produced by wiping over the nozzle free region in the first wiping action.

In the example of the head 16 shown in FIG. 8, nozzle rows are formed by arranging nozzles 90 in a staggered matrix configuration on the nozzle surface 30. By adopting an arrangement of this kind for the nozzles 90, it is possible to reduce the effective pitch between the nozzles 90 as projected to the lengthwise direction of the head 16 (namely, a direction perpendicular to the conveyance direction of the paper; in other words, the breadthways direction of the paper), and therefore a high-density configuration of the nozzles 90 can be achieved.

Below, a specific cleaning method for the heads 16C, 16M, 16Y and 16K using the head cleaning apparatus 70 according to the present embodiment will be described.

Firstly, cleaning liquid is applied to the nozzle surfaces 30C, 30M, 30Y and 30K of the heads 16C, 16M, 16Y and 16K in order to dissolve the adhering material created by the ink which is adhering to the nozzle surfaces 30C, 30M, 30Y and 30K.

The cleaning liquid is applied by moving the heads 16C, 16M, 16Y and 16K from the image formation position towards the maintenance position (or from the maintenance position towards the image formation position), as well as spraying cleaning liquid from the cleaning liquid application nozzles 80C, 80M, 80Y and 80K toward the nozzle surfaces 30C, 30M, 30Y and 30K of the heads 16C, 16M, 16Y and 16K. More specifically, the procedure is as follows. When the heads 16C, 16M, 16Y and 16K are moved from the image formation position toward the maintenance position, the heads 16C, 16M, 16Y and 16K pass over the cleaning liquid application nozzles 80C, 80M, 80Y and 80K and therefore cleaning liquid is sprayed from the cleaning liquid application nozzles 80C, 80M, 80Y and 80K in coordination with the passage of the heads 16C, 16M, 16Y and 16K. By this means, cleaning liquid is applied to the whole area of the nozzle surfaces 30C, 30M, 30Y and 30K, including the nozzle free regions.

The application of cleaning liquid may be carried out once, or a plurality of times. If cleaning liquid is applied a plurality of times, the heads 16C, 16M, 16Y and 16K are moved back and forth a plurality of times during application.

When the application of the cleaning liquid has been completed, the heads 16C, 16M, 16Y and 16K are returned temporarily to the image formation position. Thereupon, a first wiping and cleaning action (first cleaning step) is carried out.

As described above, this first wiping action is carried out using a wiping web in a normal state of high absorption capability. In other words, this wiping action is carried out using an unused region of the wiping web 110 which has not been wetted (non-wet region). More specifically, the procedure is as follows.

Firstly, the position of the non-wet region of the wiping web (head position) is located. More specifically, the position of the wiping web 110 is located in such a manner that the non-wet region is wrapped about the pressing roller 118 (so that the non-wet region is abutted against the nozzle surface). This step is carried out on the basis of the output from the wet region determination sensor 124 and is performed by winding the wiping web 110 onto the take-up reel 116 until a wet region ceases to be determined by the wet region determination sensor 124.

After locating the position of the non-wet region in this way, the wiping webs 110 are respectively pressed and abutted against the nozzle surfaces 30C, 30M, 30Y and 30K of the heads 16C, 16M, 16Y and 16K while being caused to travel at a uniform speed in the take-up direction, thereby wiping and cleaning the nozzle surfaces 30C, 30M, 30Y and 30K. More specifically, the procedure is as follows.

Figure 9A:
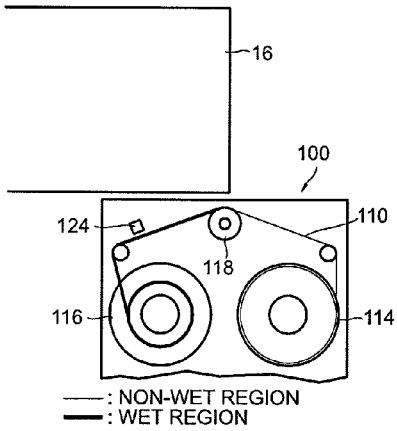
FIGS. 9A to 9F are illustrative diagrams of the operation of a head cleaning apparatus according to the first mode.

Firstly, the heads 16C, 16M, 16Y and 16K are moved towards the maintenance position. As the heads 16C, 16M, 16Y and 16K are moved toward the maintenance position, they are halted temporarily when the end portion on one side thereof (the end portion on the maintenance position side) arrives at the installation position of the pressing roller 118, as shown in FIG. 9A. In this case, the pressing rollers 118 of the cleaners 100C, 100M, 100Y and 100K are situated in a prescribed withdrawn position.

When the heads 16C, 16M, 16Y and 16K are halted, the elevator cylinders 126 are driven and the pressing rollers 118 are moved to a pressing position. As a result of this, the wiping webs 110 wrapped about the pressing rollers 118 are pressed and abutted against the nozzle surfaces 30C, 30M, 30Y and 30K of the heads 16C, 16M, 16Y and 16K (see FIG. 9B and FIG. 7A).

Thereupon, the take-up motors 122 are driven, the wiping webs 110 are taken up onto the take-up reels 116 at a uniform speed, and the head feed motor 60 is driven and the heads 16C, 16M, 16Y and 16K are conveyed at a uniform speed toward the maintenance position. As a result, as shown in FIG. 9C, the wiping webs 110 are slid in contact with the nozzle surfaces 30C, 30M, 30Y and 30K of the heads 16C, 16M, 16Y and 16K, and the nozzle surfaces 30C, 30M, 30Y and 30K are wiped and cleaned by the traveling wiping webs 110.

In this case, the wiping webs 110 travel in the opposite direction to the direction of movement of the heads 16C, 16M, 16Y and 16K. Accordingly, it is possible to increase the relative differential velocity, and the cleaning effect can be improved.

The heads 16C, 16M, 16Y and 16K which have been conveyed to the maintenance position are halted when the end portion on the other side (the end portion on the side of the image formation position) arrives at the installation position of the pressing roller 118. The travel of the wiping webs 110 is also halted in synchronism with the halting of the conveyance of the heads 16C, 16M, 16Y and 16K. By this means, the first wiping and cleaning action is completed and the whole area of the nozzle surfaces 30C, 30M, 30Y and 30K is wiped and cleaned by the wiping webs 110.

Figure 9D:
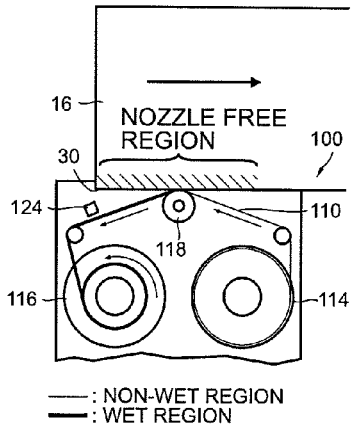

As described above, nozzle free regions are formed in the respective end portions of the nozzle surfaces 30C, 30M, 30Y and 30K of the heads 16C, 16M, 16Y and 16K, and as shown in FIG. 9D, in the first wiping and cleaning action, these nozzle free regions are also wiped and cleaned. The second wiping and cleaning action is carried out by using the wet regions formed on the wiping webs 110 by the wiping and cleaning of these nozzle free regions.

Here, since the wet region will have already been taken up onto the take-up reel 116 side, then a prescribed wind-back operation is carried out. In other words, in each of the head cleaners 100C, 100M, 100Y and 100K, as shown in FIG. 9E, when the travel of the wiping web 110 is halted, the pressing roller 118 is temporarily withdrawn to a withdrawn position and the wiping web 110 is wound back to the side of the pay-out reel 114 in accordance with the amount which has wiped the nozzle free region.

The amount of winding back is determined on the basis of the length of the nozzle free region, the speed of travel of the wiping web 110, the feed velocity of the heads 16C, 16M, 16Y and 16K, and the like.

As described above, the wiping web 110 is wound back to the side of the pay-out reel 114 in accordance with the amount which has wiped the nozzle free region, thereby forming a wet region for the second wiping and cleaning action.

While this wind-back processing of the wet region is carried out, the heads 16C, 16M, 16Y and 16K are returned until the end portion on the one side is situated at the installation position of the pressing roller 118.

Figure 9B:
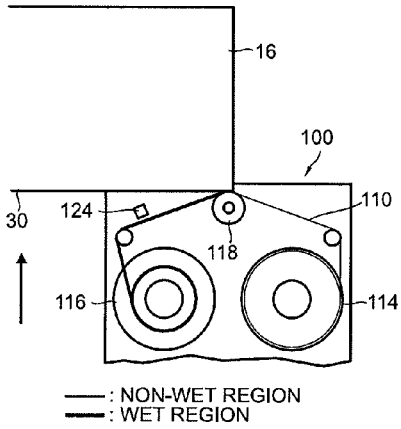
Figure 9E:
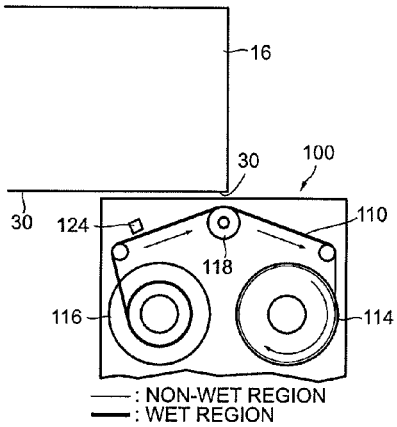
Figure 9C:
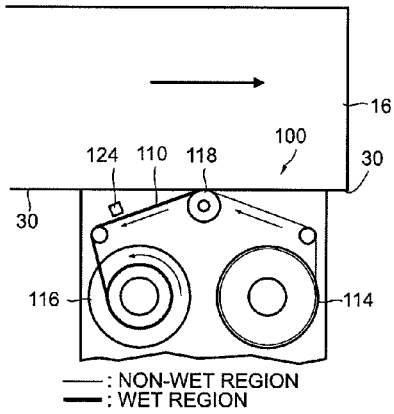

When the wind-back processing of the wet region is completed and the end portion on the one side of each of the heads 16C, 16M, 16Y and 16K has been disposed at the installation position of the pressing roller 118, then the pressing rollers 118 are moved to the pressing position and the wiping webs 110 wrapped about the pressing rollers 118 are pressed and abutted against the nozzle surfaces 30C, 30M, 30Y and 30K of the heads 16C, 16M, 16Y and 16K (see FIG. 9B and FIG. 7A).

Figure 9F:
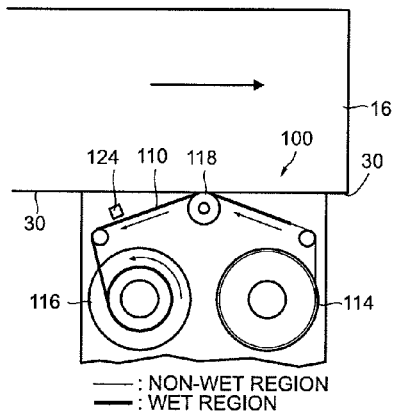

Thereupon, the take-up motors 122 are driven, the wiping webs 110 are taken up onto the take-up reels 116 at a uniform speed, and the head feed motor 60 is driven and the heads 16C, 16M, 16Y and 16K are conveyed at a uniform speed toward the maintenance position. As a result, as shown in FIG. 9F, the wet regions of the wiping webs 110 are slid in contact with the nozzle surfaces 30C, 30M, 30Y and 30K of the heads 16C, 16M, 16Y and 16K, and the nozzle surfaces 30C, 30M, 30Y and 30K are wiped and cleaned by the wet regions of the wiping webs 110.

In this second wiping and cleaning action, the wiping webs 110 travel in the opposite direction to the direction of movement of the heads 16C, 16M, 16Y and 16K. Accordingly, it is possible to increase the relative differential velocity, and the cleaning effect can be improved.

Since the wet region that is wound back is limited in size, then during the second wiping and cleaning action the speed of travel of the wiping web 110 is adjusted so as to be able to wipe and clean the nozzle surfaces 30C, 30M, 30Y and 30K by using the wet region that has been wound back.

In this way, the second wiping and cleaning action is carried out using a wet region of the wiping web 110. By using a wet region to wipe and clean the nozzle surfaces 30C, 30M, 30Y and 30K in this way, it is possible effectively to remove any wiping traces which may have occurred during the first wiping and cleaning action. Furthermore, by wiping and cleaning the nozzle surfaces 30C, 30M, 30Y and 30K using a wet region in this way, it is possible to prevent ink from being drawn out from the nozzle holes by the wiping action (namely, to prevent the occurrence of wiping traces). In each of the respective head cleaners 100C, 100M, 100Y and 100K, the travel of the wiping web 110 is halted when the other side end portion of the head 16C, 16M, 16Y and 16K has passed the pressing roller 118.

The heads 16C, 16M, 16Y and 16K, on the other hand, are moved directly towards the maintenance position.

In the head cleaners 100C, 100M, 100Y and 100K in which the travel of the wiping webs 110 has been halted, the pressing rollers 118 are withdrawn to the withdrawn position, whereby the cleaning operation is ended.

After this, the head cleaners 100C, 100M, 100Y and 100K carry out location of a non-wet region for the next cleaning process, according to requirements.

As described above, in the head cleaning apparatus 70 according to the present embodiment, after wiping and cleaning the nozzle surfaces 30C, 30M, 30Y and 30K with the wiping webs 110 once, the absorption capability of the wiping webs 110 is lowered and the nozzle surfaces 30C, 30M, 30Y and 30K are wiped and cleaned again with the wiping webs 110. By this means, it is possible to clean the nozzle surfaces 30C, 30M, 30Y and 30K without the occurrence of wiping traces or wiping omissions. Furthermore, by switching the absorption capability through wetting the wiping webs 110 in this way, it is possible to increase the range of choice of the wiping web that can be used.

In the present example, the first wiping and cleaning action which uses a non-wet region is carried out just once, but it may also be carried out a plurality of times. More specifically, the heads 16C, 16M, 16Y and 16K may be moved back and forth a plurality of times with the wiping webs 110 pressed and abutted against the heads, so as to carry out the first wiping and cleaning action. Similarly, the second wiping and cleaning action which uses a wet region may be carried out a plurality of times.

Furthermore, in the present example, the wiping webs 110 are made to travel in the opposite direction to the direction of movement of the heads 16C, 16M, 16Y and 16K when carrying out the second wiping and cleaning action using the wet region, but this wiping and cleaning action may also be carried out with the webs traveling in the same direction as the heads. In this case, the wiping webs 110 are pressed and abutted against the nozzle surfaces 30C, 30M, 30Y and 30K while conveying the heads 16C, 16M, 16Y and 16K at a uniform speed toward the maintenance position and winding back the wiping webs 110 in accordance with the amount of web which has wiped and cleaned the nozzle free region. By this means, it is possible to wipe and clean the nozzle surfaces 30C, 30M, 30Y and 30K while causing the wiping webs 110 to travel in the same direction as the direction of movement of the heads 16C, 16M, 16Y and 16K.

Furthermore, it is also possible to carry out two wiping and cleaning actions using a wet region in a state where the wiping webs 110 have been halted and are not traveling.

The amount of wetting of the wet region used in the second wiping and cleaning action is desirably set appropriately in accordance with the absorption capacity of the wiping web 110 used (for example, the wet region is wetted so that the absorption capability falls to 20% approximately). In this case, desirably, the amount of wetting is increased, the greater the relative velocity differential between the heads 16C, 16M, 16Y and 16K and the wiping webs 110 during the second wiping and cleaning action. By this means, the absorption capability can be adjusted appropriately and the second wiping and cleaning action can be carried out in a suitable fashion.

In order to adjust the wetting amount, the amount of cleaning liquid applied to the nozzle free region is adjusted.

Furthermore, the head cleaners 100C, 100M, 100Y and 100K according to the present embodiment respectively comprise a wet region determination sensor 124, but this wet region determination sensors 124 does not necessarily have to be provided, and it is also possible to locate the wiping web 110 in a desired position by controlling the amount of winding out and winding back of the wiping web 110. By providing a wet region determination sensor 124, it is possible to achieve accurate positional location, as well as being able to determine the presence or absence of the wiping web 110.

Furthermore, in the present example, the wet regions are formed respectively by wiping the traveling wiping webs 110 on the nozzle free regions formed on the nozzle surfaces 30C, 30M, 30Y and 30K of the heads 16C, 16M, 16Y and 16K, but wet regions can also be formed by causing ink to seep out from the nozzles after the first wiping and cleaning action and wiping the wiping webs 110 on this ink. In this case, it is not particularly necessary to cause ink to seep out from all of the nozzles, and ink should be caused to seep out from nozzles in a necessary range in order to create a wet region.

Furthermore, normally, the cleaning liquid absorbed into the wiping web 110 wets and spreads, and therefore the region into which the liquid wets and spreads in an unused part of the web is used as the wet region.

Moreover, in the present example, in order to dissolve the adhering material caused by the ink, cleaning liquid is applied previously to the nozzle surfaces 30C, 30M, 30Y and 30K in order to wet the nozzle surfaces 30C, 30M, 30Y and 30K, but there are no particular restrictions on the method of wetting the nozzle surfaces 30C, 30M, 30Y and 30K. For example, it is also possible to use ink as a wetting liquid. In this case, ink is caused to seep out from the nozzles formed on the nozzle surfaces 30C, 30M, 30Y and 30K, so as to wet the nozzle surfaces 30C, 30M, 30Y and 30K. Furthermore, in this case, the nozzle surfaces 30C, 30M, 30Y and 30K are sealed with a cap, the internal pressure of the cap is reduced, and the ink is suctioned onto the nozzle surfaces 30C, 30M, 30Y and 30K and thus caused to seep out from the nozzles. Alternatively, the ink is caused to seep out onto the nozzle surfaces by applying pressure to the flow channels from the ink tanks to the heads.

If ink is used as the wetting liquid in this way, then it is possible to omit the cleaning liquid application nozzles 80C, 80M, 80Y and 80K.

Second Embodiment of First Mode

Figure 10:
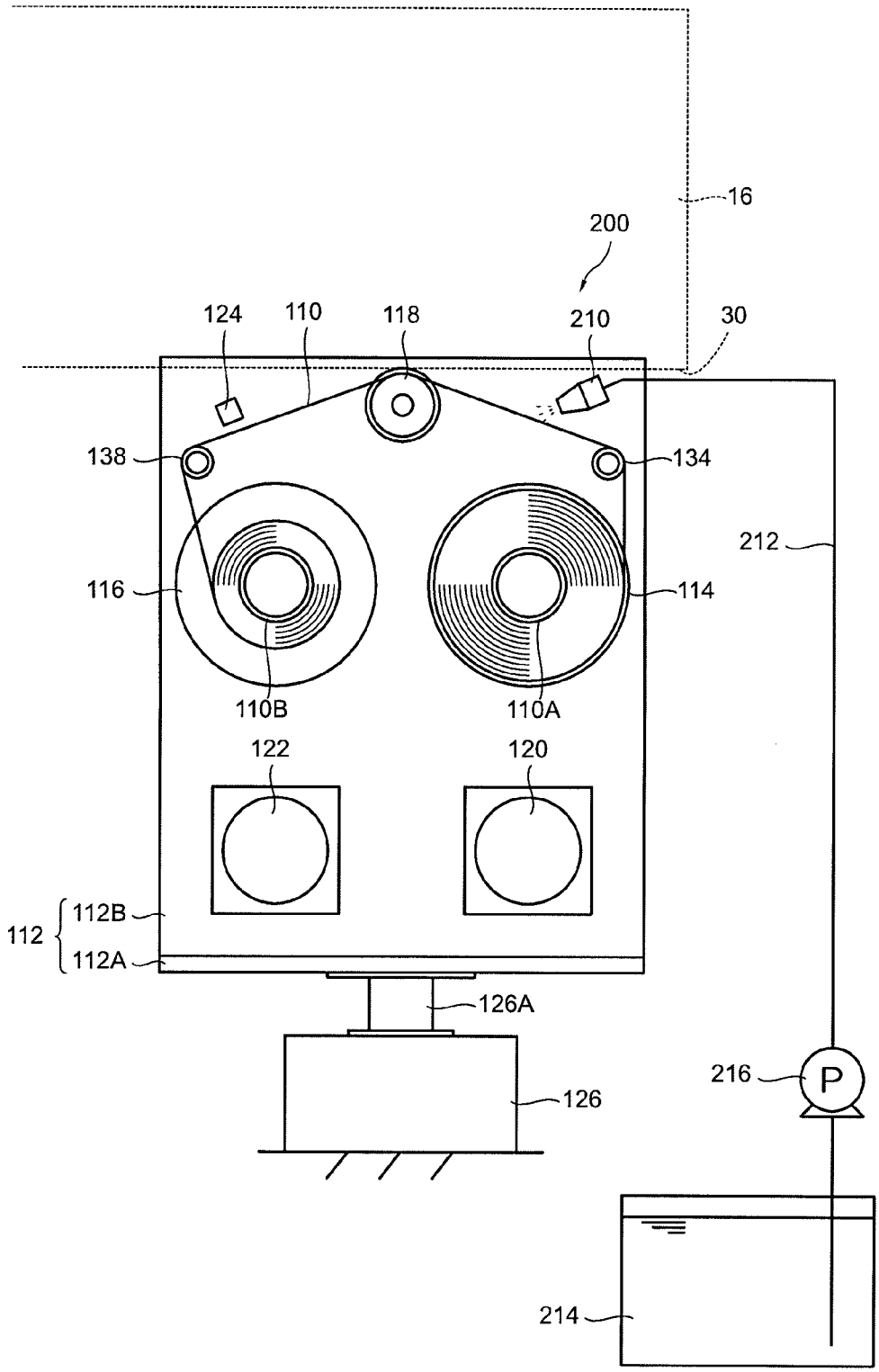
FIG. 10 is a front view diagram of a second embodiment of a head cleaner according to the first mode.

FIG. 10 is a front view diagram of a second embodiment of a head cleaner according to the first mode. As shown in FIG. 10, the head cleaner 200 according to the present embodiment comprises a wetting liquid deposition nozzle 210 for wetting the wiping web 110 by depositing cleaning liquid thereon.

Apart from the fact that this wetting liquid deposition nozzle 210 is provided, this head cleaner is the same as the head cleaner 100 according to the first embodiment of the first mode which is described above. Consequently, only the wetting liquid deposition nozzle 210 is described here.

As shown in FIG. 10, the wetting liquid deposition nozzle 210 is disposed between the pay-out guide roller 134 and the pressing roller 118 (on the upstream side of the pressing roller 118 in terms of the direction of travel of the wiping web 110 when being taken up onto the take-up reel 116). This wetting liquid deposition nozzle 210 has a spray port corresponding to the width of the wiping web 110, and sprays a wetting liquid onto the wiping web 110 which travels between the pay-out guide roller 134 and the pressing roller 118 (the wiping web 110 on the upstream side of the pressing roller 118 in terms of the direction of travel of the wiping web 110 when being taken up onto the take-up reel 116), thereby wetting the wiping web 110. By this means, it is possible to wet the wiping web 110 before the web is pressed and abutted against the nozzle surface 30 of the head 16.

The wetting liquid is supplied from a wetting liquid tank 214 via a wetting liquid supply pipe 212 which is connected to the wetting liquid deposition nozzle 210, and by driving a wetting liquid spray pump 216 which is provided at an intermediate point of the wetting liquid supply pipe 212, the wetting liquid is sprayed from the wetting liquid deposition nozzle 210.

Head Cleaning Method

Next, a cleaning method for a head using the head cleaner according to the present embodiment will be described.

The fact of switching the absorption capability of the wiping web 110 and wiping the nozzle surfaces 30C, 30M, 30Y and 30K in two separate actions is the same as the cleaning method of the first embodiment of the first mode which is described previously. More specifically, the first action involves wiping by a wiping web 110 in a state of normal high absorption capability, and the second action involves wiping by a wetted wiping web 110 in a state of low absorption capability.

Firstly, the non-wet region of the wiping web is located in position. As described above, the first wiping action is carried out using a wiping web in a normal state of high absorption capability, in other words, an unused region which has not been wetted (non-wet region), and therefore this non-wet region is located in position. If this positional location of the non-wet region has already been completed, then this process is not necessary.

Figure 11A:
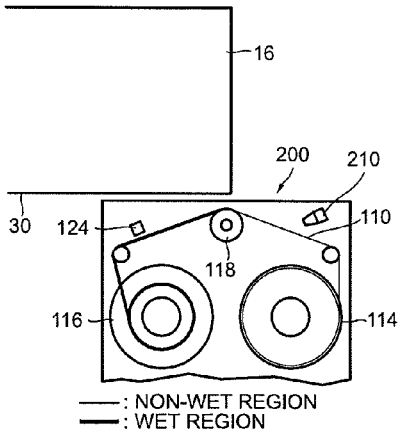
FIGS. 11A to 11F are illustrative diagrams of the operation of a head cleaning apparatus according to the first mode.

When the respective non-wet regions have been located in position, the heads 16C, 16M, 16Y and 16K are moved towards the maintenance position. As the heads 16C, 16M, 16Y and 16K are moved toward the maintenance position, they are halted temporarily when the end portion on one side thereof (the end portion on the maintenance position side) arrives at the installation position of the pressing roller 118, as shown in FIG. 11A. In this case, the pressing rollers 118 of the cleaners 100C, 100M, 100Y and 100K are situated in a prescribed withdrawn position.

When the heads 16C, 16M, 16Y and 16K are halted, the elevator cylinders 126 are driven and the pressing rollers 118 are moved to a pressing position. As a result of this, the wiping webs 110 wrapped about the pressing rollers 118 are pressed and abutted against the nozzle surfaces 30C, 30M, 30Y and 30K of the heads 16C, 16M, 16Y and 16K (see FIG. 11B and FIG. 7A).

Thereupon, the take-up motors 122 are driven, the wiping webs 110 are taken up onto the take-up reels 116 at a uniform speed, and the head feed motor 60 is driven to convey the heads 16C, 16M, 16Y and 16K at a uniform speed toward the maintenance position. As a result, as shown in FIG. 11C, the respective wiping webs 110 are slid in contact with the nozzle surfaces 30C, 30M, 30Y and 30K of the heads 16C, 16M, 16Y and 16K, and the nozzle surfaces 30C, 30M, 30Y and 30K are wiped and cleaned by the traveling wiping webs 110.

In this case, the wiping webs 110 travel in the opposite direction to the direction of movement of the heads 16C, 16M, 16Y and 16K. Accordingly, it is possible to increase the relative differential velocity, and the cleaning effect can be improved.

The heads 16C, 16M, 16Y and 16K which have been conveyed to the maintenance position are halted when the end portion on the other side (the end portion on the side of the image formation position) arrives at the installation position of the pressing roller 118. The travel of the wiping webs 110 is also halted in synchronism with the halting of the conveyance of the heads 16C, 16M, 16Y and 16K. By this means, the first wiping and cleaning action is completed and the whole area of the nozzle surfaces 30C, 30M, 30Y and 30K is wiped and cleaned by the wiping webs 110.

Figure 11D:
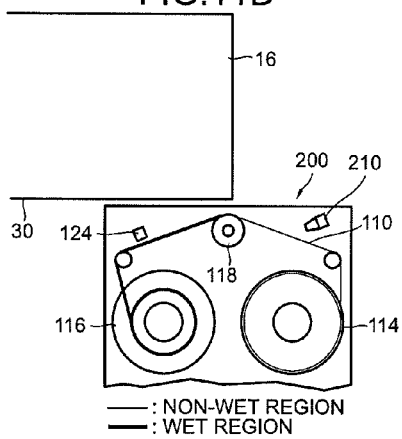
Figure 11B:
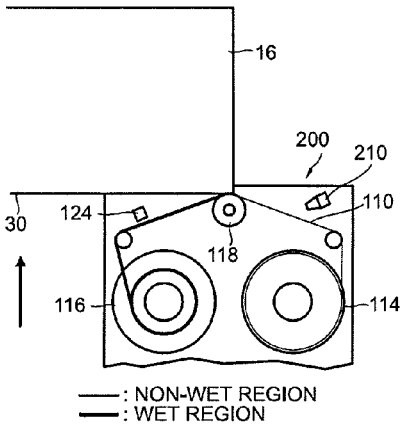

When the first wiping and cleaning action has been completed, as shown in FIG. 11D, each pressing roller 118 is withdrawn temporarily to a withdrawn position. Furthermore, the heads 16C, 16M, 16Y and 16K are returned in such a manner that the end portion on one side thereof is disposed at the installation position of the pressing roller 118.

Figure 11E:
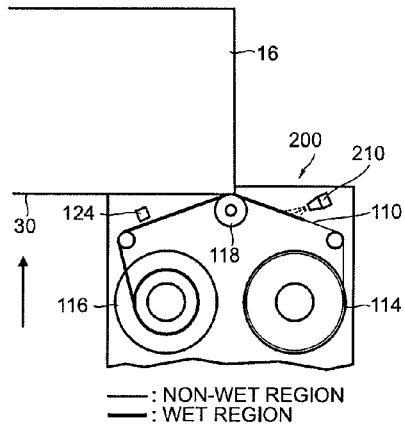
Figure 11C:
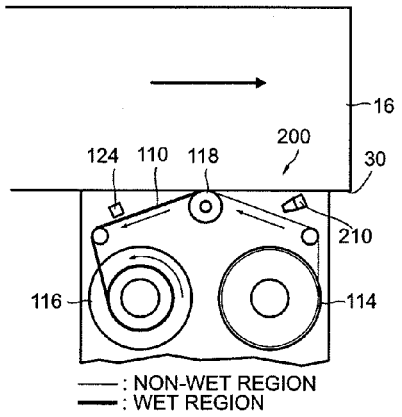

When the end portion on one side of each of the heads 16C, 16M, 16Y and 16K is situated at the installation position of the pressing roller 118, then as shown in FIG. 11E, the pressing rollers 118 are moved to a pressing position and the wiping webs 110 wrapped about the pressing rollers 118 are pressed and abutted against the nozzle surfaces 30C, 30M, 30Y and 30K of the heads 16C, 16M, 16Y and 16K.

Figure 11F:
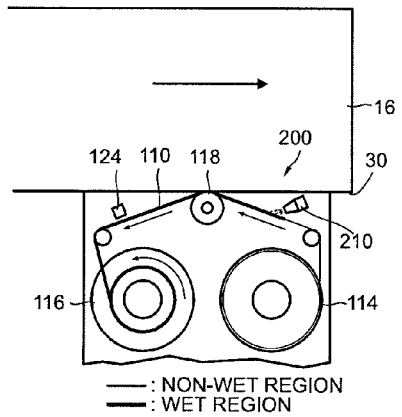

Thereupon, the take-up motors 122 are driven, the wiping webs 110 are taken up onto the take-up reels 116 at a uniform speed, and the head feed motor 60 is driven to convey the heads 16C, 16M, 16Y and 16K at a uniform speed toward the maintenance position. Furthermore, simultaneously with this, the respective wetting liquid spray pumps 216 are driven and wetting liquid is sprayed toward the wiping webs 110 from the wetting liquid deposition nozzles 210. Consequently, wetting liquid is deposited onto the wiping webs 110 before making contact with the nozzle surfaces 30C, 30M, 30Y and 30K of the heads 16C, 16M, 16Y and 16K (namely, the wiping webs 110 on the upstream side of the pressing roller 118), thereby wetting the wiping webs 110 (forming wetted regions) before the webs make contact with the nozzle surfaces 30C, 30M, 30Y and 30K of the heads 16C, 16M, 16Y and 16K. By taking the wiping web 110 up onto the take-up reel 116 while spraying wetting liquid from the wetting liquid deposition nozzle 210 toward the wiping web 110 in this way, a wet region of the wiping web 110 is slid over the nozzle surfaces 30C, 30M, 30Y and 30K of the heads 16C, 16M, 16Y and 16K, as shown in FIG. 11F, and the nozzle surfaces 30C, 30M, 30Y and 30K are each wiped and cleaned by a wet region of the wiping web 110.

In this way, the second wiping and cleaning action is carried out using a wet region of the wiping web 110. By using a wet region to perform the second wiping and cleaning action in this way, it is possible effectively to remove any wiping traces which may have occurred during the first wiping and cleaning action. Furthermore, by using a wet region to perform the second wiping and cleaning action in this way, it is possible to prevent ink from being drawn out from the nozzle holes by the wiping action.

In each of the respective head cleaners 100C, 100M, 100Y and 100K, the travel of the wiping web 110 is halted when the other side end portion of the head 16C, 16M, 16Y and 16K has passed the pressing roller 118. Furthermore, the driving of the wetting liquid spray pump 216 is also halted simultaneously.

The heads 16C, 16M, 16Y and 16K, on the other hand, are moved directly towards the maintenance position.

In the head cleaners 100C, 100M, 100Y and 100K in which the travel of the wiping webs 110 has been halted, the pressing rollers 118 are withdrawn to the withdrawn position, and the cleaning operation is thereby ended.

After this, the head cleaners 100C, 100M, 100Y and 100K carry out location of a non-wet region for the next cleaning process, according to requirements.

As described above, in the present embodiment, after wiping and cleaning the nozzle surfaces 30C, 30M, 30Y and 30K with the wiping webs 110 once, the absorption capability of the wiping webs 110 is lowered and the nozzle surfaces 30C, 30M, 30Y and 30K are wiped and cleaned again using the wiping webs 110. By this means, it is possible to clean the nozzle surfaces 30C, 30M, 30Y and 30K without the occurrence of wiping traces or wiping omissions. Furthermore, by switching the absorption capability through wetting the wiping webs 110 in this way, it is possible to increase the range of choice of the wiping web that can be used.

In the present example, the first wiping and cleaning action which uses a non-wet region is carried out just once, but it may also be carried out a plurality of times. More specifically, the heads 16C, 16M, 16Y and 16K may be moved back and forth a plurality of times with the wiping webs 110 pressed and abutted against the heads, so as to carry out the first wiping and cleaning action. Similarly, the second wiping and cleaning action which uses a wet region may also be carried out a plurality of times.

Furthermore, in the present example, the wiping webs 110 are made to travel in the opposite direction to the direction of movement of the heads 16C, 16M, 16Y and 16K when carrying out the second wiping and cleaning action using the wet region, but this wiping and cleaning action may also be carried out with the webs traveling in the same direction as the heads. In this case, for example, the wiping webs 110 are pressed and abutted against the nozzle surfaces 30C, 30M, 30Y and 30K of the heads 16C, 16M, 16Y and 16K traveling from the maintenance position toward the image formation position, thereby wiping and cleaning the nozzle surfaces 30C, 30M, 30Y and 30K.

Furthermore, it is also possible to carry out two wiping and cleaning actions in a state where the wiping webs 110 have been halted and are not traveling.

The amount of wetting of the wet region used in the second wiping and cleaning action is desirably set appropriately in accordance with the absorption capacity of the wiping web 110 used (for example, the wet region is wetted so that the absorption capability falls to 20% approximately). In this case, desirably, the amount of wetting (the amount of wetting liquid supplied from the wetting liquid deposition nozzles 210) is increased, the greater the relative velocity differential between the heads 16C, 16M, 16Y and 16K and the wiping webs 110 during the second wiping and cleaning action. By this means, the absorption capability can be adjusted appropriately and the second wiping and cleaning action can be carried out in a suitable fashion.

Furthermore, the head cleaners 100C, 100M, 100Y and 100K according to the present embodiment respectively comprise a wet region determination sensor 124, but this wet region determination sensor 124 does not necessarily have to be provided, and it is also possible to locate the wiping web 110 in a desired position by controlling the amount of winding out and winding back of the wiping web 110. By providing a wet region determination sensor 124, it is possible to achieve accurate positional location, as well as being able to determine the presence or absence of the wiping web 110.

Furthermore, in the series of embodiments described above, a case where the nozzle surface of a line head is wiped and cleaned is described, but the application of the present invention is not limited to this. The invention can also be applied similarly to a case of wiping and cleaning the nozzle surface of a so-called shuttle scanning type of head.

Second Mode

Next, desirable embodiments of a second mode of the present invention will be described. Explanation for elements that are the same as or similar to those in the first mode described above is omitted in the second mode.

Figure 12:
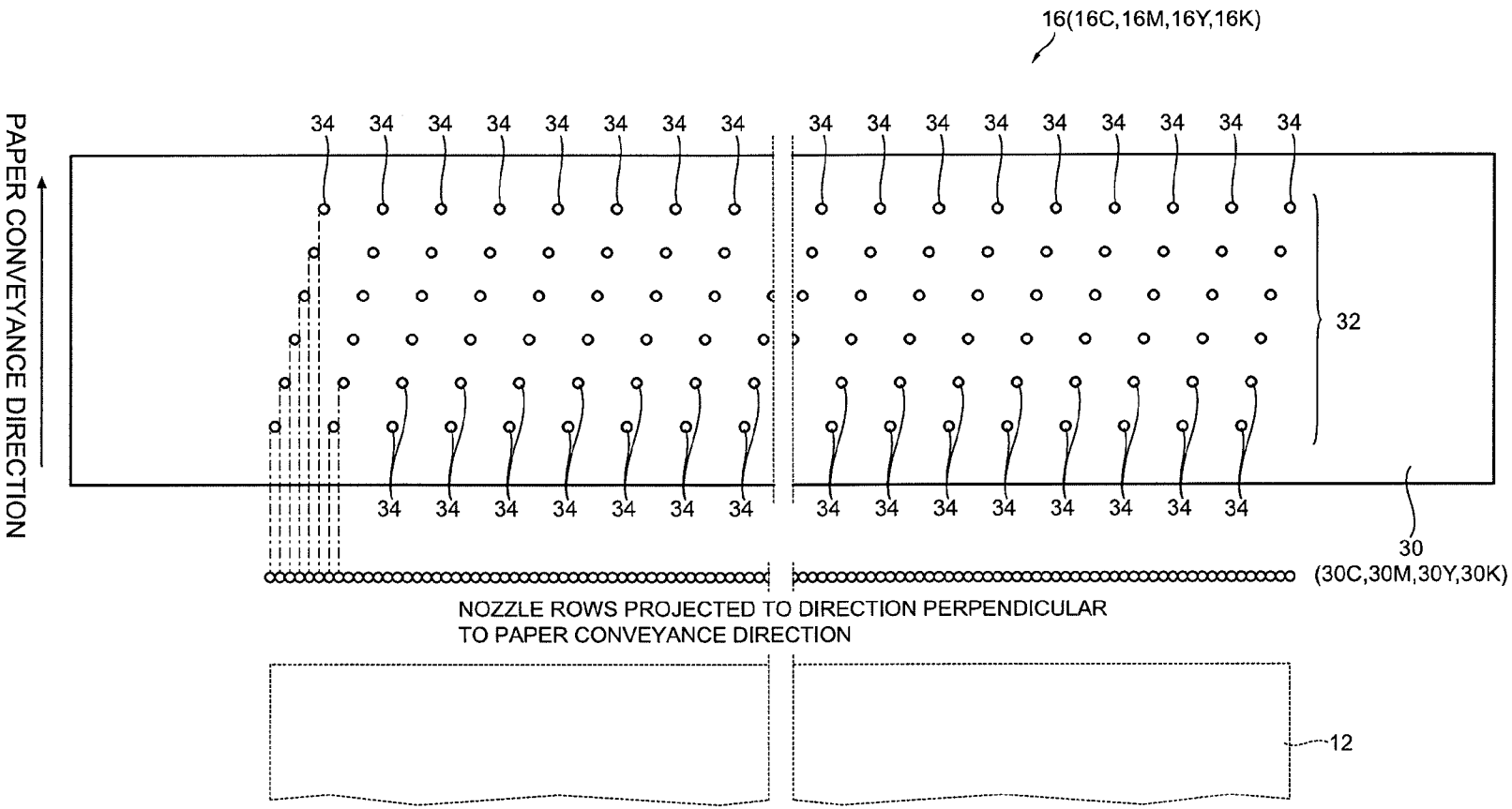
FIG. 12 is a plan diagram showing the composition of a nozzle surface of a head according to a second mode and a third mode.

FIG. 12 is a plan view diagram showing a composition of the nozzle surface of a head 16 (16C, 16M, 16Y and 16K). As shown in FIG. 12, nozzle rows 32 are formed in the lengthwise direction of the head 16 in the nozzle surface 30 (30C, 30M, 30Y and 30K) of the head 16 (16C, 16M, 16Y and 16K).

Each of the heads 16 which are installed on a head supporting frame 40 is disposed with the nozzle rows 32 which are formed in the nozzle surface 30 arranged perpendicularly with respect to the direction of conveyance of the paper 12. Ink droplets are ejected perpendicularly from the nozzle rows 32 formed in the nozzle surface 30 toward the outer circumferential surface of the image formation drum 14.

In the example of the head 16 shown in FIG. 12, nozzles rows 32 are formed by arranging nozzles 34, 34, in a staggered matrix configuration on the nozzle surface 30. By adopting an arrangement of this kind for the nozzles 34, 34 . . . it is possible to reduce the effective pitch between the nozzles 34 as projected to the lengthwise direction of the head 16 (namely, a direction perpendicular to the conveyance direction of the paper; in other words, the breadthways direction of the paper), and therefore a high-density configuration of the nozzles 34 can be achieved.

The head supporting frame 40 where the heads 16C, 16M, 16Y and 16K are installed is provided movably in a direction parallel to the rotating shaft 18 of the image formation unit 14 (namely, in the lengthwise direction of the heads 16C, 16M, 16Y and 16K installed thereon) and is composed in such a manner that the heads 16C, 16M, 16Y and 16K can be withdrawn to a prescribed maintenance position. This point is described below.

The image formation unit 10 has the composition described above. In this image formation unit 10, paper 12 is received onto the image formation drum 14 from a previous step via the conveyance drum 26, and is conveyed in rotation while being held by suction on the circumferential surface of the image formation drum 14. The paper 12 passes below the heads 16C, 16M, 16Y and 16K during this conveyance and ink droplets are ejected from the heads 16C, 16M, 16Y and 16K onto the recording surface of the paper as the paper passes, thereby forming a color image on the recording surface. After having completed image recording, the paper 12 is transferred from the image formation drum 14 to the conveyance drum 28 and is conveyed to a subsequent step.

The driving of the heads 16C, 16M, 16Y and 16K (ink ejection) and the driving of the image formation unit 14, and the like, are controlled by a system controller, which is not illustrated. This system controller performs overall control of the operations of the whole inkjet recording apparatus and controls the driving of the respective units in accordance with a prescribed control program.

Movement Mechanism of Head Supporting Frame

As described above, the head supporting frame 40 is provided movably in the direction parallel to the rotating shaft 18 of the image formation drum 14. Below, the movement mechanism of the head supporting frame 40 will be described.

This head supporting frame 40 is supported slidably via sliders 52, 52 on a pair of guide rails 50, 50 which are arranged in parallel with the rotating shaft 18 of the image formation drum 14. The head supporting frame 40 slides in a direction parallel to the rotating shaft 18 of the image formation drum 14 by sliding along the guide rails 50, 50.

Furthermore, a nut section 56 which screws onto a screw bar 54 is coupled to the head supporting frame 40. The screw bar 54 is arranged in parallel with the guide rail 50 and the respective end portions thereof are supported rotatably on bearings 58, 58 which are provided in the main body frame of the inkjet recording apparatus. A head feed motor 60 is coupled to this screw bar 54, which is driven to rotate by the head feed motor 60. The head supporting frame 40 slides along the guide rails 50, 50 by driving the head feed motor 60 and turning the screw bar 54. In other words, the head supporting frame 40 slides in a direction parallel to the axis of rotation of the image formation drum 14.

A system controller, which is not illustrated, causes the heads 16C, 16M, 16Y and 16K to move from a prescribed image formation position to a maintenance position by controlling the driving of the head feed motor 60 and controlling the movement of the head supporting frame 40. Alternatively, the heads are moved from the maintenance position to the image formation position.

When disposed in the image formation position, the heads 16C, 16M, 16Y and 16K are arranged about the periphery of the image formation drum 14, as indicated by the solid lines in FIG. 2, and are able to record an image onto paper 12 conveyed in rotation by the image formation drum 14.

On the other hand, when the heads are disposed in the maintenance position, as indicated by the dotted lines in FIG. 2, then the heads are withdrawn from the periphery of the image formation drum 14. By this means, it is possible to carry out maintenance of both the image formation drum 14 and the heads 16C, 16M, 16Y and 16K.

A moisturizing unit 62 for moisturizing the heads 16C, 16M, 16Y and 16K is provided in this maintenance position. When not used for a long period of time, the nozzle surfaces 30C, 30M, 30Y and 30K of the heads 16C, 16M, 16Y and 16K are kept moist by the moisturizing unit 62, thereby preventing ejection failures due to drying.

A head cleaning apparatus 70 for wiping and cleaning the nozzle surfaces 30C, 30M, 30Y and 30K of the heads 16C, 16M, 16Y and 16K is provided between the image formation position and the maintenance position.

The nozzle surfaces 30C, 30M, 30Y and 30K of the heads 16C, 16M, 16Y and 16K are wiped and cleaned by means of a wiping web (ink absorbing body) being pressed and abutted respectively against the nozzle surfaces 30C, 30M, 30Y and 30K in the process of moving the heads from the image formation position to the maintenance position (or moving the heads from the maintenance position to the image formation position). Below, the composition of the head cleaning apparatus 70 will be described.

Composition of Head Cleaning Apparatus

As shown in FIG. 3, the head cleaning apparatus 70 comprises cleaning liquid application nozzles 80C, 80M, 80Y and 80K and head cleaners 100C, 100M, 100Y and 100K. The cleaning liquid application nozzles 80C, 80M, 80Y and 80K and the head cleaners 100C, 100M, 100Y and 100K are provided so as to correspond to the heads 16C, 16M, 16Y and 16K, and are installed on a supporting frame which is not illustrated. The head cleaning apparatus 70 is disposed at a prescribed installation position set between the image formation position and the maintenance position, by attaching the supporting frames on which the cleaning liquid application nozzles 80C, 80M, 80Y and 80K and the head cleaners 100C, 100M, 100Y and 100K are installed to a main body frame (not illustrated) of the inkjet recording apparatus.

Composition of Cleaning Liquid Application Nozzles

The cleaning liquid application nozzles 80C, 80M, 80Y and 80K are provided so as to oppose the nozzle surfaces 30C, 30M, 30Y and 30K of the corresponding heads 16C, 16M, 16Y and 16K. These cleaning liquid application nozzles 80C, 80M, 80Y and 80K have emission ports corresponding to the width of the nozzle surfaces 30C, 30M, 30Y and 30K and emit cleaning liquid toward the nozzle surfaces 30C, 30M, 30Y and 30K of the corresponding heads 16C, 16M, 16Y and 16K.

Figure 14:
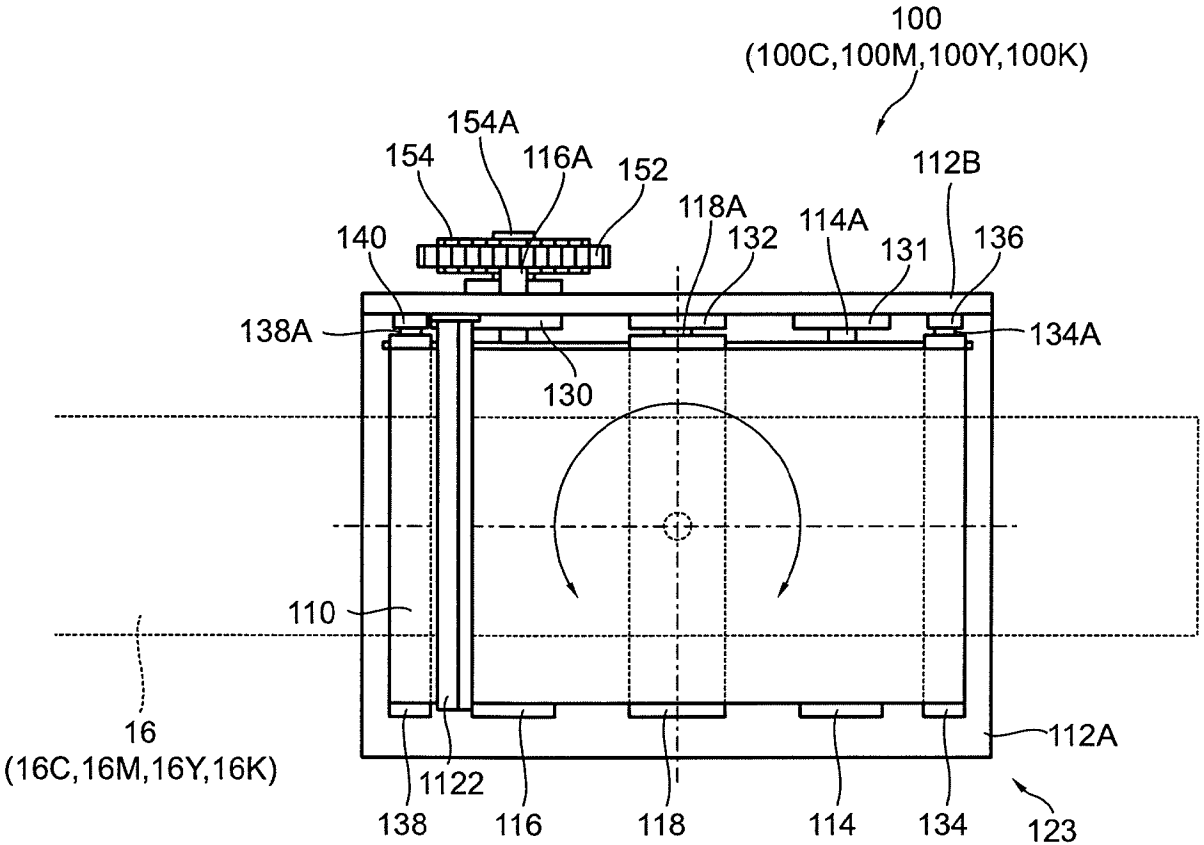
FIG. 14 is a plan view diagram of the head cleaner according to the second mode.

As shown in FIG. 14, the cleaning liquid is supplied from a cleaning liquid tank 84 via a cleaning liquid supply pipe 82 (82C, 82M, 82Y, 82K) and by driving a cleaning liquid spray pump 86 (86C, 86M, 86Y and 86K) provided at an intermediate point of the cleaning liquid supply pipe 82, cleaning liquid is sprayed from the corresponding cleaning liquid application nozzle 80C, 80M, 80Y and 80K.

Cleaning liquid is applied to the nozzle surfaces 30C, 30M, 30Y and 30K by spraying cleaning liquid from the cleaning liquid application nozzles 80C, 80M, 80Y and 80K toward the nozzle surfaces 30C, 30M, 30Y and 30K while the heads 16C, 16M, 16Y and 16K are moved from the image formation position to the maintenance position (or from the maintenance position to the image formation position).

The system controller controls the application of cleaning liquid to the nozzle surfaces 30C, 30M, 30Y and 30K by controlling the driving of the cleaning liquid spraying pump and the head feed motor 60.

Composition of Head Cleaner

The head cleaners 100C, 100M, 100Y and 100K are provided so as to oppose the nozzle surfaces 30C, 30M, 30Y and 30K of the corresponding heads 16C, 16M, 16Y and 16K, and respectively press and abut a wiping web 110 formed in a band shape against the nozzle surface 30C, 30M, 30Y and 30K of the corresponding head 16C, 16M, 16Y and 16K by means of a pressing roller 118. The nozzle surfaces 30C, 30M, 30Y and 30K of the heads 16C, 16M, 16Y and 16K are wiped and cleaned by means of the respective wiping webs 110 being pressed and abutted against the nozzle surfaces 30C, 30M, 30Y and 30K in the process of moving the heads from the image formation position to the maintenance position (or moving the heads from the maintenance position to the image formation position).

The head cleaners 100C, 100M, 100Y and 100K each have the same composition and therefore the composition of one head cleaner 100 will be described here.

Figure 13:
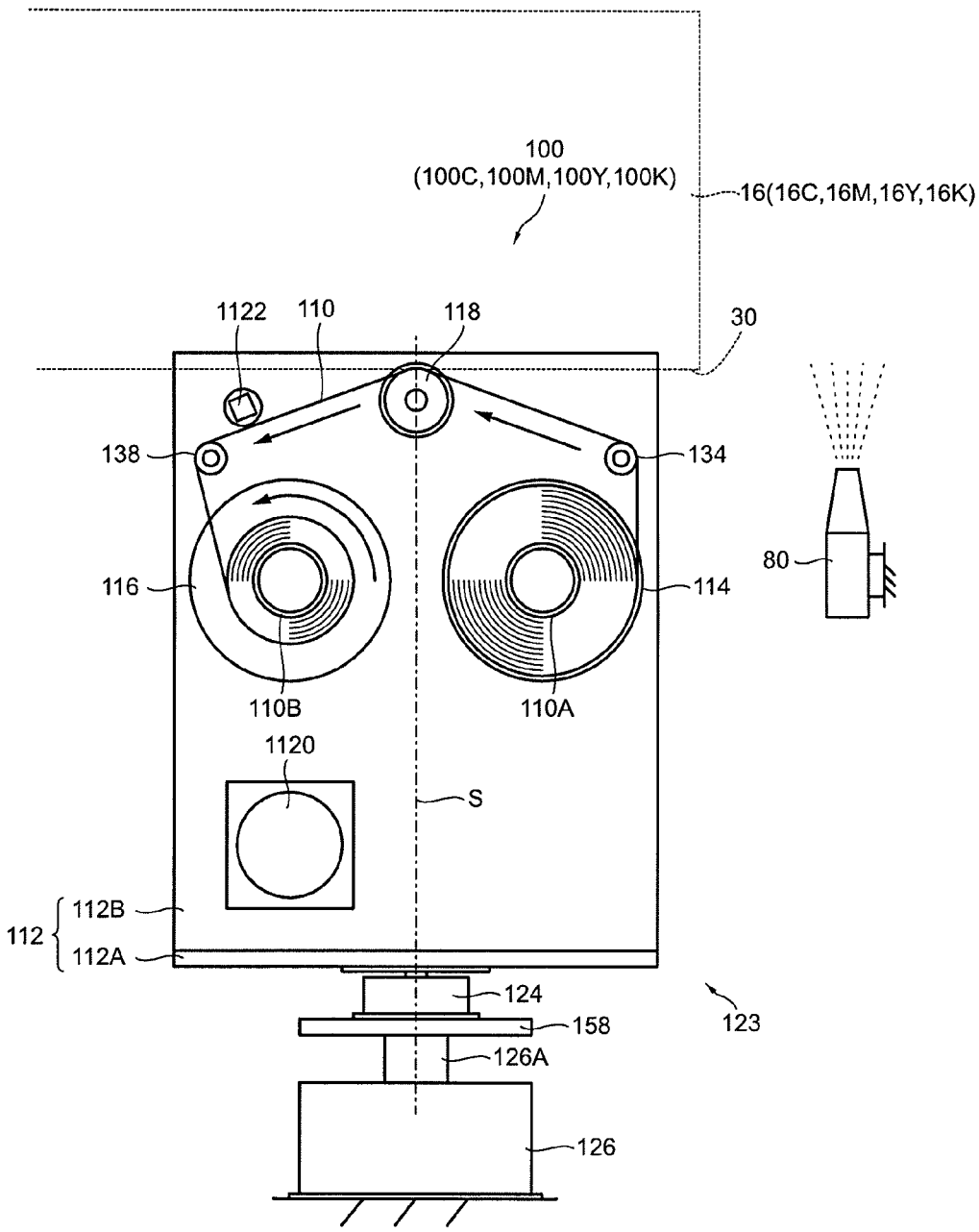
FIG. 13 is a front view diagram of the head cleaner according to the second mode.
Figure 15:
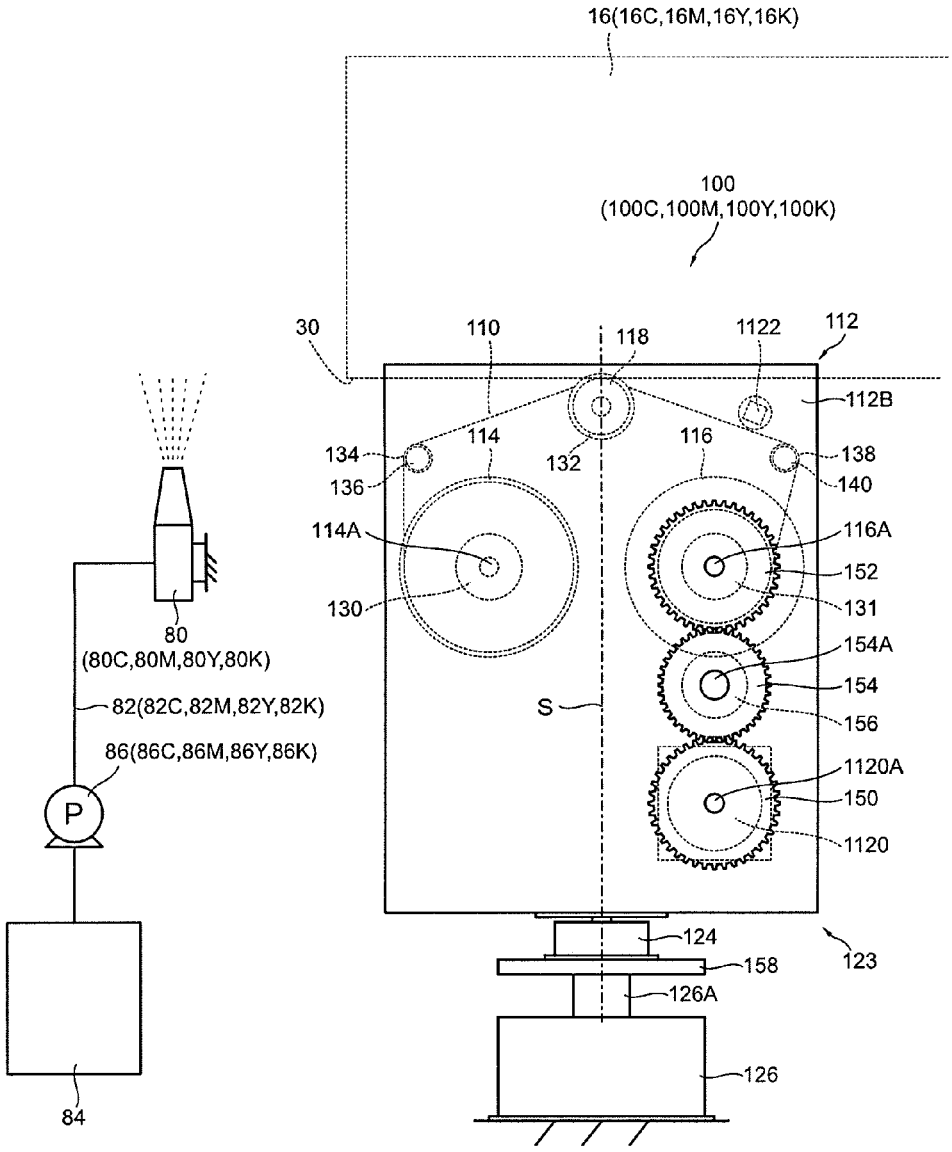
FIG. 15 is a side view diagram of the head cleaner according to the second mode.
Figure 16:
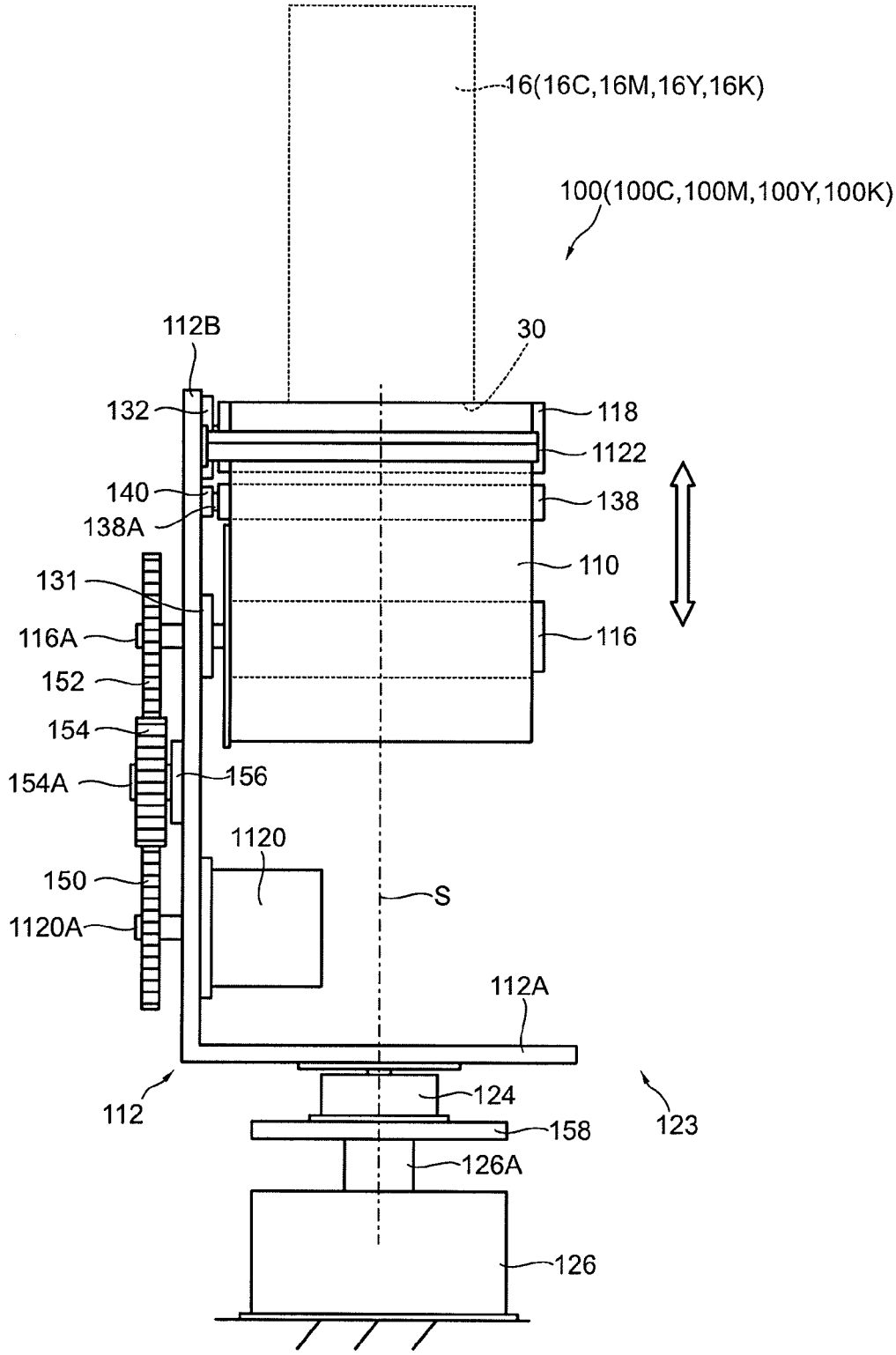
FIG. 16 is a rear view diagram of the head cleaner according to the second mode.

FIG. 13 is a front view diagram of a head cleaner, FIG. 14 is a plan diagram of a head cleaner, FIG. 15 is a side view diagram of a head cleaner, and FIG. 16 is a rear view diagram of a head cleaner.

As shown in FIGS. 13 to 16, the head cleaner 100 wipes and cleans the nozzle surface 30 of the head 16 by wrapping a band-shaped wiping web 110 about a pressing roller 118 and pressing and abutting the wiping web 110 wrapped about the pressing roller 118 against the nozzle surface 30 (30C, 30M, 30Y and 30K) of the corresponding head 16 (16C, 16M, 16Y and 16K).

This head cleaner 100 principally comprises a main body frame 112, a pay-out reel 114 which pays out a wiping web 110, a take-up reel 116 which winds up the wiping web 110, the pressing roller 118 that is presses and abuts the wiping web 110 against the nozzle surface 30 of the head 16, a take-up motor 1120 which drives the take-up reel 116 to rotate and take up the wiping web 110 onto the take-up reel 116, a wiping web travel drive unit 123 comprising a used region determination sensor 1122 which determines a used region of the wiping web 110, a travel direction switching motor 1124 that rotates the wiping web travel drive unit 123 to switch the direction of travel of the wiping web 110, and an elevator cylinder 126 which abuts and separates the wiping web 110 with respect to the nozzle surface 30 of a head 16 by advancing and retracting the wiping web travel drive unit 123 perpendicularly with respect to the nozzle surface 30 of the head 16.

The wiping web 110 is formed in a band shape of woven high-density fibers, such as polyester, acrylic, nylon, or the like, and winding cores 110A and 110B are attached to either end thereof. The wiping web 110 in an unused state is supplied in the form of a roll wound up onto one of the winding cores 110A.

This wiping web 110 is composed in such a manner that the liquid absorption capability thereof changes when the direction of sliding movement of the wiping web 110 is changed. In the present embodiment, when the web is slid in the lengthwise direction, a high liquid absorption capability is obtained (a liquid absorption capability sufficient to avoid wiping omissions when the nozzle surface of the head is wiped), and when the web is slid in a direction perpendicular to the lengthwise direction, the liquid absorption capability is reduced by a certain amount (to a level whereby ink is not drawn out from the nozzles when the nozzle surface of the head is wiped). For example, the web is composed in such a manner that when the web is slid in the direction perpendicular to the lengthwise direction, the liquid absorption capability is reduced by approximately 20% compared to a case where the web is slid in the lengthwise direction.

Consequently, if the wiping web 110 is slid in a direction following the lengthwise direction, then it is possible to wipe the nozzle surface in a state of high liquid absorption capability (a liquid absorption capability sufficient to avoid the occurrence of wiping omissions when the nozzle surface of the head is wiped), and if the wiping web 110 is slid in a direction perpendicular to the lengthwise direction, then it is possible to wipe the nozzle surface in a state of low liquid absorption capability (a liquid absorption capability of a level whereby ink is not drawn out from the nozzles even when the nozzle surface of the head is wiped).

A wiping web of this kind can be achieved, for example, by altering the material of the fibers used, altering the thickness of the fibers, altering the weaving method (or weaving direction), or altering the amount of fibers per unit length, between the direction following the lengthwise direction and the direction perpendicular to the lengthwise direction.

As described hereinafter, the wiping web 110 is installed on the head cleaner 100 by mounting the winding core 110A which is wound with the wiping web 110 in the form of a roll on the pay-out reel 114, and mounting the winding core 110B at the end of the web on the take-up reel 116.

The main body frame 112 is formed in an L shape and is constituted by a bottom surface section 112A provided in parallel with the nozzle surface 30 of the head 16 and a wall surface section 112B provided perpendicularly with respect to the bottom surface section 112A.

The pay-out reel 114 is provided perpendicularly with respect to the wall surface section 112B of the main body frame 112 (namely, in parallel with the nozzle surface of the corresponding head), and the axle section 114A of the reel is supported rotatably on a bearing 130 provided on the inner side of the wall surface section 112B of the main body frame 112. As described below, a winding core 110A on the pay-out side of the wiping web 110 is installed on the pay-out reel 114.

Similarly to the pay-out reel 114, the take-up reel 116 is provided perpendicularly with respect to the wall surface section 112B of the main body frame 112, and the axle section 116A of the reel is supported rotatably on a bearing 131 provided on the inner side of the wall surface section 112B of the main body frame 112. As described below, a winding core 110B on the take-up side of the wiping web 110 is installed on the take-up reel 116.

The take-up reel 116 and the pay-out reel 114 are disposed in parallel in the lateral direction at a uniform spacing apart.

The pressing roller 118 is disposed above the intermediate position between the pay-out reel 114 and the take-up reel 116, and the wiping web 110 which travels between the pay-out reel 114 and the take-up reel 116 is wrapped about the pressing roller 118. The pressing roller 118 is provided perpendicularly with respect to the wall surface section 112B of the main body frame 112, and an axle section 118A of the roller is supported rotatably on a bearing 132 provided on the inner side of the wall surface section 112B of the main body frame 112. Furthermore, the circumferential surface of the pressing roller 118 is coated with an elastic body, such as polyurethane or olefin, or the like. By this means, it is possible to press and abut the wiping web 110 wrapped on the circumferential surface thereof with a uniform impelling force, when the wiping web 110 is pressed and abutted against the nozzle surface 30 of the head 16.

The wiping web 110 paid out from the pay-out reel 114 is wrapped about the pressing roller 118 via a pay-out guide roller 134 which is disposed between the pay-out reel 114 and the pressing roller 118. The pay-out guide roller 134 is provided perpendicularly with respect to the wall surface section 112B of the main body frame 112, and an axle section 134A of the roller is supported rotatably on a bearing 136 provided on the inner side of the wall surface section 112B of the main body frame 112.

Furthermore, the wiping web 110 wrapped about the pressing roller 118 is wrapped onto the take-up reel 116 via an installation guide roller 138 which is disposed between the pressing roller 118 and the take-up reel 116. The take-up guide roller 138 is provided perpendicularly with respect to the wall surface section 112B of the main body frame 112, and an axle section 138A of the roller is supported rotatably on a bearing 140 provided on the inner side of the wall surface section 112B of the main body frame 112.

The take-up motor 1120 is disposed below the take-up reel 116 and is installed perpendicularly on the inner side of the wall surface section 112B of the main body frame 112. The output axle 1120A of the take-up motor 1120 is provided so as to project to the outer side of the wall surface section 112B, and a take-up drive gear 150 is fixed to the front end of this axle.

The axle section 116A of the take-up reel 116 is provided so as to project to the outer side of the wall surface section 112B, and a take-up passive gear 152 is fixed to the front end of this axle. This take-up passive gear 152 meshes with the take-up drive gear 150 via a take-up idle gear 154.

The take-up idle gear 154 is disposed on the outer side of the wall surface section 112B of the main body frame 112, and an axle section 154A thereof is supported rotatably on a bearing 156 provided on the outer side of the wall surface section 112B of the main body frame 112.

When the take-up motor 1120 is driven, the take-up drive gear 150 is rotated and this rotation is transmitted to the take-up passive gear 152 via the take-up idle gear 154. By this means, the take-up reel 116 is turned in a direction which takes up the wiping web 110.

A used region determination sensor 1122 is arranged between the pressing roller 118 and the take-up guide roller 138 and determines the used region of the wiping web 110 traveling between same. The used region is determined by determining the wet region of the wiping web 110, for instance. In other words, the used region becomes wet due to absorbing ink or cleaning liquid and therefore the used region is determined by determining this wet region. The used region determination sensor 1122 is constituted by a photosensor comprising a light emitting section and a light receiving section, for example, and determines the used region (wet region) of the wiping web 110 by receiving the reflected light of the light which is emitted toward the wiping web 110 from the light emitting section. The system controller controls the used region determination sensor 1122 and carries out processing for determining the used region.

The travel direction switching motor 1124 is disposed below the wiping web travel drive unit 123. This travel direction switching motor 1124 is disposed on an elevator stage 158 which is provided in parallel with the bottom face portion 112A of the main body frame 112, and an output axle thereof is fixed perpendicularly on the lower side of the bottom face portion 112A of the main body frame 112. The wiping web travel drive unit 123 is rotated about an axis S perpendicular to the bottom surface portion 112A (namely, an axis perpendicular to the nozzle surface 30 of the head 16) by driving the travel direction switching motor 1124. The pressing roller 118 is disposed perpendicularly with respect to the axis S, and the center of the roller in the breadthways direction is disposed on this axis S. As a result of this, when the travel direction switching motor 1124 is driven and the wiping web travel drive unit 123 is caused to rotate, the wiping web 110 turns about the axis S perpendicular to the nozzle surface 30 of the corresponding head 16, thereby switching the direction of travel. For example, if the wiping web travel drive unit 123 is rotated through 180 degrees, then the direction of travel is reversed. The system controller controls the driving of the travel direction switching motor 1124 and thereby controls the switching of the travel of the wiping web 110 with respect to the nozzle surface 30 of the corresponding head 16.

The elevator cylinder 126 is disposed on the lower side of the elevator stage 158. The elevator cylinder 126 is fixed to the head cleaning apparatus main body (not illustrated), and the rod 126A of the cylinder is fixed perpendicularly to the lower surface portion of the elevator stage 158. The wiping web travel drive unit 123 is advanced and retracted perpendicularly with respect to the nozzle surface 30 of the corresponding head 16, by driving this elevator cylinder 126. By advancing and retracting the wiping web travel drive unit 123 perpendicularly with respect to the nozzle surface 30, as shown in FIG. 17A and FIG. 17B the pressing roller 118 is moved between a prescribed "pressing position" (FIG. 17A) and "withdrawn position" (FIG. 17B).

Figure 17A:
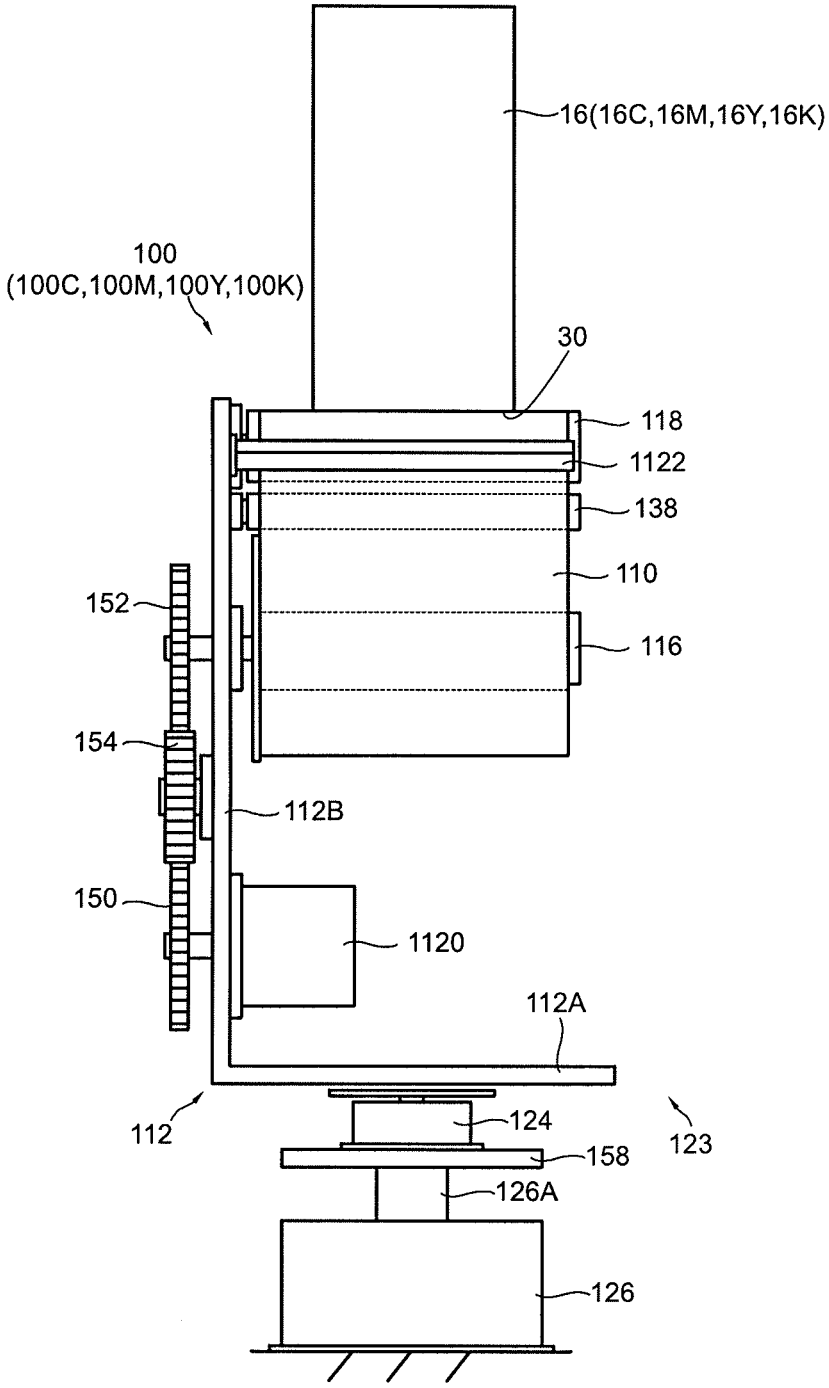
FIGS. 17A and 17B are illustrative diagrams of a raising and lowering operation of the head cleaner according to the second mode.
Figure 17B:
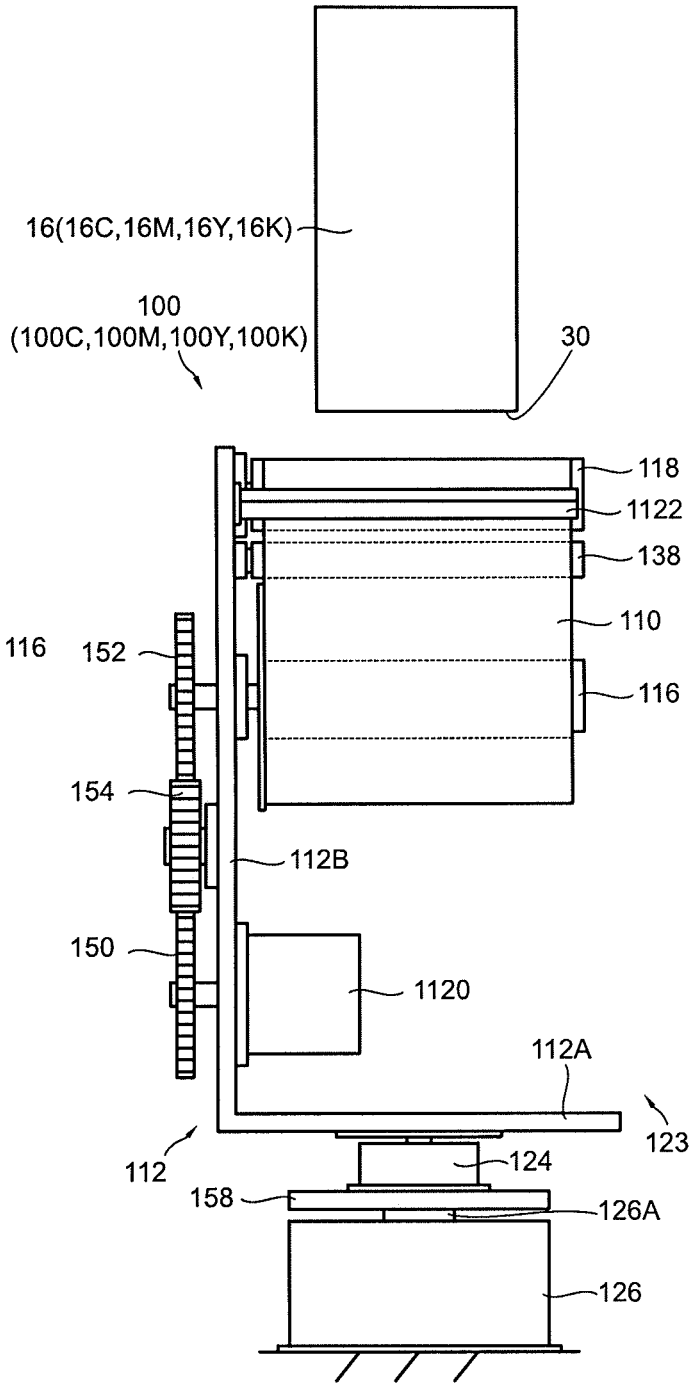

The wiping web 110 wrapped about the pressing roller 118 is pressed and abutted against the nozzle surface 30 of the corresponding head 16, when the pressing roller 118 is disposed at the "pressing position" shown in FIG. 17A. When the pressing roller 118 is disposed at the "withdrawn position" shown in FIG. 17B, the wiping web 110 is retracted from the nozzle surface 30 of the corresponding head 16. More specifically, the wiping web 110 is separated from the nozzle surface 30 so as not to make contact with the nozzle surface 30.

The system controller controls the abutment and withdrawal of the wiping web 110 with respect to the nozzle surface 30 by controlling the operation of the elevator cylinder 126.

The head cleaner 100 has the composition described above.

As stated previously, the unused wiping web 110 is supplied in the form of a roll wound up onto one of the winding cores 110A. When this wiping web 110 is installed on the head cleaner 100, firstly, the winding core 110A on which the wiping web 110 is wound in the form of a roll is installed on the pay-out reel 114. The wiping web 110 installed on the pay-out reel 114 is paid out a small amount at a time and wrapped in sequence about the pay-out guide roller 134, the pressing roller 118 and the take-up guide roller 138, and the winding core on the front end (the take-up side winding core) 110B is installed on the take-up reel 116. By this means, the wiping web 110 is installed on the head cleaner 100.

The head cleaner 100 in which the wiping web 110 has been installed pays out the wiping web 110 from the pay-out reel 114 and winds up the wiping web 110 onto the take-up reel 116 by driving the take-up motor (winding motor) 1120 to rotate. By this means, the wiping web 110 which is wrapped about the pressing roller 118 is caused to travel in the lengthwise direction.

Moreover, when the elevator cylinder 126 is driven so as to move the pressing roller 118 to the pressing position, the wiping web 110 wrapped about the pressing roller 118 is pressed and abutted against the nozzle surface 30 of the head 16 (see FIG. 17A), and when the pressing roller 118 is moved to the withdrawn position, the wiping web 110 is withdrawn from the nozzle surface 30 of the head 16 (see FIG. 17B).

Furthermore, when the travel direction switching motor 1124 is driven and the wiping web travel drive unit 123 is rotated, the direction of travel (the orientation of the web with respect to the direction in which the web is slid) is switched.

Figure 18A:
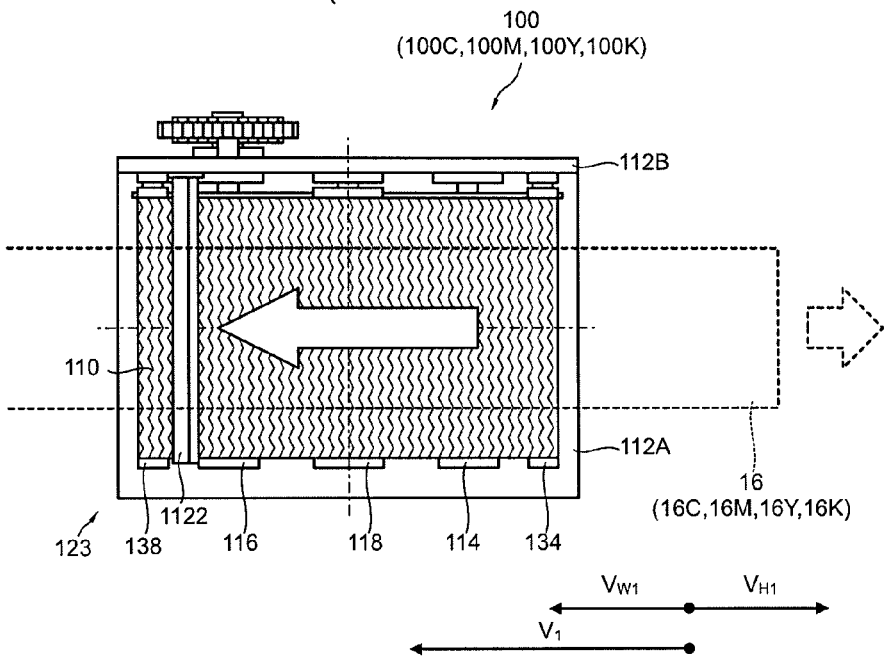
FIGS. 18A and 18B are illustrative diagrams of a direction of travel switching operation of the head cleaner according to the second mode.
Figure 18B:
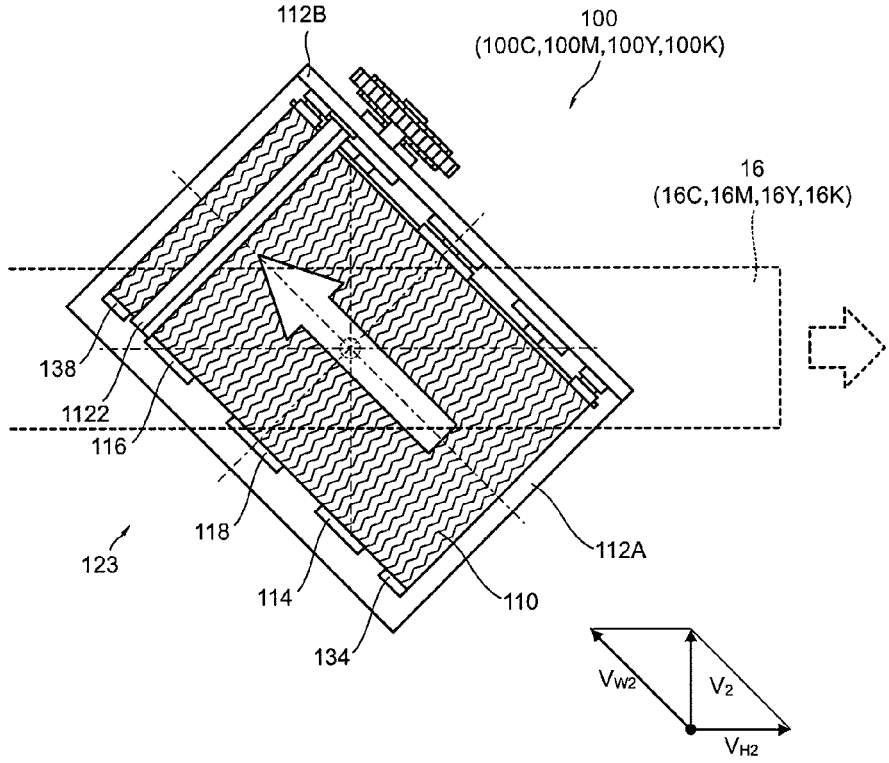

In the present embodiment, as shown in FIGS. 18A and 18B, a first direction is taken to be when the lengthwise direction of the wiping web 110 (=direction of travel) is parallel to the lengthwise direction of the head 16 (=direction of movement) and a second direction is taken to be when the lengthwise direction of the wiping web 110 is inclined at a prescribed angle with respect to the lengthwise direction of the head 16 (in the present embodiment, a direction inclined at 45 degrees). The direction of travel of the wiping web 110 is switched between these first and second directions.

When the direction of travel is set to the first direction and the wiping web 110 is pressed and abutted against the nozzle surface 30 of the head 16 which is moved at a prescribed speed of movement $V_{H1}$ from the image formation position to the maintenance position, while causing the wiping web 110 to travel at a prescribed speed of travel $V_{w1}$, the wiping web 110 is slid in the lengthwise direction (the lengthwise direction of the wiping web) with respect to the nozzle surface of the head 16. In this case, the wiping web 110 is slid at a relative velocity $V_1$ with respect to the nozzle surface 30 of the head 16.

By sliding the wiping web 110 in the lengthwise direction (the lengthwise direction of the wiping web) with respect to the nozzle surface of the head 16 in this way, the wiping web 110 can be wiped over the nozzle surface of the head 16 in a state of high liquid absorption capability.

On the other hand, if the direction of travel of the wiping web 110 is set to a second direction and the wiping web 110 is pressed and abutted against the nozzle surface 30 of the head 16 which is moved at a prescribed movement velocity $V_{H2}$ from the image formation position to the maintenance position, while causing the wiping web 110 to travel at a prescribed speed of travel $V_{w2}$, then the wiping web 110 is slid relatively against the nozzle surface 30 of the head 16 in a direction perpendicular to the lengthwise direction (the lengthwise direction of wiping web) (the web is slid at a relative velocity $V_2$ in a direction perpendicular to the lengthwise direction (the lengthwise direction of the wiping web) with respect to the nozzle surface 30 of the head 16).

By sliding the wiping web 110 relatively in a direction perpendicular to the lengthwise direction (the lengthwise direction of the wiping web) with respect to the nozzle surface of the head 16 in this way, the wiping web 110 can be wiped over the nozzle surface of the head 16 in a state of low liquid absorption capability.

The system controller cleans the nozzle surface 30 of the head 16, by controlling the driving of the take-up motor 1120, the travel direction switching motor 1124, the elevator cylinder 126 and the head feed motor 60.

Head Cleaning Method

Next, a cleaning method for a head using the head cleaning apparatus 70 according to the present embodiment will be described.

The cleaning of the heads 16C, 16M, 16Y and 16K is carried out by respectively wiping with a wiping web 110 after applying a cleaning liquid to the whole area of the nozzle surfaces 30C, 30M, 30Y and 30K. In the head cleaning apparatus 70 of the present embodiment, the wiping operation of wiping the nozzle surfaces 30C, 30M, 30Y and 30K with the wiping webs 110 is carried out in two separate actions. More specifically, a first action (first cleaning step) involves wiping with a wiping web 110 in a state of high liquid absorption capability with the direction of travel set to a first direction, and a second action (second cleaning step) involves wiping with a wiping web 110 in a state of low liquid absorption capability with the direction of travel set to a second direction.

In this way, by wiping the nozzle surfaces 30C, 30M, 30Y and 30K in two separate wiping actions, it is possible to prevent wiping traces and wiping omissions. More specifically, large liquid droplets present on the nozzle surface are removed, thereby preventing wiping omissions, by the first wiping action performed with the wiping web 110 in a state of high liquid absorption capability. In the subsequent second wiping action performed with the wiping web 110 in a state of low liquid absorption capability, the wiping traces produced by the first wiping action are removed, as well as preventing ink from being drawn out from the nozzle holes. By this means, it is possible to clean the nozzle surfaces 30C, 30M, 30Y and 30K without the occurrence of wiping traces or wiping omissions.

Below, a specific cleaning method for the heads 16C, 16M, 16Y and 16K using the head cleaning apparatus 70 according to the present embodiment will be described.

Firstly, cleaning liquid is applied to the nozzle surfaces 30C, 30M, 30Y and 30K of the heads 16C, 16M, 16Y and 16K in order to dissolve the adhering material created by the ink which is adhering to the nozzle surfaces 30C, 30M, 30Y and 30K.

The cleaning liquid is applied by moving the heads 16C, 16M, 16Y and 16K from the image formation position towards the maintenance position (or from the maintenance position towards the image formation position), as well as spraying cleaning liquid from the cleaning liquid application nozzles 80C, 80M, 80Y and 80K toward the nozzle surfaces 30C, 30M, 30Y and 30K of the heads 16C, 16M, 16Y and 16K. More specifically, the procedure is as follows. When the heads 16C, 16M, 16Y and 16K are moved from the image formation position toward the maintenance position, the heads 16C, 16M, 16Y and 16K pass over the cleaning liquid application nozzles 80C, 80M, 80Y and 80K and therefore cleaning liquid is sprayed from the cleaning liquid application nozzles 80C, 80M, 80Y and 80K in coordination with the passage of the heads 16C, 16M, 16Y and 16K. By this means, cleaning liquid is applied to the whole area of the nozzle surfaces 30C, 30M, 30Y and 30K, including the nozzle free regions.

The application of cleaning liquid may be carried out once, or a plurality of times. If cleaning liquid is applied a plurality of times, the heads 16C, 16M, 16Y and 16K are moved back and forth a plurality of times during application.

When the application of the cleaning liquid has been completed, the heads 16C, 16M, 16Y and 16K are returned temporarily to the image formation position. Thereupon, a first wiping and cleaning action (first cleaning step) is carried out.

As described above, the first wiping action is carried out with the web set to a state of high liquid absorption capability by setting the direction of travel of the wiping web 110 (the orientation with respect to the direction of sliding the web) to the first direction (see FIG. 18A). More specifically, the procedure is as follows.

Firstly, an unused region of the wiping web is located in position. In other words, the wiping web 110 is located in position in such a manner that the unused region of the wiping web 110 is wrapped about the pressing roller 118. This step is carried out on the basis of the output from the used region determination sensor 1122 and is performed by winding the wiping web 110 onto the take-up reel 116 until the wet region ceases to be determined by the used region determination sensor 1122.

If the direction of travel of the wiping web 110 at this stage has not been set to the first direction, then the travel direction switching motor 1124 is driven and the direction of travel of the wiping web 110 is set to the first direction.

When the positional location of the unused region is completed, then the heads 16C, 16M, 16Y and 16K are conveyed toward the maintenance position, and the traveling wiping webs 110 are pressed against the nozzle surfaces 30C, 30M, 30Y and 30K of the heads 16C, 16M, 16Y and 16K which have been sent to the maintenance position, thereby wiping and cleaning the nozzle surfaces 30C, 30M, 30Y and 30K of the heads 16C, 16M, 16Y and 16K. More specifically, the procedure is as follows.

Figure 19A:
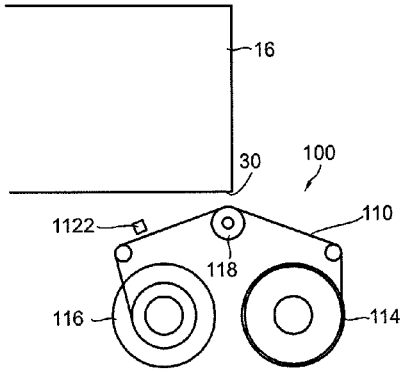
FIGS. 19A to 19F are step diagrams of a head cleaning method using the head cleaning apparatus according to the second mode.

Firstly, the heads 16C, 16M, 16Y and 16K are moved towards the maintenance position. As the heads 16C, 16M, 16Y and 16K are moved toward the maintenance position, they are halted temporarily when the end portion on one side thereof (the end portion on the maintenance position side) arrives at the installation position of the corresponding pressing roller 118, as shown in FIG. 19A. In this case, the pressing rollers 118 of the cleaners 100C, 100M, 100Y and 100K are situated in a prescribed withdrawn position.

When the heads 16C, 16M, 16Y and 16K are halted, the elevator cylinders 126 are driven and the pressing rollers 118 are moved to a pressing position. By this means, the wiping webs 110 wrapped about the pressing rollers 118 are pressed and abutted against the nozzle surfaces 30C, 30M, 30Y and 30K of the heads 16C, 16M, 16Y and 16K (FIG. 19B).

When the wiping webs 110 wrapped about the pressing rollers 118 are pressed and abutted against the nozzle surfaces 30C, 30M, 30Y and 30K of the heads 16C, 16M, 16Y and 16K, then the take-up motors (winding motors) 1120 are driven. By this means, the wiping webs 110 are wound up respectively onto the take-up reels 116 at a uniform speed, and the wiping webs 110 wrapped about the pressing rollers 118 travel at a uniform speed of travel $V_{w1}$.

Furthermore, simultaneously with this, the head feed motor 60 is driven and the heads 16C, 16M, 16Y and 16K are conveyed toward the maintenance position at a uniform speed of movement $V_{H1}$.

Figure 19D:
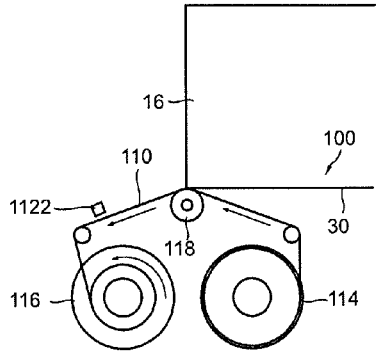
Figure 19B:
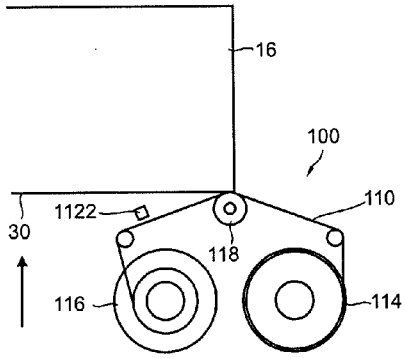
Figure 19E:
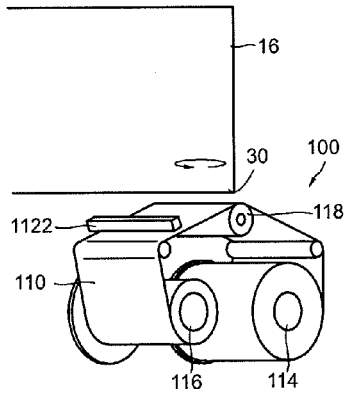
Figure 19C:
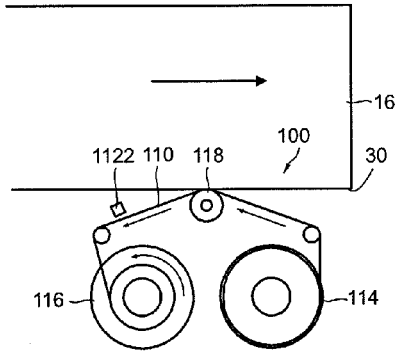

As a result, as shown in FIG. 19C, the wiping webs 110 are moved in the direction opposite to the direction of movement of the heads 16C, 16M, 16Y and 16K while being slid over the nozzle surfaces 30C, 30M, 30Y and 30K of the heads 16C, 16M, 16Y and 16K, and the nozzle surfaces 30C, 30M, 30Y and 30K are cleaned and wiped by the traveling wiping webs 110.

The heads 16C, 16M, 16Y and 16K which have been conveyed to the maintenance position are halted when the end portion on the other side (the end portion on the side of the image formation position) arrives at the installation position of the pressing roller 118, as shown in FIG. 19D. The travel of the wiping webs 110 is halted in synchronism with the halting of the conveyance of the heads 16C, 16M, 16Y and 16K.

By means of the above, the first wiping and cleaning action is completed. As described above, the first wiping and cleaning action involves sliding the wiping web 110 in the lengthwise direction of the wiping web 110, and therefore it is possible to wipe the nozzle surfaces 30C, 30M, 30Y and 30K in a state of high liquid absorption capability. By this means, it is possible to wipe and clean the nozzle surfaces 30C, 30M, 30Y and 30K without the occurrence of wiping omissions.

When the first wiping and cleaning action has been completed, the elevator cylinders 126 are driven and the pressing rollers 118 are moved to a withdrawn position. Furthermore, the heads 16C, 16M, 16Y and 16K are returned toward the image formation position. The heads 16C, 16M, 16Y and 16K which have been returned toward the image formation position are halted when the end portion on the one side is situated at the installation position of the pressing roller 118. Thereupon, a second wiping and cleaning action (second cleaning step) is carried out.

Firstly, the respective direction of travel switching motors 1124 are driven to rotate and, as shown in FIG. 19E, the direction of travel of the wiping webs 110 is thereby switched to the second direction.

When the direction of travel has been switched, the respective elevator cylinders 126 are driven and the pressing rollers 118 are moved to a pressing position. As a result of this, the wiping webs 110 wrapped about the pressing rollers 118 are pressed and abutted against the nozzle surfaces 30C, 30M, 30Y and 30K of the heads 16C, 16M, 16Y and 16K.

When the pressing rollers 118 have been moved to the pressing position and the wiping webs 110 wrapped about the pressing rollers 118 are pressed and abutted against the nozzle surfaces 30C, 30M, 30Y and 30K of the heads 16C, 16M, 16Y and 16K, then the take-up motors (winding motors) 1120 are driven. By this means, the wiping webs 110 are wound up respectively onto the take-up reels 116 at a uniform speed, and the wiping webs 110 wrapped about the pressing rollers 118 travel at a uniform speed of travel $V_{w2}$.

Furthermore, simultaneously with this, the head feed motor 60 is driven and the heads 16C, 16M, 16Y and 16K are conveyed toward the maintenance position at a uniform speed of movement $V_{H2}$.

Figure 19F:
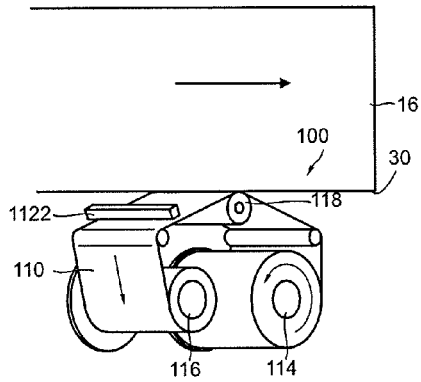

As a result, as shown in FIG. 19F, the wiping webs 110 are moved in a direction (the second direction) inclined at a prescribed angle with respect to the direction of movement of the heads 16C, 16M, 16Y and 16K while being slid over the nozzle surfaces 30C, 30M, 30Y and 30K of the heads 16C, 16M, 16Y and 16K, and the nozzle surfaces 30C, 30M, 30Y and 30K are cleaned and wiped by the traveling wiping webs 110.

By sliding the wiping webs 110 over the nozzle surfaces 30C, 30M, 30Y and 30K of the heads 16C, 16M, 16Y and 16K while the wiping webs 110 travel in a direction inclined at a prescribed angle with respect to the direction of movement of the heads 16C, 16M, 16Y and 16K in this way, the wiping webs 110 are slid relatively in a direction perpendicular to the lengthwise direction with respect to the nozzle surfaces 30 of the heads 16. By this means, it is possible to wipe the nozzle surfaces 30C, 30M, 30Y and 30K of the heads 16C, 16M, 16Y and 16K in a state of low liquid absorption capability.

The heads 16C, 16M, 16Y and 16K which have been conveyed to the maintenance position are halted when the end portion on the other side arrives at the installation position of the pressing rollers 118. The travel of the wiping webs 110 is halted in synchronism with the halting of the conveyance of the heads 16C, 16M, 16Y and 16K.

By means of the above, the second wiping and cleaning action is completed. As described above, this second wiping and cleaning action wipes the nozzle surfaces 30C, 30M, 30Y and 30K with the wiping webs 110 in a state of low liquid absorption capability, and therefore it is possible to wipe and clean the nozzle surfaces 30C, 30M, 30Y and 30K of the heads 16C, 16M, 16Y and 16K without drawing ink out from the nozzles (without creating wiping traces). Furthermore, if wiping traces have occurred in the first wiping and cleaning action, it is possible to wipe away these traces effectively.

When the second wiping and cleaning action has been completed, the heads 16C, 16M, 16Y and 16K are conveyed directly toward the maintenance position.

On the other hand, in the head cleaners 100C, 100M, 100Y and 100K, the elevator cylinders 126 are driven and the pressing rollers 118 are disposed in the withdrawn position. After this, the head cleaners 100C, 100M, 100Y and 100K carry out location of an unused region of the wiping web for the next cleaning process, according to requirements. Furthermore, a travel direction switching motor 1124 is driven and the direction of travel is switched in such a manner that the direction of travel is set to the first direction.

By means of the steps described above, the cleaning of the nozzle surfaces 30C, 30M, 30Y and 30K of the heads 16C, 16M, 16Y and 16K is completed.

As described previously, in a head cleaning apparatus 70 according to the present embodiment, the liquid absorption capability of the wiping webs 110 which wipe and clean the nozzle surfaces 30C, 30M, 30Y and 30K of the heads 16C, 16M, 16Y and 16K is switched and the nozzle surfaces 30C, 30M, 30Y and 30K of the heads 16C, 16M, 16Y and 16K are wiped and cleaned in two separate actions. In other words, in a first action, wiping is performed in a state of high liquid absorption capability by sliding the wiping webs 110 in the lengthwise direction, and in a second action, wiping is performed in a state of low liquid absorption capability by sliding the wiping webs 110 in a direction perpendicular to the lengthwise direction. By this means, it is possible to clean the nozzle surfaces 30C, 30M, 30Y and 30K without the occurrence of wiping traces or wiping omissions.

In the present embodiment, the first wiping and cleaning action which is carried out with the direction of travel of the wiping webs 110 set to the first direction is implemented just once, but it may also be carried out a plurality of times. In this case, the heads 16C, 16M, 16Y and 16K are moved back and forth a plurality of times, while the wiping webs 110 remain pressed and abutted against the nozzle surfaces 30C, 30M, 30Y and 30K of the heads 16C, 16M, 16Y and 16K. In a similar fashion, the second wiping and cleaning action which is carried out with the direction of travel of the wiping webs 110 set to the second direction may also be carried out a plurality of times.

Furthermore, in the present example, the wiping webs 110 are slid while traveling in both the first and second actions, but the wiping webs 110 may also be slid in a halted state. By sliding the wiping webs 110 while traveling as in the present example, it is possible to wipe the nozzle surfaces 30C, 30M, 30Y and 30K of the heads 16C, 16M, 16Y and 16K by using a clean part of the web at all times. By this means, the cleaning effect can be enhanced.

Furthermore, according to the present example, in the first wiping and cleaning action, the wiping webs 110 are pressed and abutted against the nozzle surfaces 30C, 30M, 30Y and 30K of the heads 16C, 16M, 16Y and 16K while causing the wiping webs 110 to travel in the opposite direction with respect to the direction of movement of the heads 16C, 16M, 16Y and 16K, but the wiping webs 110 may also be pressed and abutted against the nozzle surfaces 30C, 30M, 30Y and 30K of the heads 16C, 16M, 16Y and 16K while traveling in the same direction. By pressing and abutting the wiping webs 110 against the nozzle surfaces 30C, 30M, 30Y and 30K of the heads 16C, 16M, 16Y and 16K while causing the wiping webs 110 to travel in the opposite direction with respect to the direction of movement of the heads 16C, 16M, 16Y and 16K, it is possible to raise the relative velocity of travel of the wiping webs 110 with respect to the nozzle surfaces 30C, 30M, 30Y and 30K of the heads 16C, 16M, 16Y and 16K, and hence the cleaning effect can be enhanced.

Moreover, in the example described above, the application of cleaning liquid, the first wiping and cleaning action and the second wiping and cleaning action are carried out during a step of moving the heads 16C, 16M, 16Y and 16K from the image formation position to the maintenance position, but it is also possible to carry out the application of cleaning liquid, the first wiping and cleaning action and the second wiping and cleaning action during a step of moving the heads 16C, 16M, 16Y and 16K from the maintenance position to the image formation position. Furthermore, it is also possible to carry out the application of the cleaning liquid, the first wiping and cleaning action and the second wiping and cleaning action during back and forth movement steps. For example, the application of the cleaning liquid is carried out during a step of moving the image formation position to the maintenance position, and the first wiping and cleaning action is carried out during a step of moving from the maintenance position to the image formation position. The second wiping and cleaning action is then carried out during a step of moving from the image formation position to the maintenance position. By this means, it is possible to shorten the cleaning time. In this case, the direction of travel of the wiping web 110 is switched appropriately.

Moreover, in the example described above, the wiping webs 110 are pressed and abutted against the nozzle surfaces 30C, 30M, 30Y and 30K of the heads 16C, 16M, 16Y and 16K by wrapping the wiping webs 110 about the pressing rollers 118 and pressing and abutting the pressing rollers 118 against the nozzle surfaces 30C, 30M, 30Y and 30K of the heads 16C, 16M, 16Y and 16K, but there are no particular restrictions on the device which presses and abuts the wiping webs 110 against of the nozzle surfaces 30C, 30M, 30Y and 30K of the heads 16C, 16M, 16Y and 16K.

For example, it is possible to adopt a composition where a guide member having a circular arc-shaped guide surface is fixed to a main body frame, and a wiping web is pressed and abutted against the nozzle surface of the head by being wrapped about the guide surface of this guide member. Furthermore, if using a guide member that is not rotated in this way, the guide surface does not necessarily have to be a circular arc-shaped surface, and it is also possible to form a plate-shaped guide surface provided in parallel with the nozzle surface and to press and abut a wiping web wrapped about this guide surface against the nozzle surface of the head. By this means, it is possible to create face-to-face contact between the wiping web and the nozzle surface of the head.

Furthermore, in the example described above, a wiping web 110 formed in a band shape is used, but the mode of the wiping member is not limited to this. It is also possible to use a wiping member which is in the form of a cloth. In this case also, a wiping member which changes the liquid absorption capability by changing orientation is used, and in the first action, the nozzle surface of the head is wiped using the orientation set to high liquid absorption capability, and in the second action, the nozzle surface of the head is wiped using the orientation set to low liquid absorption capability.

Furthermore, in the example described above, the liquid absorption capability of the wiping web is switched between two levels, a high level and a low level, and the nozzle surface of the head is wiped and cleaned in two separate actions, but a composition can also be adopted in which the liquid absorption capability of the wiping web is switched in a greater number of levels, in such a manner that the nozzle surface of the head is wiped and cleaned in a plurality of separate actions. For example, it is possible to adopt a composition in which the liquid absorption capability can be switched between three levels (high, medium, low) by switching the direction of travel, and in such a manner that the nozzle surface of the head is wiped and cleaned in three separate actions. In this case, the nozzle surface of the head is wiped by switching the liquid absorption capability in such a manner that the liquid absorption capability reduces in a stepwise fashion.

In this case as well, it is also possible to carry out wiping a plurality of times at each of the respective levels. In other words, in the present embodiment, the nozzle surface of the head should be wiped and cleaned at least once in a state of high liquid absorption capability, and the nozzle surface of the head should be wiped and cleaned finally in a state of low liquid absorption capability.

Second Embodiment of Head Cleaner of Second Mode

Figure 20:
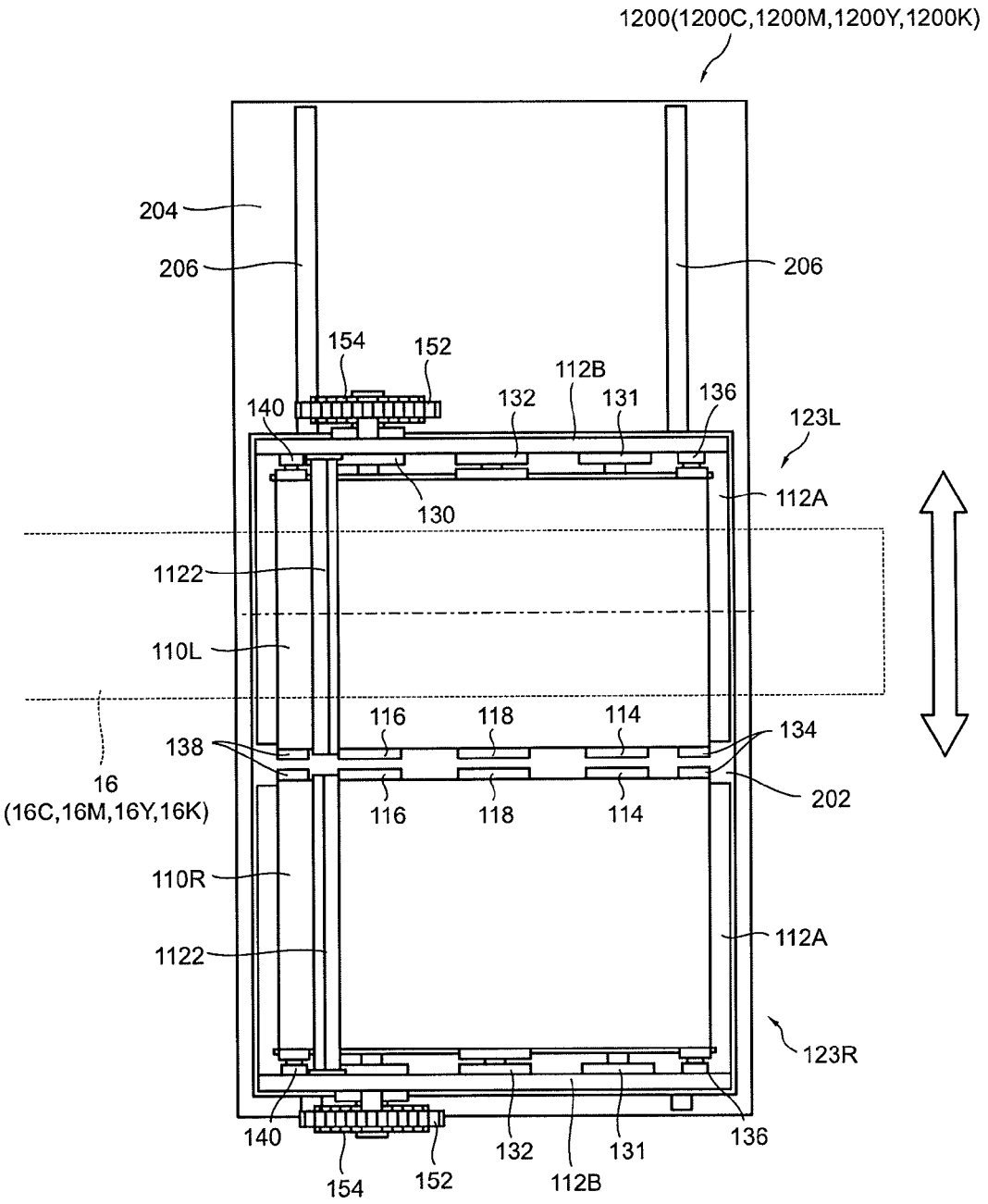
FIG. 20 is a plan diagram of a second embodiment of the head cleaning according to the second mode.
Figure 21:
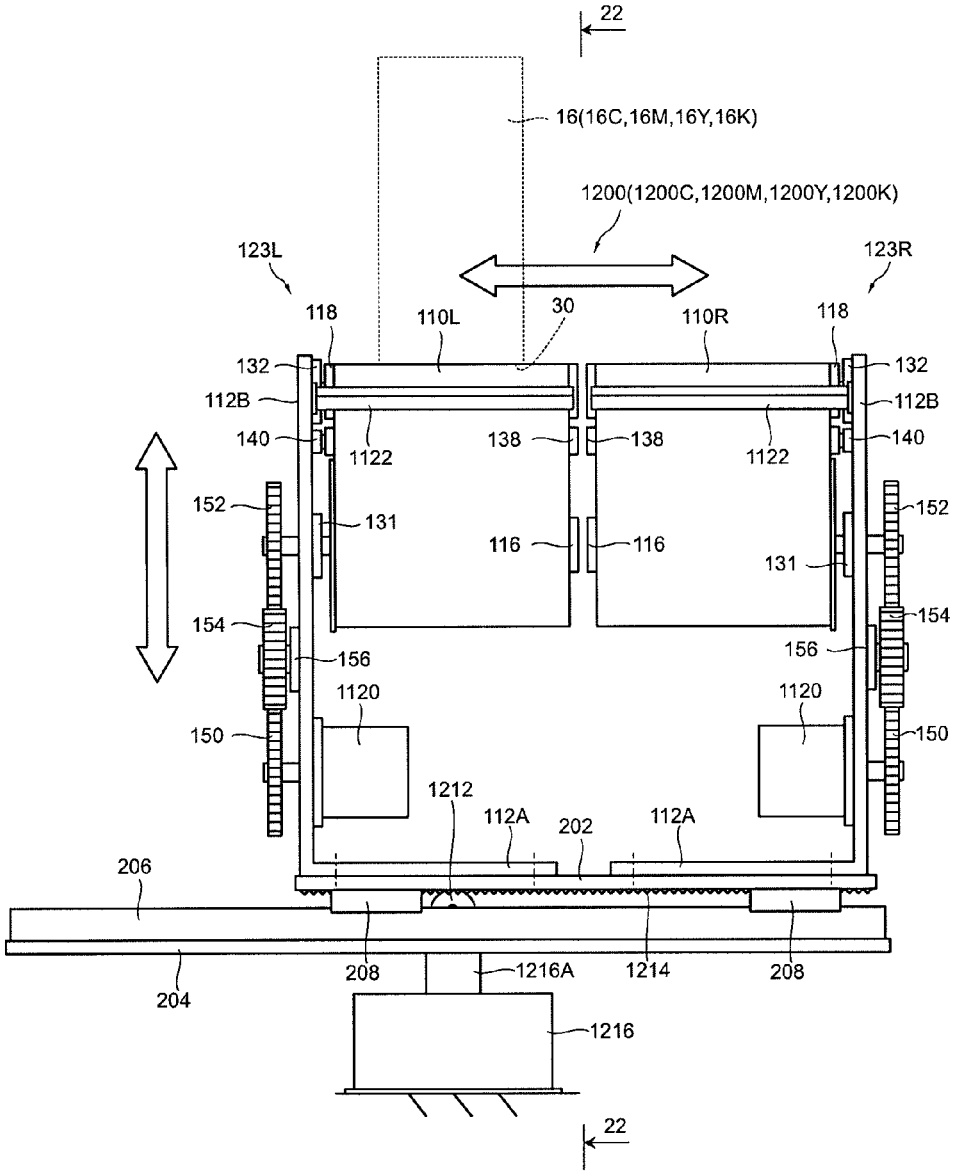
FIG. 21 is a side view diagram of the second embodiment of the head cleaner according to the second mode.
Figure 22:
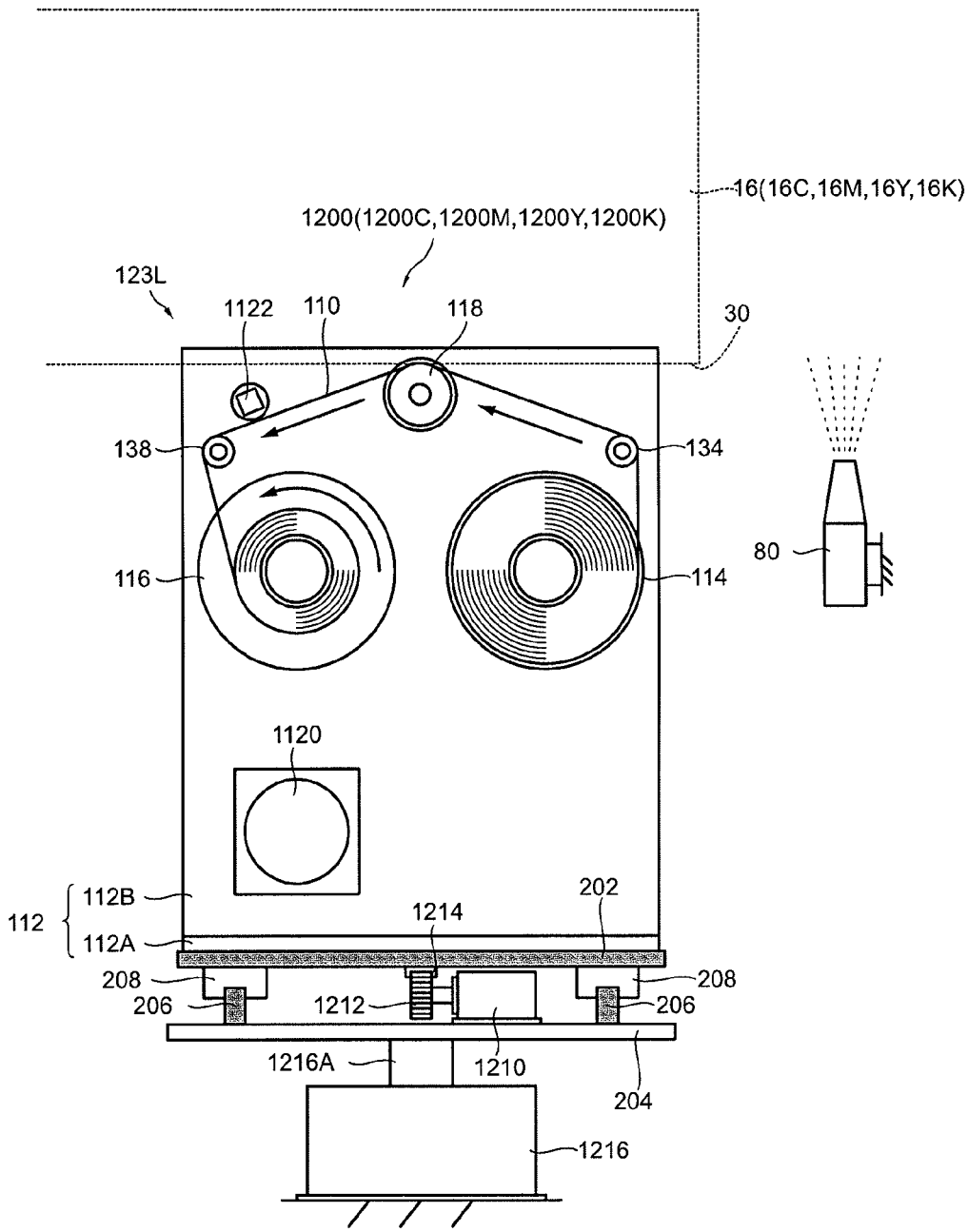
FIG. 22 is a cross-sectional view along 22-22 in FIG. 21.

FIG. 20 is a plan diagram of a second embodiment of a head cleaner according to the second mode, FIG. 21 is a side view diagram of a second embodiment of the head cleaner according to the second mode, and FIG. 22 is a cross-sectional diagram along 22-22 in FIG. 21.

As shown in FIG. 20 to FIG. 22, the head cleaners 1200 (1200C, 1200M, 1200Y and 1200K) according to the present embodiment each comprise two wiping webs 110L and 110R having different liquid absorption capabilities and wipe and clean the nozzle surface of the heads by switching the wiping webs used in a first action and a second action. In other words, the nozzle surface of each head is wiped by using a first wiping web 110L having a high liquid absorption capability (a wiping web having high liquid absorption capability sufficient to avoid the occurrence of wiping omissions when the nozzle surface of the head is wiped) in a first action (first cleaning step), and the nozzle surface is wiped by using a second wiping web 110R having a low liquid absorption capability (a wiping web having a low liquid absorption capability of a level which does not draw ink out from the nozzles when the nozzle surface of the head is wiped), in a second action (second cleaning step).

These two wiping webs 110L and 110R travel in parallel with the direction of movement of the head 16 (namely, the lengthwise direction of the head 16) by being driven respectively by a first wiping web travel drive unit 123L and a second wiping web travel drive unit 123R.

The composition of the first wiping web travel drive unit 123L and the second wiping web travel drive unit 123R are the same as the composition of the wiping web travel drive unit 123 of the head cleaner 100 according to the first embodiment of the second mode which is described above. Therefore, the same constituent elements are labeled with the same reference numerals and description thereof is omitted here.

The first wiping web travel drive unit 123L and the second wiping web travel drive unit 123R are both disposed on a sliding stage 202. The first wiping web travel drive unit 123L and the second wiping web travel drive unit 123R are arranged in opposing fashion on top of the sliding stage 202, and the respective pay-out reels 114, take-up reels 116, pressing rollers 118, pay-out guide rollers 134 and take-up guide rollers 138 thereof are arranged in coaxial fashion.

The first wiping web travel drive unit 123L and the second wiping web travel drive unit 123R are arranged in such a manner that the pay-out reels 114, the take-up reels 116, the pressing rollers 118, the pay-out guide rollers 134 and the take-up guide rollers 138 are respectively perpendicular to the direction of movement of the head 16. By this means, when the first wiping web 110L and the second wiping web 110R are caused to travel, the webs travel in parallel to the direction of movement of the head 16.

The first wiping web travel drive unit 123L and the second wiping web travel drive unit 123R are installed detachably on the sliding stage 202 by screw fastening the bottom surface portions 112A of respective main body frames 112 to the sliding stage 202. When the wiping webs are to be replaced, the respective wiping web travel drive units are removed from the sliding stage 202.

The sliding stage 202 is disposed in parallel with the nozzle surface 30 of the corresponding head 16, and is provided slidably on the elevator stage 204.

The elevator stage 204 is provided in parallel with the nozzle surface 30 of the corresponding head 16, and a pair of guide rails 206 and 206 is installed on the upper surface thereof. The pair of guide rails 206, 206 is arranged in parallel with the direction of movement of the head 16. The sliding stage 202 is provided slidably via sliders 208, 208 . . . on the guide rails 206 and 206.

Furthermore, a slide driving motor 1210 is provided between the pair of guide rails 206 and 206 on the elevator stage 204. A pinion 1212 is fixed to the output shaft of this slide driving motor 1210. On the other hand, a rack 1214 is formed in parallel with the pair of guide rails 206, 206 on the rear surface of the sliding stage 202, and this rack meshes with the pinion 1212.

The sliding stage 202 slides over the guide rails 206 and 206 due to the action of the rack 1214 and the pinion 1212, when the slide driving motor 1210 is driven. The system controller controls the movement of the sliding stage 202 by controlling the driving of the slide driving motor 1210 and thereby disposes the sliding stage 202 in a "first position" and a "second position".

Figure 23A:
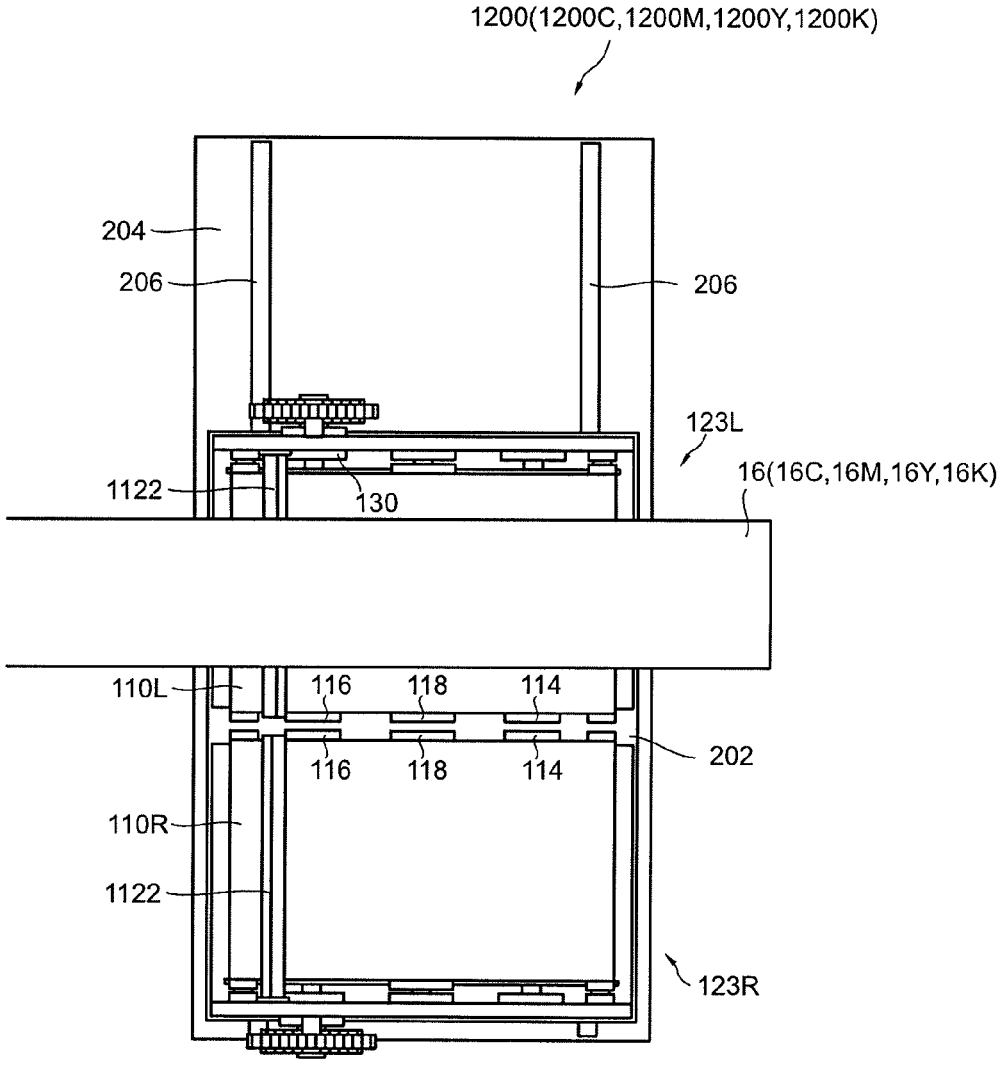
FIGS. 23A and 23B are illustrative diagrams of a wiping web switching operation of the head cleaner according to the second mode.
Figure 23B:
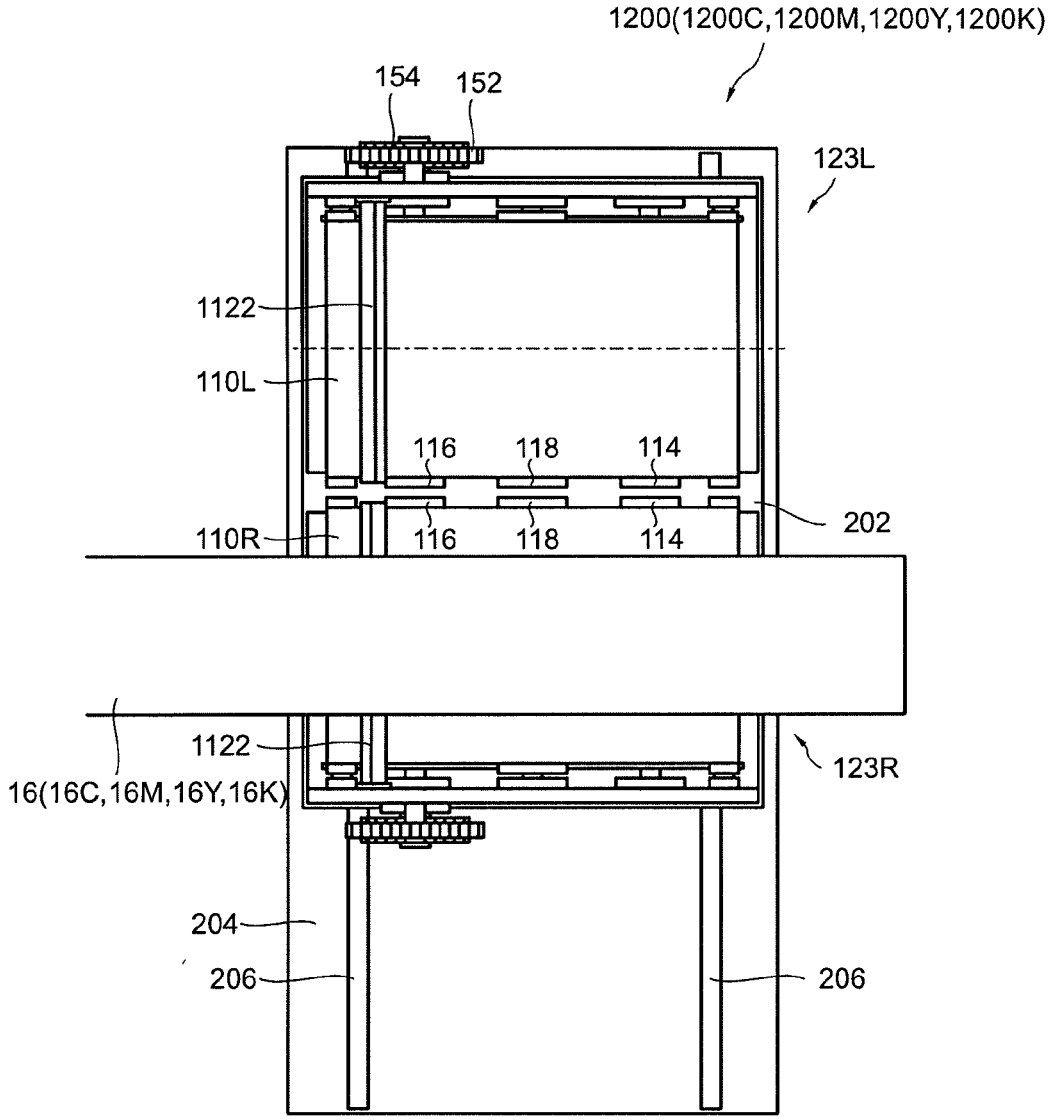

As shown in FIGS. 23A and 23B, of the first wiping web travel drive unit 123L and the second wiping web travel drive unit 123R which are arranged on the sliding stage 202, the first wiping web travel drive unit 123L is disposed above the path of movement of the head 16 when the sliding stage 202 is disposed in the first position (FIG. 23A), and the second wiping web travel drive unit 123R is disposed above the path of movement of the head 16 when the sliding stage 202 is disposed in the second position (FIG. 23B). Consequently, when the sliding stage 202 is disposed in the first position, the nozzle surface 30 of the head 16 can be wiped with the first wiping web 110L, and when the sliding stage 202 is disposed in the second position, the nozzle surface 30 of the head 16 can be wiped with the second wiping web 110R.

The elevator stage 204 is advanced and retracted perpendicularly with respect to the nozzle surface 30 of the corresponding head 16, by driving an elevator cylinder 1216.

The elevator cylinder 1216 is fixed to the head cleaning apparatus main body (not illustrated), and a rod 1216A of the cylinder is fixed perpendicularly to the lower surface portion of the elevator stage 204. The first wiping web travel drive unit 123L and the second wiping web travel drive unit 123R are advanced and retracted perpendicularly with respect to the nozzle surface 30 of the corresponding head 16, by driving this elevator cylinder 1216. By advancing and retracting the first wiping web travel drive unit 123L and the second wiping web travel drive unit 123R perpendicularly with respect to the nozzle surface 30 of the corresponding head 16, the pressing rollers 118 provided in the respective wiping web travel drive units are moved between a prescribed pressing position and withdrawn position.

When the pressing roller 118 which is disposed above the path of movement of the corresponding head 16 is moved to the pressing position, the pressing roller 118 presses and abuts against the nozzle surface 30 of the corresponding head 16, and when the pressing roller 118 is moved to the withdrawn position, the pressing roller 118 is separated from the nozzle surface 30 of the head 16. Consequently, for example, when the first wiping web travel drive unit 123L is disposed above the path of movement of the corresponding head 16 (when the sliding stage 202 is situated in the first position), then if the elevator cylinder 1216 is driven and the elevator stage 204 is raised or lowered, the wiping web 110L wrapped about the pressing roller 118 of the first wiping web travel drive unit 123L is pressed and abutted against, or separated from, the nozzle surface 30 of the corresponding head 16. On the other hand, when the second wiping web travel drive unit 123R is disposed above the path of movement of the corresponding head 16 (when the sliding stage 202 is situated in the second position), then if the elevator cylinder 1216 is driven and the elevator stage 204 is raised or lowered, the wiping web 110R wrapped about the pressing roller 118 of the second wiping web travel drive unit 123R is pressed and abutted against, or separated from, the nozzle surface 30 of the corresponding head 16.

The head cleaners 1200 (1200C, 1200M, 1200Y and 1200K) according to the present embodiment each have the composition described above.

The respective head cleaners 1200C, 1200M, 1200Y and 1200K are installed on a supporting frame (not illustrated), and are disposed in a prescribed installation position set between the image formation position and the maintenance position, being provided so as to oppose the nozzle surfaces 30C, 30M, 30Y and 30K of the corresponding heads 16C, 16M, 16Y and 16K (see FIG. 3).

Head Cleaning Method

Next, a cleaning method for a head using the head cleaner 1200 according to the present embodiment will be described.

Similarly to the head cleaning apparatus of the first embodiment of the second mode described above, the cleaning of the heads 16C, 16M, 16Y and 16K is carried out by wiping respectively with a wiping web 110 after applying a cleaning liquid to the whole area of the nozzle surfaces 30C, 30M, 30Y and 30K. In a head cleaning apparatus which uses the head cleaner 1200 according to the present embodiment, the operation of wiping the nozzle surfaces 30C, 30M, 30Y and 30K with the wiping webs is carried out in two separate actions. More specifically, the first action (first cleaning step) involves wiping the nozzle surface using a first wiping web 110L having a high liquid absorption capability and the second action (second cleaning step) involves wiping the nozzle surface using a second wiping web 110R having a low liquid absorption capability.

In this way, by wiping the nozzle surfaces 30C, 30M, 30Y and 30K in two separate wiping actions, it is possible to prevent wiping traces and wiping omissions. More specifically, large liquid droplets present on the nozzle surface are removed, thereby preventing wiping omissions, by the first wiping action performed with the first wiping web 110L in a state of high liquid absorption capability. In the subsequent second wiping action performed by the second wiping web 110R in a state of low liquid absorption capability, the wiping traces produced by the first wiping action are removed, as well as preventing ink from being drawn out from the nozzle holes. By this means, it is possible to clean the nozzle surfaces 30C, 30M, 30Y and 30K without the occurrence of wiping traces or wiping omissions.

Below, a specific cleaning method for the heads 16C, 16M, 16Y and 16K using the head cleaners 1200 according to the present embodiment will be described.

Firstly, cleaning liquid is applied to the nozzle surfaces 30C, 30M, 30Y and 30K of the heads 16C, 16M, 16Y and 16K in order to dissolve the adhering material created by the ink which is adhering to the nozzle surfaces 30C, 30M, 30Y and 30K.

The cleaning liquid is applied by moving the heads 16C, 16M, 16Y and 16K from the image formation position towards the maintenance position (or from the maintenance position towards the image formation position), as well as spraying cleaning liquid from the cleaning liquid application nozzles 80C, 80M, 80Y and 80K toward the nozzle surfaces 30C, 30M, 30Y and 30K of the heads 16C, 16M, 16Y and 16K.

When the application of the cleaning liquid has been completed, the heads 16C, 16M, 16Y and 16K are returned provisionally to the image formation position. Thereupon, a first wiping and cleaning action (first cleaning step) is carried out.

As described above, this first wiping action is carried out by using first wiping webs 110L having a high liquid absorption capability.

Firstly, the respective slide driving motors 1210 are driven and the sliding stages 202 are moved to the first position (if the sliding stages 202 are not already situated in the first position). By this means, the first wiping web travel drive units 123L are positioned over the path of movement of the heads 16C, 16M, 16Y and 16K.

Furthermore, in this case, if the unused region of the first wiping web 110L has not been located in position, then positional location is carried out. When this positional location of the unused region has been completed, the heads 16C, 16M, 16Y and 16K are conveyed by a prescribed amount toward the maintenance position.

As the heads 16C, 16M, 16Y and 16K are moved toward the maintenance position, they are halted temporarily when the end portion on one side thereof (the end portion on the maintenance position side) arrives at the installation position of the pressing roller 118. In this case, the pressing rollers 118 of the head cleaners 1200C, 1200M, 1200Y and 1200K are situated in the withdrawn position.

When the heads 16C, 16M, 16Y and 16K are halted, the elevator cylinders 1216 are driven and the pressing rollers 118 are moved to a pressing position. By this means, the first wiping webs 110L which are wrapped about the pressing rollers 118 of the respective first wiping web travel drive units 123L are pressed and abutted against the nozzle surfaces 30C, 30M, 30Y and 30K of the heads 16C, 16M, 16Y and 16K.

When the first wiping webs 110L wrapped about the pressing rollers 118 of the first wiping web travel drive units 123L are pressed and abutted against the nozzle surfaces 30C, 30M, 30Y and 30K of the heads 16C, 16M, 16Y and 16K, then the take-up motors 1120 of the first wiping web travel drive units 123L are driven. By this means, the first wiping webs 110L are wound up respectively onto the take-up reels 116 at a uniform speed, and the first wiping webs 110L which are wrapped about the pressing rollers 118 of the first wiping web travel drive units 123L travel at a uniform speed of travel.

Furthermore, simultaneously with this, the head feed motor 60 is driven and the heads 16C, 16M, 16Y and 16K are conveyed toward the maintenance position at a uniform speed of movement.

As a result of this, the first wiping webs 110L are slid over the nozzle surfaces 30C, 30M, 30Y and 30K of the heads 16C, 16M, 16Y and 16K while the first wiping webs 110L travel in the direction opposite to the direction of movement of the heads 16C, 16M, 16Y and 16K, thereby wiping and cleaning the nozzle surfaces 30C, 30M, 30Y and 30K by means of the traveling first wiping webs 110L.

The heads 16C, 16M, 16Y and 16K which have been conveyed to the maintenance position are halted when the end portion on the other side (the end portion on the side of the image formation position) arrives at the installation position of the pressing rollers 118. The travel of the first wiping webs 110L is halted in synchronism with the halting of the conveyance of the heads 16C, 16M, 16Y and 16K.

By means of the above, the first wiping and cleaning action is completed. As described above, this first wiping and cleaning action involves wiping by using the first wiping webs 110L having a high liquid absorption capability. By this means, it is possible to wipe and clean the nozzle surfaces 30C, 30M, 30Y and 30K without the occurrence of wiping omissions.

When the first wiping and cleaning action has been completed, the elevator cylinders 1216 are driven and the pressing rollers 118 of the first wiping web travel drive units 123L are moved to a withdrawn position. Furthermore, the heads 16C, 16M, 16Y and 16K are returned toward the image formation position. The heads 16C, 16M, 16Y and 16K which have been returned toward the image formation position are halted when the end portion on the one side is situated at the installation position of the pressing roller 118 of the first wiping web travel drive unit 123L. Thereupon, a second wiping and cleaning action (second cleaning step) is carried out.

Firstly, the wiping web used is switched. More specifically, the respective sliding drive motors 1210 are driven and the sliding stages 202 are moved to the second position. By this means, the second wiping web travel drive units 123R are positioned over the path of movement of the heads 16C, 16M, 16Y and 16K.

Furthermore, in this case, if the unused region of the second wiping web 110R has not been located in position, then positional location of the second wiping web 110R is carried out. When positional location of the unused region has been completed, the elevator cylinders 1216 are driven and the pressing rollers 118 are moved to the pressing position. By this means, the second wiping webs 110R which are wrapped about the pressing rollers 118 of the respective second wiping web travel drive units 123R are pressed and abutted against the nozzle surfaces 30C, 30M, 30Y and 30K of the heads 16C, 16M, 16Y and 16K.

When the second wiping webs 110R wrapped about the pressing rollers 118 of the second wiping web travel drive units 123R are pressed and abutted against the nozzle surfaces 30C, 30M, 30Y and 30K of the heads 16C, 16M, 16Y and 16K, then the take-up motors 1120 of the second wiping web travel drive units 123R are driven. By this means, the second wiping webs 110R are wound up respectively onto the take-up reels 116 at a uniform speed, and the second wiping webs 110R which are wrapped about the pressing rollers 118 of the second wiping web travel drive units 123R travel at a uniform speed of travel.

Furthermore, simultaneously with this, the head feed motor 60 is driven and the heads 16C, 16M, 16Y and 16K are conveyed toward the maintenance position at a uniform speed of movement.

As a result of this, the second wiping webs 110R are slid over the nozzle surfaces 30C, 30M, 30Y and 30K of the heads 16C, 16M, 16Y and 16K while the second wiping webs 110R travel in the direction opposite to the direction of movement of the heads 16C, 16M, 16Y and 16K, thereby wiping and cleaning the nozzle surfaces 30C, 30M, 30Y and 30K by means of the traveling second wiping webs 110R.

The heads 16C, 16M, 16Y and 16K which have been conveyed to the maintenance position are halted when the end portion on the other side (the end portion on the side of the image formation position) arrives at the installation position of the pressing rollers 118. The travel of the second wiping webs 110R is halted in synchronism with the halting of the conveyance of the heads 16C, 16M, 16Y and 16K.

By means of the above, the second wiping and cleaning action is completed. As described above, this second wiping and cleaning action wipes the nozzle surfaces 30C, 30M, 30Y and 30K with the second wiping webs 110R which have low liquid absorption capability, and therefore it is possible to wipe and clean the nozzle surfaces 30C, 30M, 30Y and 30K of the heads 16C, 16M, 16Y and 16K without drawing ink out from the nozzles (without creating wiping traces). Furthermore, if wiping traces have occurred in the first wiping and cleaning action, it is possible to wipe away these traces effectively.

When the second wiping and cleaning action has been completed, the heads 16C, 16M, 16Y and 16K are conveyed directly toward the maintenance position.

On the other hand, in the head cleaners 1200C, 1200M, 1200Y and 1200K, the elevator cylinders 126 are driven and the pressing rollers 118 are disposed in the withdrawn position. After this, the head cleaners 1200C, 1200M, 1200Y and 1200K carry out location of an unused region of the wiping web for the next cleaning process, according to requirements. Furthermore, the sliding stages 202 are moved in such a manner that the first wiping web travel drive units 123L are respectively disposed above the path of movement of the heads 16.

By means of the steps described above, the cleaning of the nozzle surfaces 30C, 30M, 30Y and 30K of the heads 16C, 16M, 16Y and 16K is completed.

As described above, in the present embodiment, the liquid absorption capability of the wiping web which wipes and cleans the nozzle surfaces 30C, 30M, 30Y and 30K of the heads 16C, 16M, 16Y and 16K is switched and the nozzle surfaces 30C, 30M, 30Y and 30K of the heads 16C, 16M, 16Y and 16K are wiped and cleaned in two separate actions, whereby it is possible to clean the nozzle surfaces 30C, 30M, 30Y and 30K without the occurrence of wiping traces or wiping omissions, similarly to the first embodiment of the second mode which is described above.

By using two wiping webs having different liquid absorption capabilities in this way, it is possible to increase the range of selection of the wiping webs which can be used.

In the present embodiment, the first wiping and cleaning action which is carried out using the first wiping webs 110L is implemented just once, but it may also be carried out a plurality of times. In a similar fashion, the second wiping and cleaning action which is carried out using the second wiping webs 110R may be carried out a plurality of times.

Furthermore, in the present example, the wiping webs are slid while traveling in both the first and second actions, but the wiping webs may also be slid in a halted state. By sliding the wiping webs while traveling as in the present example, it is possible to wipe the nozzle surfaces 30C, 30M, 30Y and 30K of the heads 16C, 16M, 16Y and 16K by using a clean part of the web at all times. By this means, the cleaning effect can be enhanced.

Furthermore, according to the present example, the wiping webs are pressed and abutted against the nozzle surfaces 30C, 30M, 30Y and 30K of the heads 16C, 16M, 16Y and 16K while causing the wiping webs to travel in the opposite direction with respect to the direction of movement of the heads 16C, 16M, 16Y and 16K, but the wiping webs may also be pressed and abutted against the nozzle surfaces 30C, 30M, 30Y and 30K of the heads 16C, 16M, 16Y and 16K while traveling in the same direction. By pressing and abutting the wiping webs against the nozzle surfaces 30C, 30M, 30Y and 30K of the heads 16C, 16M, 16Y and 16K while causing the wiping webs to travel in the opposite direction with respect to the direction of movement of the heads 16C, 16M, 16Y and 16K, it is possible to raise the relative velocity of travel of the wiping webs 110 with respect to the nozzle surfaces 30C, 30M, 30Y and 30K of the heads 16C, 16M, 16Y and 16K, and the cleaning effect can be enhanced.

Furthermore, in the example described above, the nozzle surfaces of the heads are wiped and cleaned in two separate actions by using two wiping webs having different liquid absorption capabilities, but it is also possible to wipe and clean the nozzle surfaces of the heads in a plurality of separate actions by using a plurality of wiping webs having different liquid absorption capabilities. For example, it is possible to use three wiping webs having different liquid absorption capabilities (high, medium and low) in such a manner that the nozzle surfaces of the heads are wiped and cleaned in three separate actions. In this case, the nozzle surfaces of the heads are wiped by switching the wiping webs in such a manner that the liquid absorption capability reduces.

In this case as well, it is also possible to carry out wiping a plurality of times at each of the respective levels. In other words, in the present embodiment, the nozzle surfaces of the head should be wiped and cleaned at least once with a wiping web having a high liquid absorption capability, and the nozzle surfaces of the head should be wiped and cleaned finally with a wiping web having a low liquid absorption capability.

Third Embodiment of Head Cleaner of Second Mode

Figure 24:
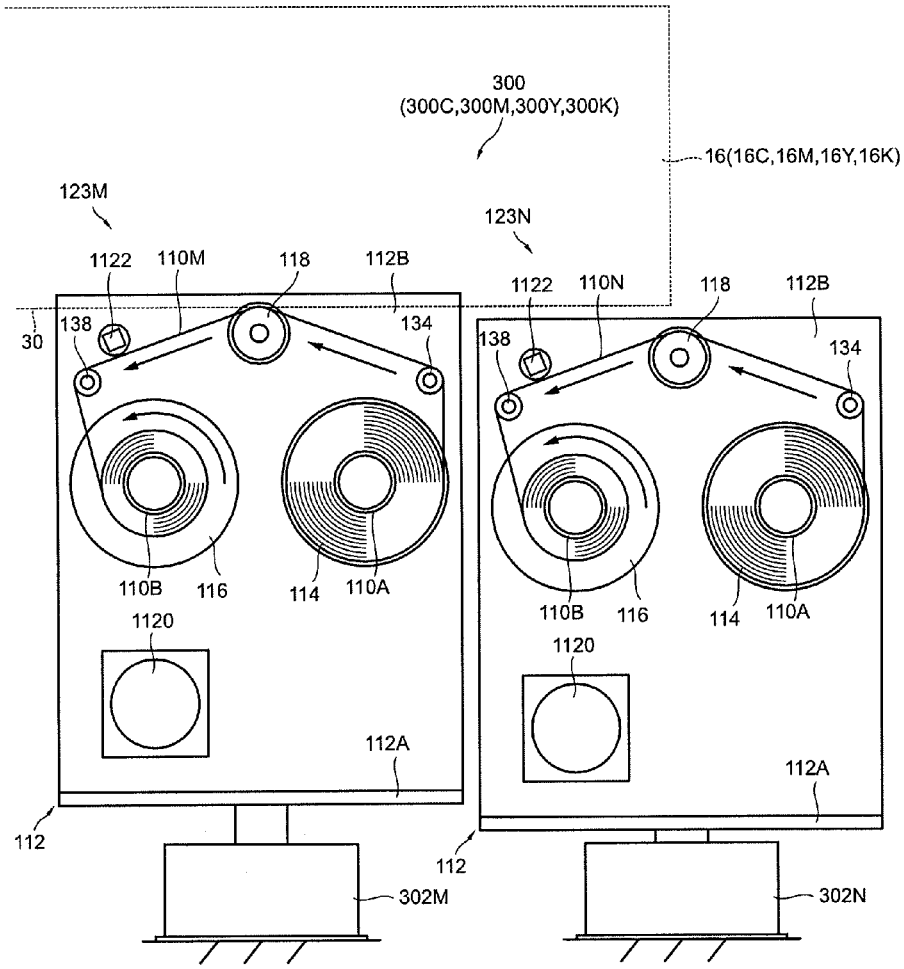
FIG. 24 is a front view diagram of the second embodiment of the head cleaner according to the second mode.
Figure 25:
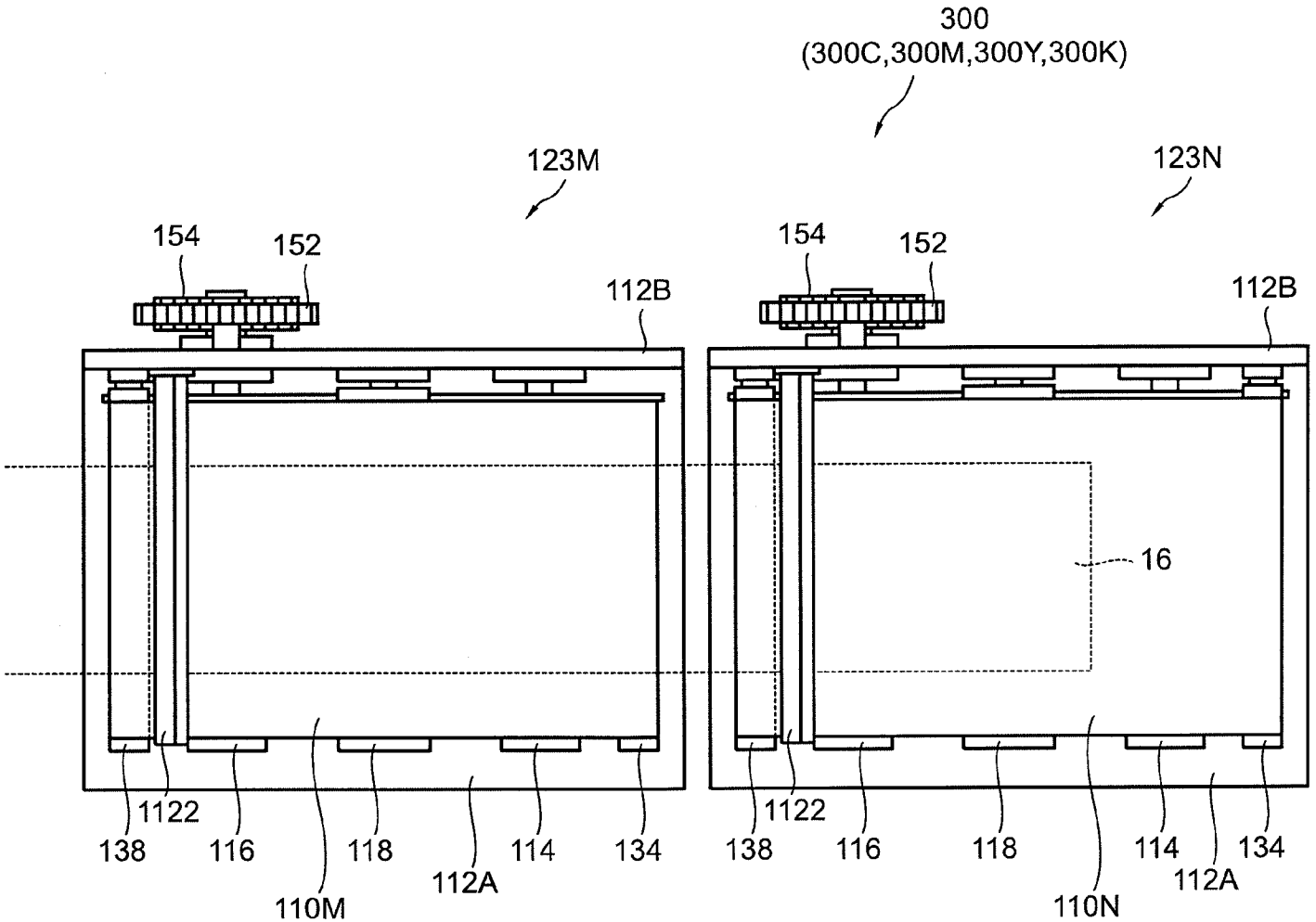
FIG. 25 is a plan diagram of a third embodiment of the head cleaning according to the second mode.

FIG. 24 is a front view diagram of a third embodiment of a head cleaner according to the second mode and FIG. 25 is a plan diagram of the third embodiment of the head cleaner according to the second mode.

As shown in FIG. 24 and FIG. 25, the head cleaners 300 (300C, 300M, 300Y and 300K) according to the present embodiment each comprise two wiping webs 110M and 110N having different liquid absorption capabilities and wipe and clean the nozzle surface of the heads by switching the wiping webs used in a first action and a second action, in a similar fashion to the head cleaners 1200 of the second embodiment of the second mode which are described above.

The head cleaners 300 according to the present embodiment differ from the head cleaners 1200 according to the second embodiment of the second mode described above in that the wiping webs 110M and 110M are disposed in a forward/rearward relationship in the direction of movement of the heads 16.

The forward wiping web 110M is a wiping web having a high liquid absorption capability (a wiping web of high liquid absorption capability which does not give rise to wiping omissions even when the nozzle surface of the head is wiped), and firstly, the nozzle surface 30 of the head 16 is wiped using this forward wiping web 110M.

The rearward wiping web 110N is a wiping web having a low liquid absorption capability (a wiping web of a sufficiently low liquid absorption capability to avoid drawing out of ink from the nozzles when the nozzle surface of the head is wiped), and the nozzle surface 30 of the head 16 is wiped by using this rearward wiping web 110N, after wiping the nozzle surface 30 of the head 16 with the forward wiping web 110M which has a high liquid absorption capability.

The forward wiping web 110M and the rearward wiping web 110N travel in parallel with the direction of movement of the head 16 (namely, the lengthwise direction of the head 16) by being driven respectively by a forward wiping web travel drive unit 123M and a rearward wiping web travel drive unit 123N.

The composition of the forward wiping web travel drive unit 123M and the rearward wiping web travel drive unit 123N is the same as the composition of the wiping web travel drive unit 123 of the head cleaner 100 according to the first embodiment of the second mode which is described above. Therefore, the same constituent elements are labeled with the same reference numerals and description thereof is omitted here.

The forward wiping web travel drive unit 123M and the rearward wiping web travel drive unit 123N are respectively raised and lowered independently by driving elevator cylinders 302M and 302N.

The forward elevator cylinder 302M is fixed to the main body of the head cleaning apparatus (not illustrated), and the rod thereof is fixed perpendicularly to the bottom surface portion 112A of the main body frame 112 of the forward wiping web drive travel unit 123M. The forward wiping web travel drive unit 123M is advanced and retracted perpendicularly with respect to the nozzle surface 30 of the corresponding head 16, by driving this elevator cylinder 302M. By advancing and retracting the forward wiping web travel drive unit 123M perpendicularly with respect to the nozzle surface 30 of the corresponding head 16, the pressing roller 118 provided in the forward wiping web travel drive unit 123M is moved between a prescribed pressing position and withdrawn position. By situating the pressing roller 118 in the prescribed pressing position, the forward wiping web 110M wrapped about the pressing roller 118 is pressed and abutted against the nozzle surface 30 of the corresponding head 16. Furthermore, by situating the pressing roller 118 in the prescribed withdrawn position, the forward wiping web 110M wrapped about the pressing roller 118 is separated from the nozzle surface 30 of the corresponding head 16.

The rearward elevator cylinder 302N is fixed to the main body of the head cleaning apparatus (not illustrated), and the rod thereof is fixed perpendicularly to the bottom surface portion 112A of the main body frame 112 of the rearward wiping web drive travel unit 123N. The rearward wiping web travel drive unit 123N is advanced and retracted perpendicularly with respect to the nozzle surface 30 of the corresponding head 16, by driving this elevator cylinder 302N. By advancing and retracting the rearward wiping web travel drive unit 123N perpendicularly with respect to the nozzle surface 30 of the corresponding head 16, the pressing roller 118 provided in the rearward wiping web travel drive unit 123N is moved between a prescribed pressing position and withdrawn position. By situating the pressing roller 118 in the prescribed pressing position, the rearward wiping web 110N wrapped about the pressing roller 118 is pressed and abutted against the nozzle surface 30 of the corresponding head 16. Furthermore, by situating the pressing roller 118 in the prescribed withdrawn position, the rearward wiping web 110N wrapped about the pressing roller 118 is separated from the nozzle surface 30 of the corresponding head 16.

The head cleaners 300 (300C, 300M, 300Y and 300K) according to the present embodiment each have the composition described above.

The respective head cleaners 300C, 300M, 300Y and 300K are installed on a supporting frame (not illustrated), and are provided in a prescribed installation position set between the image formation position and the maintenance position, being disposed so as to oppose the nozzle surfaces 30C, 30M, 30Y and 30K of the corresponding heads 16C, 16M, 16Y and 16K (see FIG. 3).

Head Cleaning Method

Next, a cleaning method for a head using the head cleaner 300 according to the present embodiment will be described.

Similarly to the head cleaning apparatus of the first embodiment of the second mode described above, the cleaning of the heads 16C, 16M, 16Y and 16K is carried out by wiping with a wiping web 110 after applying a cleaning liquid to the whole area of the nozzle surfaces 30C, 30M, 30Y and 30K. In a head cleaning apparatus which uses the head cleaner 1200 according to the present embodiment, the operation of wiping the nozzle surfaces 30C, 30M, 30Y and 30K with the wiping webs is carried out in two separate actions. More specifically, a first action (first cleaning step) involves wiping the nozzle surface using a forward wiping web 110M having a high liquid absorption capability and a second action (second cleaning step) involves wiping the nozzle surface using a rearward wiping web 110N having a low liquid absorption capability.

In this way, by wiping the nozzle surfaces 30C, 30M, 30Y and 30K in two separate wiping actions, it is possible to prevent wiping traces and wiping omissions. More specifically, large liquid droplets present on the nozzle surface are removed, thereby preventing wiping omissions, by the first wiping action which is performed with the forward wiping web 110M having high liquid absorption capability. In the subsequent second wiping action which is performed with the rearward wiping web 110N having low liquid absorption capability, the wiping trace produced by the first wiping action is removed, as well as preventing ink from being drawn out from the nozzle holes. By this means, it is possible to clean the nozzle surfaces 30C, 30M, 30Y and 30K without the occurrence of wiping traces or wiping omissions.

Below, a specific cleaning method for the heads 16C, 16M, 16Y and 16K using the head cleaner 300 according to the present embodiment will be described.

Firstly, cleaning liquid is applied to the nozzle surfaces 30C, 30M, 30Y and 30K of the heads 16C, 16M, 16Y and 16K in order to dissolve the adhering material created by the ink which is adhering to the nozzle surfaces 30C, 30M, 30Y and 30K.

The cleaning liquid is applied by moving the heads 16C, 16M, 16Y and 16K from the image formation position towards the maintenance position (or from the maintenance position towards the image formation position), as well as spraying cleaning liquid from the cleaning liquid application nozzles 80C, 80M, 80Y and 80K toward the nozzle surfaces 30C, 30M, 30Y and 30K of the heads 16C, 16M, 16Y and 16K.

When the application of the cleaning liquid has been completed, the heads 16C, 16M, 16Y and 16K are returned provisionally to the image formation position. Thereupon, a first wiping and cleaning action (first cleaning step) is carried out.

As described above, this first wiping action is carried out by using the forward wiping web 110M which has a high liquid absorption capability.

Firstly, the heads 16C, 16M, 16Y and 16K are moved through a prescribed amount towards the maintenance position. As the heads 16C, 16M, 16Y and 16K are moved toward the maintenance position, they are halted temporarily when the end portion on one side thereof (the end portion on the maintenance position side) arrives at the installation position of the pressing roller 118 of the corresponding forward wiping web travel drive unit 123M. In this case, the pressing rollers 118 of the forward wiping web travel drive units 123M and the rearward wiping web travel drive units 123N of each of the head cleaners 300C, 300M, 300Y and 300K are disposed in a retracted position.

When the heads 16C, 16M, 16Y and 16K are halted, the elevator cylinders 302M of the forward wiping web travel drive units 123M are driven and the pressing rollers 118 of the respective forward wiping web travel drive units 123M are moved to a pressing position. By this means, the forward wiping webs 110M which are wrapped about the pressing rollers 118 of the respective forward wiping web travel drive units 123M are pressed and abutted against the nozzle surfaces 30C, 30M, 30Y and 30K of the heads 16C, 16M, 16Y and 16K.

When the forward wiping webs 110M which are wrapped about the pressing rollers 118 of the respective forward wiping web travel drive units 123M are pressed and abutted against the nozzle surfaces 30C, 30M, 30Y and 30K of the heads 16C, 16M, 16Y and 16K, the take-up motors 1120 of the forward wiping web travel drive units 123M are driven. By this means, the forward wiping webs 110M are wound up respectively onto the take-up reels 116 at a uniform speed, and the forward wiping webs 110M which are wrapped about the pressing rollers 118L of the forward wiping web travel drive units 123M travel at a uniform speed of travel.

Furthermore, simultaneously with this, the head feed motor 60 is driven and the heads 16C, 16M, 16Y and 16K are conveyed toward the maintenance position at a uniform speed of movement.

As a result of this, the forward wiping webs 110M are slid over the nozzle surfaces 30C, 30M, 30Y and 30K of the heads 16C, 16M, 16Y and 16K while the forward wiping webs 110M travel in the direction opposite to the direction of movement of the heads 16C, 16M, 16Y and 16K, thereby wiping and cleaning the nozzle surfaces 30C, 30M, 30Y and 30K by means of the traveling forward wiping webs 110M.

The heads 16C, 16M, 16Y and 16K which have been conveyed to the maintenance position are halted when the end portion on the other side (the end portion on the side of the image formation position) arrives at the installation position of the pressing rollers 118. The travel of the forward wiping webs 110M is halted in synchronism with the halting of the conveyance of the heads 16C, 16M, 16Y and 16K.

By means of the above, the first wiping and cleaning action is completed. As described above, this first wiping and cleaning action is carried out by using the forward wiping webs 110M which have a high liquid absorption capability. By this means, it is possible to wipe and clean the nozzle surfaces 30C, 30M, 30Y and 30K without the occurrence of wiping omissions.

When the first wiping and cleaning action has been completed, the elevator cylinders 302M of the forward wiping web travel drive units 123M are driven and the pressing rollers 118 of the forward wiping web travel drive units 123M are thereby moved to a withdrawn position. Furthermore, the heads 16C, 16M, 16Y and 16K are returned toward the image formation position. The heads 16C, 16M, 16Y and 16K which have been returned toward the image formation position are halted when the end portion on the one side is situated at the installation position of the pressing roller 118 of the rearward wiping web travel drive unit 123N. Thereupon, a second wiping and cleaning action (second cleaning step) is carried out.

Firstly, the elevator cylinders 302N of the rearward wiping web travel drive units 123N are driven and the pressing rollers 118 of the respective rearward wiping web travel drive units 123N are moved to a pressing position. By this means, the rearward wiping webs 110N which are wrapped about the pressing rollers 118 of the respective rearward wiping web travel drive units 123N are pressed and abutted against the nozzle surfaces 30C, 30M, 30Y and 30K of the heads 16C, 16M, 16Y and 16K.

When the rearward wiping webs 110N which are wrapped about the pressing rollers 118 of the rearward wiping web travel drive units 123N are pressed and abutted against the nozzle surfaces 30C, 30M, 30Y and 30K of the heads 16C, 16M, 16Y and 16K, the take-up motors 1120 of the rearward wiping web travel drive units 123N are driven. By this means, the rearward wiping webs 110N are wound up respectively onto the take-up reels 116 at a uniform speed, and the rearward wiping webs 110N which are wrapped about the pressing rollers 118 of the rearward wiping web travel drive units 123N travel at a uniform speed of travel.

Furthermore, simultaneously with this, the head feed motor 60 is driven and the heads 16C, 16M, 16Y and 16K are conveyed toward the maintenance position at a uniform speed of movement.

As a result of this, the rearward wiping webs 110N are slid over the nozzle surfaces 30C, 30M, 30Y and 30K of the heads 16C, 16M, 16Y and 16K while the rearward wiping webs 110N travel in the direction opposite to the direction of movement of the heads 16C, 16M, 16Y and 16K, thereby wiping and cleaning the nozzle surfaces 30C, 30M, 30Y and 30K by means of the traveling rearward wiping webs 110N.

The heads 16C, 16M, 16Y and 16K which have been conveyed to the maintenance position are halted when the end portion on the other side (the end portion on the side of the image formation position) arrives at the installation position of the pressing rollers 118. The travel of the rearward wiping webs 110N is halted in synchronism with the halting of the conveyance of the heads 16C, 16M, 16Y and 16K.

By means of the above, the second wiping and cleaning action is completed. As described above, this second wiping and cleaning action wipes the nozzle surfaces 30C, 30M, 30Y and 30K respectively with rearward wiping webs 110N which have low liquid absorption capability, and therefore it is possible to wipe and clean the nozzle surfaces 30C, 30M, 30Y and 30K of the heads 16C, 16M, 16Y and 16K without drawing ink out from the nozzles (without creating wiping traces). Furthermore, if wiping traces have occurred in the first wiping and cleaning action, it is possible to wipe away these traces effectively.

When the second wiping and cleaning action has been completed, the heads 16C, 16M, 16Y and 16K are conveyed directly toward the maintenance position.

On the other hand, in the head cleaners 300C, 300M, 300Y and 300K, the elevator cylinders 302N of the rearward wiping web travel drive units 123N are driven and the pressing rollers 118 of the rearward wiping web travel drive units 123N are situated in the withdrawn position. After this, the head cleaners 300C, 300M, 300Y and 300K carry out location of an unused region of the wiping web for the next cleaning process, according to requirements.

By means of the steps described above, the cleaning of the nozzle surfaces 30C, 30M, 30Y and 30K of the heads 16C, 16M, 16Y and 16K is completed.

As described above, in the present embodiment, the liquid absorption capability of the wiping webs which wipe and clean the nozzle surfaces 30C, 30M, 30Y and 30K of the heads 16C, 16M, 16Y and 16K is switched and the nozzle surfaces 30C, 30M, 30Y and 30K of the heads 16C, 16M, 16Y and 16K are wiped and cleaned in two separate actions, whereby it is possible to clean the nozzle surfaces 30C, 30M, 30Y and 30K without the occurrence of wiping traces or wiping omissions, similarly to the first embodiment of the second mode which is described above.

By using two wiping webs having different liquid absorption capabilities in this way, it is possible to increase the range of selection of the wiping webs which can be used.

In the present embodiment, the first wiping and cleaning action which is carried out using the forward wiping webs 110M is implemented just once, but it may also be carried out a plurality of times. In a similar fashion, the second wiping and cleaning action which is carried out using the rearward wiping webs 110N may be carried out a plurality of times.

Furthermore, in the present example, the wiping webs are slid while traveling in both the first and second actions, but the wiping webs may also be slid in a halted state. By sliding the wiping webs while traveling as in the present example, it is possible to wipe the nozzle surfaces 30C, 30M, 30Y and 30K of the heads 16C, 16M, 16Y and 16K by using a clean part of the web at all times. By this means, the cleaning effect can be enhanced.

Furthermore, according to the present example, the wiping webs are pressed and abutted against the nozzle surfaces 30C, 30M, 30Y and 30K of the heads 16C, 16M, 16Y and 16K while causing the wiping webs to travel in the opposite direction with respect to the direction of movement of the heads 16C, 16M, 16Y and 16K, but the wiping webs may also be pressed and abutted against the nozzle surfaces 30C, 30M, 30Y and 30K of the heads 16C, 16M, 16Y and 16K while traveling in the same direction. By pressing and abutting the wiping webs against the nozzle surfaces 30C, 30M, 30Y and 30K of the heads 16C, 16M, 16Y and 16K while causing the wiping webs to travel in the opposite direction with respect to the direction of movement of the heads 16C, 16M, 16Y and 16K, it is possible to raise the relative velocity of travel of the wiping webs 110 with respect to the nozzle surfaces 30C, 30M, 30Y and 30K of the heads 16C, 16M, 16Y and 16K, and the cleaning effect can be improved.

Furthermore, in the example described above, the nozzle surfaces of the heads are wiped and cleaned in two separate actions by using two wiping webs having different liquid absorption capabilities, but it is also possible to wipe and clean the nozzle surfaces of the heads in a plurality of separate actions by using a plurality of wiping webs having different liquid absorption capabilities. For example, it is possible to use three wiping webs having different liquid absorption capabilities (high, medium and low) in such a manner that the nozzle surfaces of the heads are wiped and cleaned in three separate actions. In this case, the nozzle surfaces of the heads are wiped by switching the wiping webs in such a manner that the liquid absorption capability reduces in a stepwise fashion.

In this case as well, it is also possible to carry out wiping a plurality of times at each of the respective levels. In other words, in the present embodiment, the nozzle surfaces of the heads should each be wiped and cleaned at least once with a wiping web having a high liquid absorption capability, and the nozzle surface of the head should be wiped and cleaned finally with a wiping web having a low liquid absorption capability.

Furthermore, in the example described above, the forward wiping web travel drive units 123M and the rearward wiping web travel drive units 123N are raised and lowered respectively and independently, but they may also be raised and lowered simultaneously. By this means, the wiping and cleaning action using the forward wiping web 110M and the wiping and cleaning action using the rearward wiping web 110N can be carried out simultaneously.

Fourth Embodiment of Head Cleaner of Second Mode

Figure 26:
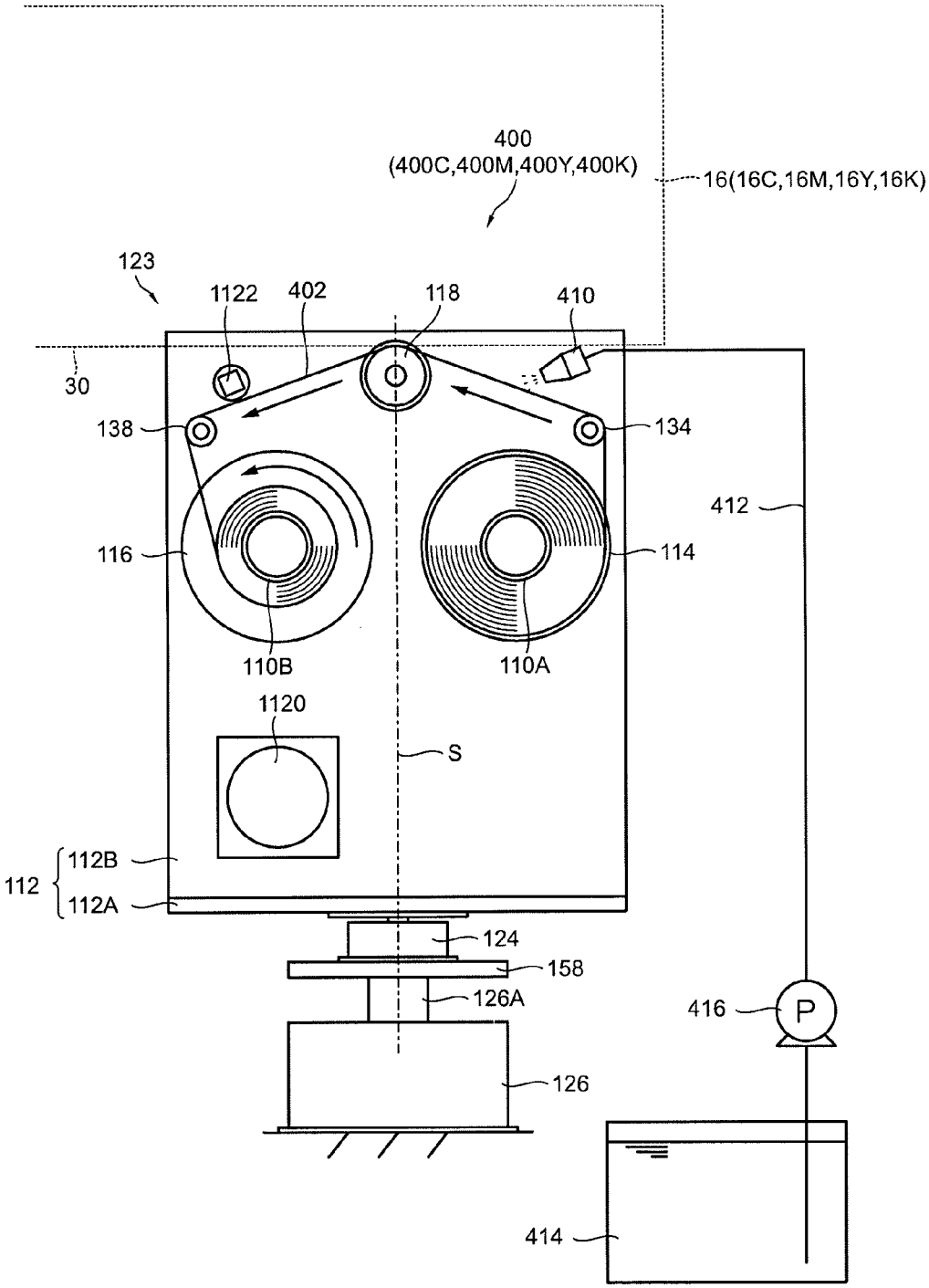
FIG. 26 is a front view diagram of a fourth embodiment of the head cleaner according to the second mode.

FIG. 26 is a front view diagram of a fourth embodiment of a head cleaner according to the second mode.

The head cleaner 400 (400C, 400M, 400Y and 400K) according to the present embodiment also wipes and cleans the nozzle surface of the head in two separate actions, by switching the liquid absorption capability of the wiping web.

The head cleaner 400 according to the present embodiment switches the liquid absorption capability of the wiping web by depositing liquid onto the wiping web. For this purpose, as shown in FIG. 26, the head cleaner 400 according to the present embodiment comprises a liquid deposition nozzle 410 for depositing cleaning liquid onto the wiping web 402. Apart from the fact that this liquid deposition nozzle 410 is provided, this head cleaner is the same as the head cleaner 100 according to the first embodiment of the second mode which is described above. Consequently, only the liquid deposition nozzle 410 is described here.

As shown in FIG. 26, the liquid deposition nozzle 410 is disposed between the pay-out guide roller 134 and the pressing roller 118. The liquid deposition nozzle 410 has a spray port corresponding to the width of the wiping web 402, and wets the wiping web 402 by spraying liquid onto the wiping web 402 as the web travels between the pay-out guide roller 134 and the pressing roller 118.

The liquid is supplied from a liquid tank 414 via a liquid supply pipe 412 which is connected to the liquid deposition nozzle 410, and by driving a liquid spray pump 416 which is provided at an intermediate point of the liquid supply pipe 412, the liquid is sprayed from the liquid deposition nozzle 410.

The object of the liquid is to reduce the liquid absorption capability of the wiping web 402, and the type of liquid is therefore not limited in particular, provided that the liquid satisfies this object. Consequently, it is also possible to deposit a cleaning liquid, for example.

Furthermore, the wiping web 402 used does not necessarily have to be one which switches liquid absorption capability depending on the direction of sliding, as in the wiping web 110 according to the first embodiment of the second mode which is described above.

Head Cleaning Method

Next, a cleaning method for a head using the head cleaner according to the present embodiment will be described.

The fact of switching the liquid absorption capability of the wiping web and wiping the nozzle surfaces 30C, 30M, 30Y and 30K of the heads 16C, 16M, 16Y and 16K in two separate actions is the same as the first embodiment of the second mode which is described previously. In the present embodiment, the first action (first cleaning step) involves wiping with a wiping web in a normal state (a wiping web having high liquid absorption capability which does not produce wiping traces when the nozzle surface of the head is wiped) and the second action (second cleaning step) involves wiping with a wiping web in a state of reduced liquid absorption capability by previously depositing liquid (a wiping web in a state of reduced liquid absorption capability to a level which avoids drawing out of ink from the nozzles even when the nozzle surface of the head is wiped). More specifically, the wiping procedure is as follows.

Firstly, the non-wet region of the wiping web is located in position. When the respective non-wet regions have been located in position, the heads 16C, 16M, 16Y and 16K are moved towards the maintenance position. As the heads 16C, 16M, 16Y and 16K are moved toward the maintenance position, they are halted temporarily when the end portion on one side thereof (the end portion on the maintenance position side) arrives at the installation position of the pressing roller 118. In this case, the pressing rollers 118 of the cleaners 100C, 100M, 100Y and 100K are situated in a prescribed withdrawn position.

When the heads 16C, 16M, 16Y and 16K are halted, the elevator cylinders 126 are driven and the pressing rollers 118 are moved to a pressing position. As a result of this, the wiping webs 402 wrapped about the pressing rollers 118 are pressed and abutted against the nozzle surfaces 30C, 30M, 30Y and 30K of the heads 16C, 16M, 16Y and 16K.

Thereupon, the take-up motors 1120 are driven, the wiping webs 402 are taken up onto the take-up reels 116 at a uniform speed, and the head feed motor 60 is driven and the heads 16C, 16M, 16Y and 16K are conveyed at a uniform speed toward the maintenance position. The wiping webs 402 are slid in contact with the nozzle surfaces 30C, 30M, 30Y and 30K of the heads 16C, 16M, 16Y and 16K, and the nozzle surfaces 30C, 30M, 30Y and 30K are wiped and cleaned by the traveling wiping webs 402.

The heads 16C, 16M, 16Y and 16K which have been conveyed to the maintenance position are halted when the end portion on the other side (the end portion on the side of the image formation position) arrives at the installation position of the pressing rollers 118. The travel of the wiping webs 402 is also halted in synchronism with the halting of the conveyance of the heads 16C, 16M, 16Y and 16K. By this means, the first wiping and cleaning action is completed.

When the first wiping and cleaning action has been completed, the pressing rollers 118 are withdrawn temporarily to the withdrawn position. Furthermore, the heads 16C, 16M, 16Y and 16K are returned in such a manner that the end portion on one side thereof is disposed at the installation position of the pressing roller 118.

When the end portion on one side of each of the heads 16C, 16M, 16Y and 16K is situated at the installation position of the pressing roller 118, then the pressing rollers 118 are moved to a pressing position and the wiping webs 402 which are wrapped about the pressing rollers 118 are pressed and abutted against the nozzle surfaces 30C, 30M, 30Y and 30K of the heads 16C, 16M, 16Y and 16K.

Thereupon, the take-up motors 1120 are driven, the wiping webs 402 are taken up onto the take-up reels 116 at a uniform speed, and the head feed motor 60 is driven to convey the heads 16C, 16M, 16Y and 16K at a uniform speed toward the maintenance position. Furthermore, simultaneously with this, the respective liquid spray pumps 416 are driven and liquid is sprayed toward the wiping webs 402 from the liquid deposition nozzles 410. By this means, liquid is deposited on the wiping webs 402 before they are wrapped about the respective pressing rollers 118, thereby forcibly reducing the liquid absorption capability of the wiping webs 402 before wrapping about the pressing rollers 118. Thereupon, by wrapping the wiping webs 402 about the take-up reels 116 while spraying liquid toward the wiping webs 402 from liquid deposition nozzles 410 in this way, the wetted wiping webs 402 onto which liquid has previously been deposited are slid over the nozzle surfaces 30C, 30M, 30Y and 30K of the heads 16C, 16M, 16Y and 16K and the nozzle surfaces 30C, 30M, 30Y and 30K are thereby wiped and cleaned by the wetted wiping webs 110.

In this way, the second wiping and cleaning action is carried out using wiping webs 402 which have been wetted by depositing liquid thereon, in other words, wiping webs 402 of which the liquid absorption capability has been forcibly reduced. By using wetted wiping webs 402 to perform the second wiping and cleaning action in this way, it is possible effectively to remove any wiping traces which may have occurred during the first wiping and cleaning action. Furthermore, by using wetted wiping webs 402 to perform the second wiping and cleaning action in this way, it is possible to prevent ink from being drawn out from the nozzle holes by the wiping action.

In each of the respective head cleaners 400C, 400M, 400Y and 400K, the travel of the wiping web 402 is halted when the other side end portion of the head 16C, 16M, 16Y and 16K passes the pressing roller 118. Furthermore, the driving of the liquid spray pump 416 is also halted simultaneously with this.

The heads 16C, 16M, 16Y and 16K, on the other hand, are moved directly towards the maintenance position.

In the head cleaners 400C, 400M, 400Y and 400K, after halting the travel of the wiping webs 402, the pressing rollers 118 are withdrawn to the withdrawn position, thereby ending the cleaning operation.

After this, the head cleaners 400C, 400M, 400Y and 400K carry out location of an unused region for the next cleaning process, according to requirements.

As described above, in the present embodiment, after first wiping and cleaning the nozzle surfaces 30C, 30M, 30Y and 30K with wiping webs 402 in a state of high liquid absorption capability, the nozzle surfaces 30C, 30M, 30Y and 30K are wiped and cleaned with wiping webs 402 in a state of low liquid absorption capability. By this means, it is possible to clean the nozzle surfaces 30C, 30M, 30Y and 30K without the occurrence of wiping traces or wiping omissions. Furthermore, by switching the absorption capability through wetting the wiping webs 402 in this way, it is possible to increase the range of choice of the wiping web that can be used.

In the present embodiment, the wiping web 402 is wetted by depositing liquid onto the wiping web 402 from a liquid deposition nozzle 410 provided in the main body frame 112, but the method of wetting the wiping web 402 is not limited in particular to this method. For example, it is also possible to wet the wiping web 402 by causing the wiping web 402 to absorb cleaning liquid which has been deposited onto the nozzle surface 30 of the head 16 (and in particular, cleaning liquid deposited onto the portions where nozzles are not formed). In this case, the wiping web 402 is used by winding the web back by a prescribed amount.

Furthermore, in the present embodiment, the nozzle surfaces of the heads are wiped in two separate actions, but it is also possible to perform a plurality of separate wiping actions, by changing the liquid absorption capability of the wiping webs in a stepwise fashion.

In this case as well, it is also possible to carry out wiping a plurality of times at each of the respective levels. In other words, in the present embodiment, the nozzle surfaces of the heads should be wiped and cleaned at least once with a wiping web in a state of high liquid absorption capability, and the nozzle surfaces of the heads should be wiped and cleaned finally with a wiping web in a state of low liquid absorption capability.

Fifth Embodiment of Head Cleaner of Second Mode

Figure 27:
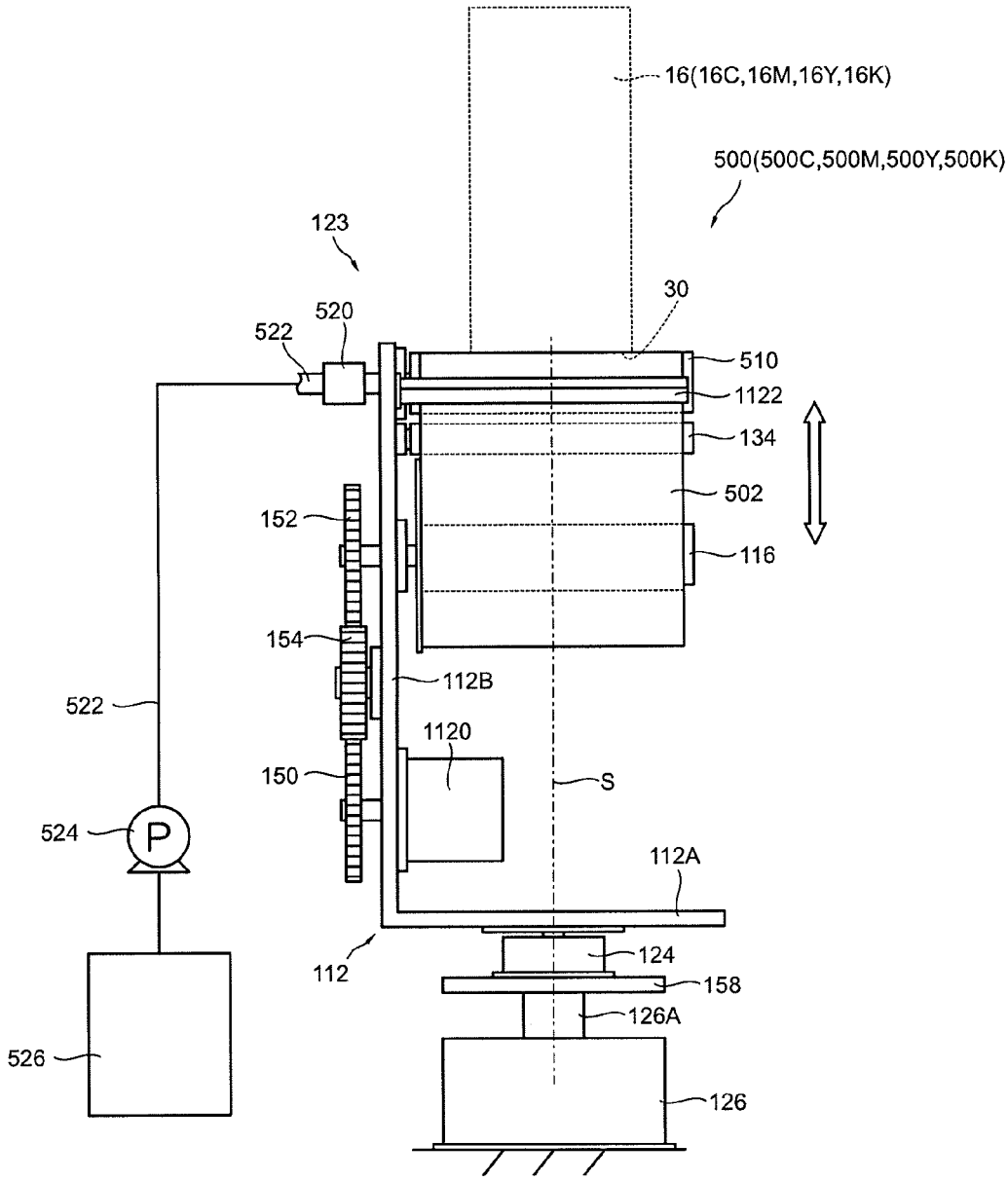
FIG. 27 is a side view diagram of a fifth embodiment of the head cleaner according to the second mode.

FIG. 27 is a side view diagram of a fifth embodiment of a head cleaner according to the second mode.

The head cleaner 500 according to the present embodiment comprises a suctioning mechanism in a pressing roller 510 and is composed in such a manner that a wiping web wrapped about the pressing roller 510 can be suctioned.

The head cleaner 500 according to the present embodiment changes the liquid absorption capability of the wiping web by switching the suctioning force applied to the wiping web by the pressing roller 510.

Apart from the fact that the suctioning mechanism is provided in the pressing roller, this head cleaner is the same as the head cleaner 100 according to the first embodiment of the second mode which is described above. Consequently, only the suctioning mechanism of the pressing roller 510 is described here.

Figure 28:
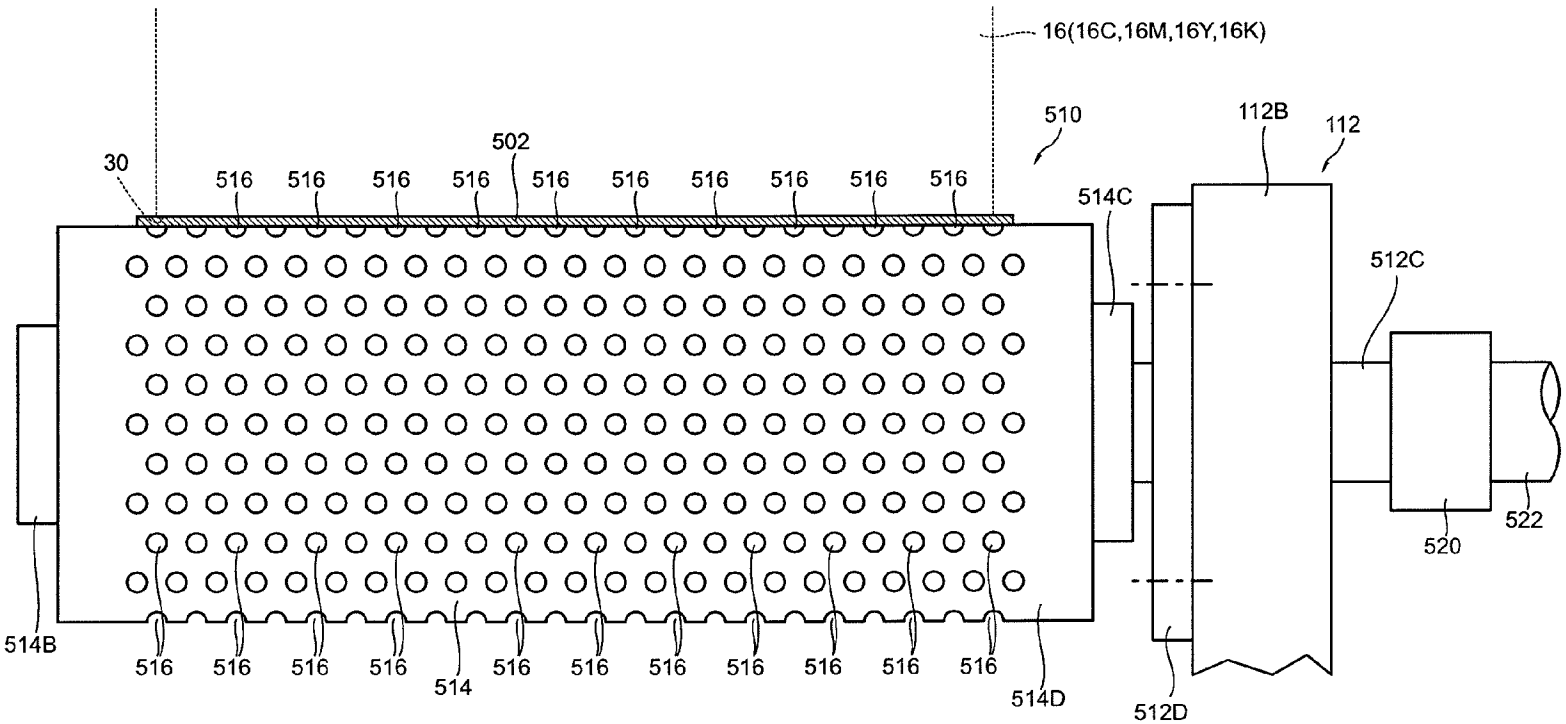
FIG. 28 is a front view diagram of a pressing roller included in the head cleaner according to the fifth embodiment of the second mode.
Figure 29:
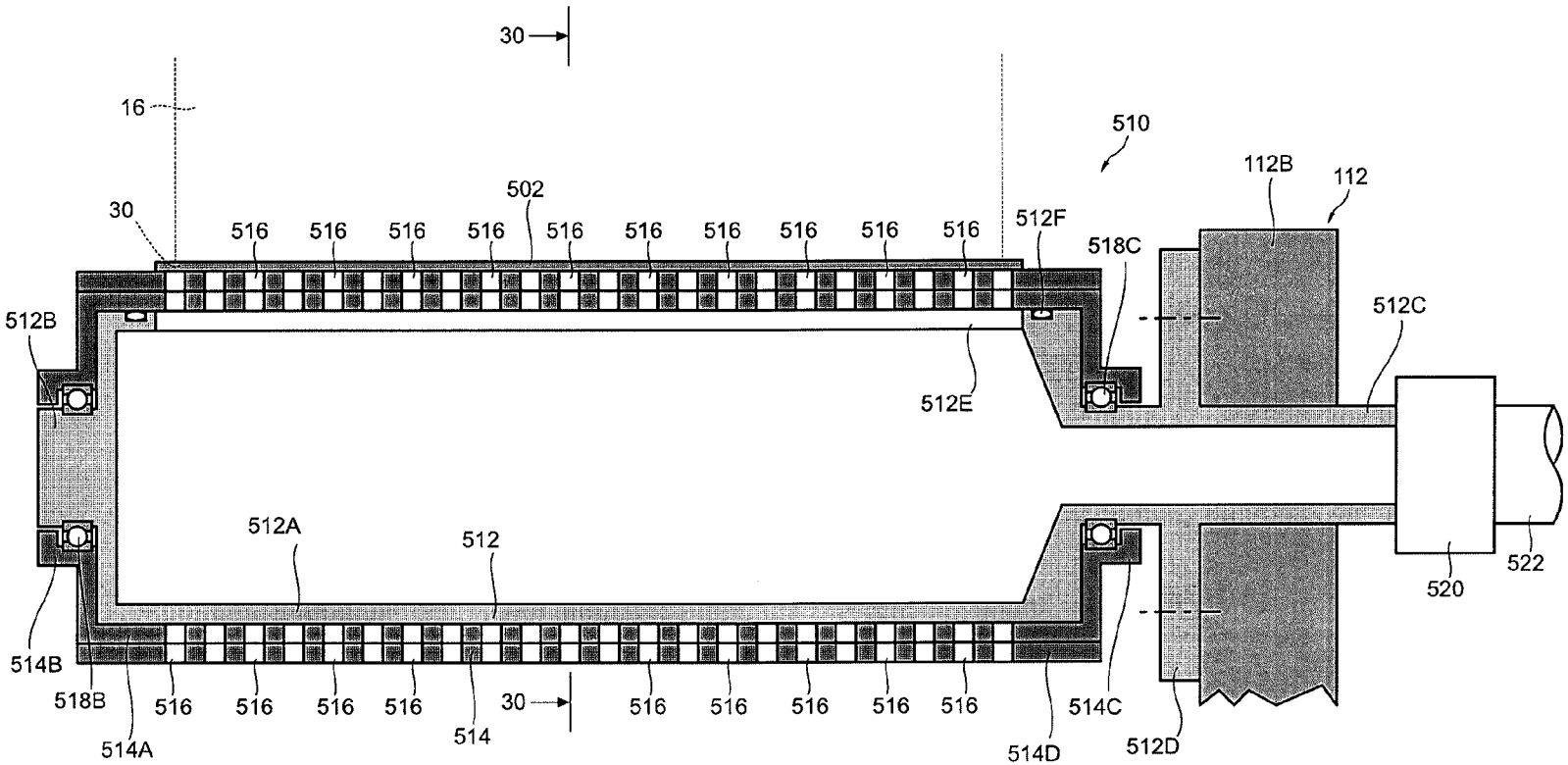
FIG. 29 is a cross-sectional diagram of a pressing roller included in the head cleaner according to the fifth embodiment of the second mode.
Figure 30:
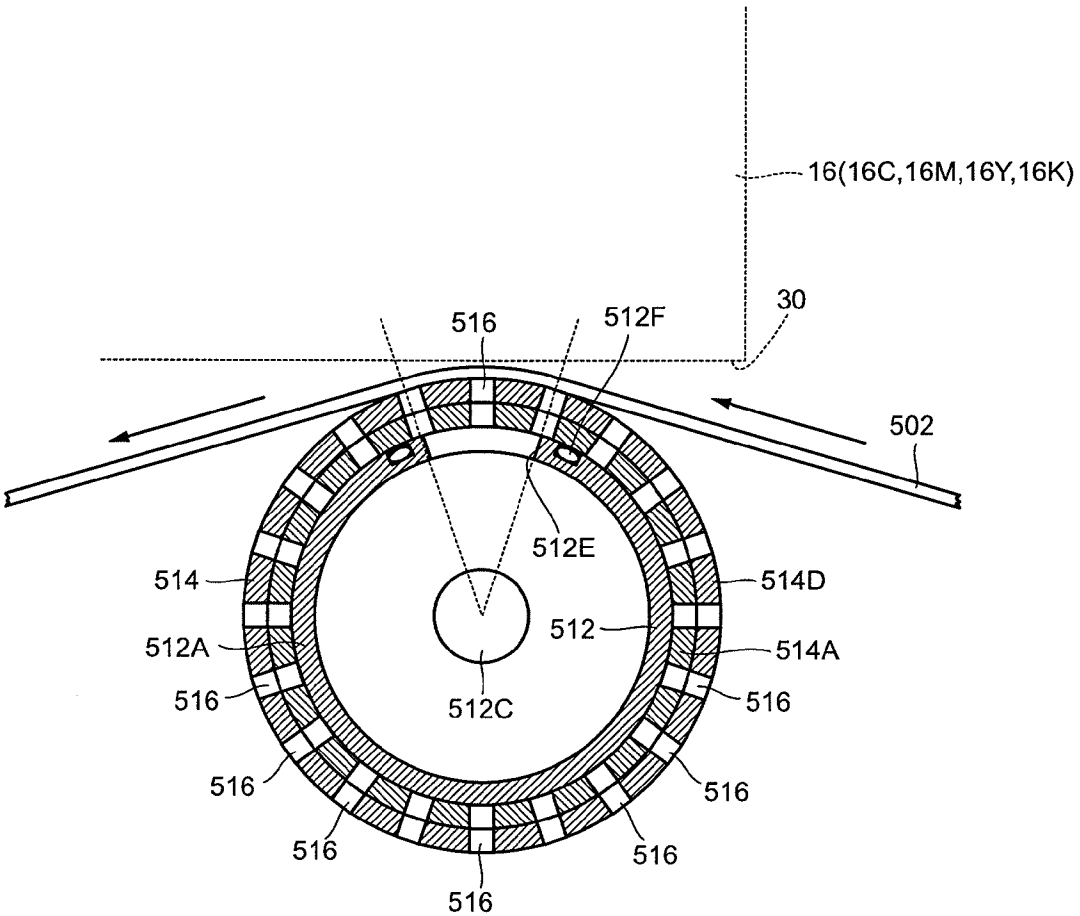
FIG. 30 is a cross-sectional view along 30-30 in FIG. 29.

FIG. 28 is a front view diagram of a pressing roller 510 and FIG. 29 is a cross-sectional diagram of same. Furthermore, FIG. 30 is a cross-sectional diagram along 30-30 in FIG. 29.

As shown in FIG. 28 and FIG. 29, the pressing roller 510 has a double-tube structure comprising an inner tube 512 and an outer tube 514, and a plurality of suction holes 516 are formed in the circumferential surfaces thereof.

The inner tube 512 is made of stainless steel, or the like, and is constituted by a trunk section 512A formed in a round cylindrical shape, axle sections 512B and 512C formed to project at either end of the trunk section 512A, and a flange section 512D which is formed on the axle section 512C on the base end side.

The trunk section 512A is formed to have a prescribed outer diameter, and an opening section 512E is formed through a prescribed angular range in the top portion thereof. This opening section 512E is formed so as to correspond to the wrapping angle of the wiping web 502 when the web is wrapped about the outer circumference of the pressing roller 510, and a packing member 513F is installed about the perimeter thereof.

The axle section 512B on the front end side is formed in a round bar shape and is formed so as to project by a prescribed amount from the center of the end face on the front end side of the trunk section 512A.

The axle section 512C on the base end side is formed in a round tube shape and is formed so as to project by a prescribed amount from the center of the end face on the base end side of the trunk section 512A. The inner circumference of this axle section 512C connects with the inner circumference of the trunk section 512A.

The flange section 512D is provided at an intermediate point of the axle section 512C on the base end side, and is formed integrally with the axle section 512C so as to be perpendicular with respect to the axle section 512C. The inner tube 512 is installed on a wall surface section 112B of the main body frame 112 by means of the axle section 512C on the base end side thereof being inserted into a pressing roller installation hole 112*b* formed on the wall surface section 112B of the main body frame 112, as well as the flange section 512D thereof being fixed by screws (not illustrated) to the wall surface section 112B of the main body frame 112. The inner tube 512 which is installed in this way, is attached perpendicularly with respect to the wall surface section 112B of the main body frame 112.

The outer tube 514 is made of stainless steel, or the like, and is constituted by a trunk section 514A formed in a round cylindrical shape, axle sections 514B and 514C formed to project at either end of the trunk section 514A, and an elastic coating 514D which is coated over the outer circumference of the trunk section 514A.

The trunk section 514A is formed in a round cylindrical shape, and the inner diameter thereof is formed to substantially the same diameter as the outer diameter of the trunk section 512A of the inner tube 512. The trunk section 514A of the outer tube 514 is fitted onto the outer circumference of the trunk section 512A of the inner tube 512, and is provided slidably in the circumferential direction about the periphery of the trunk section 512A.

The axle sections 514B and 514C on either side are formed in a round tube shape and are formed so as to project by a prescribed amount from the center of the end face on either side of the trunk section 514A. The axle sections 514B and 514C are supported rotatably on the outer circumferences of the axle sections 512B and 512C of the inner tube 512 via bearings 518B and 518C. The outer tube 514 is supported rotatably on the outer circumference of the inner tube 512 via these bearings 518B and 518C.

The elastic coating 514D is constituted by an elastic body, such as polyurethane, olefin, or the like, and is formed to a prescribed thickness on the outer circumference of the trunk section 514A. The wiping web 502 is pressed and abutted against the nozzle surface 30 of the head 16 via this elastic coating 514D. By this means, it is possible to press and abut the wiping web 502 against the nozzle surface 30 of the head 16 in a suitable fashion.

A plurality of the suction holes 516 are formed in a prescribed arrangement pattern (in the present example, a staggered matrix pattern) on the outer circumference of the outer tube 514, with a prescribed diameter (for example, a diameter of 1 mm approximately). These suction holes 516 are formed so as to pass through to the interior of the outer tube 514.

As described above, the outer tube 514 is provided slidably in the circumferential direction about the outer circumferential part of the inner tube 512. On the other hand, an opening section 512E is formed only in the top section of the inner tube 512. Consequently, the suction holes 516 which are formed in the outer tube 514 are connected to the interior of the inner tube 512 only when positioned above the opening section 512E formed in the inner tube 512.

A wiping web 502 is wrapped with a prescribed wrapping angle about the outer circumference of the outer tube 514 of the pressing roller 510 having the composition described above. The wiping web 502 wrapped about the outer circumference of the outer tube 514 is suctioned onto the pressing roller 510 by suctioning air from the interior of the inner tube 512 and thereby setting the interior of the inner tube 512 to a negative pressure. Due to being suctioned onto the pressing roller 510, the wiping web 502 has an increased liquid absorption capability in the portion which is wrapped about the pressing roller 510 (in other words, the portion which is abutted against the nozzle surface of the head). Furthermore, it is possible to adjust the liquid absorption capability in the portion which is wrapped about the pressing roller 510 by adjusting the suctioning force imparted by the pressing roller 510.

The air inside the inner tube 512 is suctioned via the axle section 512C on the base end side of the inner tube 512. The axle section 512C on the base end side of the inner tube 512 is provided so as to pass through the wall surface section 112B of the main body frame 112 and a suction pipe 522 is connected to the front end thereof via a joint 520.

As shown in FIG. 27, the suction pipe 522 is connected to a recovery tank 526 via a suction pipe 524. The air inside the inner tube 512 is suctioned, thereby creating a negative pressure inside the tube, by driving the suction pump 524.

The system controller controls the absorption capability of the wiping web 502 on the basis of the pressing roller 510, by controlling the driving of the suction pump 524.

Head Cleaning Method

Next, a cleaning method for a head using the head cleaner 500 according to the present embodiment will be described.

In the present embodiment, the wiping of the nozzle surface of the head is divided into two separate actions. In the present embodiment, a first action (first cleaning step) involves wiping with a wiping web 502 in a state of high liquid absorption capability due to the wiping web 502 being suctioned (a wiping web in a state of high liquid absorption capability which does not produce wiping omissions when the nozzle surface is wiped), and a second action (second cleaning step) involves wiping with a wiping web 502 in a state of low liquid absorption capability by weakening the suctioning force of the wiping web 502 or not suctioning the wiping web 502 (a wiping web in a state of low liquid absorption capability of a level which does not draw ink out from the nozzles when the nozzle surface is wiped). More specifically, the wiping procedure is as follows.

Firstly, cleaning liquid is applied to the nozzle surfaces 30C, 30M, 30Y and 30K of the heads 16C, 16M, 16Y and 16K in order to dissolve the adhering material created by the ink which is adhering to the nozzle surfaces 30C, 30M, 30Y and 30K.

The cleaning liquid is applied by moving the heads 16C, 16M, 16Y and 16K from the image formation position towards the maintenance position (or from the maintenance position towards the image formation position), as well as spraying cleaning liquid from the cleaning liquid application nozzles 80C, 80M, 80Y and 80K toward the nozzle surfaces 30C, 30M, 30Y and 30K of the heads 16C, 16M, 16Y and 16K.

When the application of cleaning liquid has been completed, a first wiping and cleaning action is carried out. As described above, this first wiping action is carried out using a wiping web in a state of high absorption capability. More specifically, the first wiping action is carried out using a wiping web 502 in a state of high suctioning force by suctioning via the pressing roller 510. More specifically, the procedure is as follows.

Firstly, an unused region of the wiping web is located in position. More specifically, the wiping web 502 is located in position in such a manner that an unused region of the wiping web 502 is wrapped about the pressing roller 510. This step is carried out on the basis of the output from the used region determination sensor 1122 and is performed by winding the wiping web 502 onto the take-up reel 116 until the wet region ceases to be determined by the used region determination sensor 1122.

When the positional location of the unused region has been completed, the heads 16C, 16M, 16Y and 16K are conveyed toward the maintenance position, and the traveling wiping webs 502 are pressed against the nozzle surfaces 30C, 30M, 30Y and 30K of the heads 16C, 16M, 16Y and 16K which have been sent to the maintenance position, thereby wiping and cleaning the nozzle surfaces 30C, 30M, 30Y and 30K of the heads 16C, 16M, 16Y and 16K. More specifically, the procedure is as follows.

Firstly, the heads 16C, 16M, 16Y and 16K are moved towards the maintenance position. As the heads 16C, 16M, 16Y and 16K are moved toward the maintenance position, they are halted temporarily when the end portion on one side thereof (the end portion on the maintenance position side) arrives at the installation position of the pressing roller 510. In this case, the pressing rollers 510 of the cleaners 500C, 500M, 500Y and 500K are situated in a prescribed withdrawn position.

When the heads 16C, 16M, 16Y and 16K are halted, the elevator cylinders 126 are driven and the pressing rollers 510 are moved to a pressing position. By this means, the wiping webs 502 wrapped about the respective pressing rollers 510 are pressed and abutted against the nozzle surfaces 30C, 30M, 30Y and 30K of the heads 16C, 16M, 16Y and 16K.

When the respective wiping webs 502 wrapped about the pressing rollers 510 are pressed and abutted against the nozzle surfaces 30C, 30M, 30Y and 30K of the heads 16C, 16M, 16Y and 16K, the suction pumps 524 are driven and the air inside the pressing rollers 510 is suctioned by a prescribed suctioning force. As a result of this, the interior of each pressing roller 510 is set to a negative pressure, and the wiping webs 502 wrapped about the pressing rollers 510 (the wiping webs which are pressed and abutted against the nozzle surfaces 30C, 30M, 30Y and 30K of the heads 16C, 16M, 16Y and 16K) are suctioned with a prescribed suctioning force.

Thereupon, the take-up motors 1120 are driven, the wiping webs 502 are taken up onto the take-up reels 116 at a uniform speed, and the head feed motor 60 is driven to convey the heads 16C, 16M, 16Y and 16K at a uniform speed toward the maintenance position. As a result of this, the wiping webs 502 are slid over the nozzle surfaces 30C, 30M, 30Y and 30K of the heads 16C, 16M, 16Y and 16K, and the nozzle surfaces 30C, 30M, 30Y and 30K are wiped and cleaned by the traveling wiping webs 502.

In this case, the wiping webs 502 travel in the opposite direction to the direction of movement of the heads 16C, 16M, 16Y and 16K. Accordingly, it is possible to increase the relative differential velocity, and the cleaning effect can be improved.

The heads 16C, 16M, 16Y and 16K which have been conveyed to the maintenance position are halted when the end portion on the other side (the end portion on the side of the image formation position) arrives at the installation position of the pressing roller 510. The travel of the wiping webs 502 and the suctioning of air are also halted in synchronism with the halting of the conveyance of the heads 16C, 16M, 16Y and 16K.

By means of the above, the first wiping and cleaning action is completed. As described above, the first wiping and cleaning action is carried out while suctioning the wiping webs 502 and therefore it is possible to wipe the nozzle surfaces 30C, 30M, 30Y and 30K with wiping webs 502 in a state of high liquid absorption capability. By this means, it is possible to wipe and clean the nozzle surfaces 30C, 30M, 30Y and 30K without the occurrence of wiping omissions.

When the first wiping and cleaning action has been completed, the elevator cylinders 126 are driven and the pressing rollers 510 are moved to a withdrawn position. Furthermore, the heads 16C, 16M, 16Y and 16K are returned toward the image formation position. The heads 16C, 16M, 16Y and 16K which have been returned toward the image formation position are halted when the end portion on the one side is situated at the installation position of the pressing roller 510. Thereupon, a second wiping and cleaning action is carried out.

Firstly, the elevator cylinders 126 are driven and the pressing rollers 510 are moved to a pressing position. By this means, the wiping webs 502 wrapped about the respective pressing rollers 510 are pressed and abutted against the nozzle surfaces 30C, 30M, 30Y and 30K of the heads 16C, 16M, 16Y and 16K.

When the respective wiping webs 502 wrapped about the pressing rollers 510 have been pressed and abutted against the nozzle surfaces 30C, 30M, 30Y and 30K of the heads 16C, 16M, 16Y and 16K, the take-up motors 1120 are driven and the wiping webs 502 are wound up onto the take-up reels 116 at a uniform speed. Accordingly, the wiping webs 502 wrapped about the pressing rollers 510 (namely, the wiping webs which are pressed and abutted against the nozzle surfaces 30C, 30M, 30Y and 30K of the heads 16C, 16M, 16Y and 16K) travel toward the take-up reels 116.

Furthermore, simultaneously with the driving of the take-up motors 1120, the head feed motor 60 is driven and the heads 16C, 16M, 16Y and 16K are conveyed toward the maintenance position at a uniform speed. As a result of this, the wiping webs 502 are slid over the nozzle surfaces 30C, 30M, 30Y and 30K of the heads 16C, 16M, 16Y and 16K, and the nozzle surfaces 30C, 30M, 30Y and 30K are wiped and cleaned by the traveling wiping webs 502.

Furthermore, in contrast to the first wiping and cleaning action, in this second wiping and cleaning action, the wiping webs 502 are slid over the nozzle surfaces 30C, 30M, 30Y and 30K of the heads 16C, 16M, 16Y and 16K without suctioning the webs. By this means, it is possible to wipe the nozzle surfaces 30C, 30M, 30Y and 30K of the heads 16C, 16M, 16Y and 16K by using wiping webs 502 having a low liquid absorption capability.

The heads 16C, 16M, 16Y and 16K which have been conveyed to the maintenance position are halted when the end portion on the other side arrives at the installation position of the pressing rollers 510. The travel of the wiping webs 502 is halted in synchronism with the halting of the conveyance of the heads 16C, 16M, 16Y and 16K.

By means of the above, the second wiping and cleaning action is completed. As described above, the second wiping and cleaning action is carried out without suctioning the wiping webs 502 and therefore it is possible to wipe the nozzle surfaces 30C, 30M, 30Y and 30K with wiping webs 502 in a state of low liquid absorption capability. By this means, it is possible to wipe and clean the nozzle surfaces 30C, 30M, 30Y and 30K of the heads 16C, 16M, 16Y and 16K without drawing out ink from the nozzles (without the occurrence of wiping traces). Furthermore, if wiping traces have occurred in the first wiping and cleaning action, it is possible to wipe away these traces effectively.

When the second wiping and cleaning action has been completed, the heads 16C, 16M, 16Y and 16K are conveyed directly toward the maintenance position.

On the other hand, in the head cleaners 500C, 500M, 500Y and 500K, the elevator cylinders 126 are driven and the pressing rollers 510 are disposed in the withdrawn position. After this, the head cleaners 500C, 500M, 500Y and 500K carry out location of an unused region for the next cleaning process, according to requirements.

By means of the steps described above, the cleaning of the nozzle surfaces 30C, 30M, 30Y and 30K of the heads 16C, 16M, 16Y and 16K is completed.

As described previously, in the present embodiment, the liquid absorption capability of the wiping webs 502 which wipe and clean the nozzle surfaces 30C, 30M, 30Y and 30K of the heads 16C, 16M, 16Y and 16K is switched and the nozzle surfaces 30C, 30M, 30Y and 30K of the heads 16C, 16M, 16Y and 16K are wiped and cleaned in two separate actions. More specifically, in a first action, the nozzle surfaces 30C, 30M, 30Y and 30K of the heads 16C, 16M, 16Y and 16K are wiped and cleaned with wiping webs 502 in a state of high absorption capability by suctioning the wiping webs 502, and in a second action, the nozzle surfaces 30C, 30M, 30Y and 30K of the heads 16C, 16M, 16Y and 16K are wiped and cleaned with wiping webs 502 in a state of low absorption capability by not suctioning the wiping webs 502. By this means, it is possible to clean the nozzle surfaces 30C, 30M, 30Y and 30K without the occurrence of wiping traces or wiping omissions.

Furthermore, by switching the suctioning force of the wiping webs 502 by suctioning in this way, it is possible to increase the range of selection of the wiping web which can be used.

Moreover, in the present embodiment, the nozzle surfaces are wiped in two separate actions, but it is also possible to perform a plurality of wiping actions by switching the liquid absorption capability of the wiping web in a stepwise fashion. In this case, the suctioning force of the wiping web 502 by the pressing roller 520 is switched in a stepwise fashion, whereby the liquid absorption capability of the wiping web is switched in a stepwise fashion.

In this case as well, it is also possible to carry out wiping a plurality of times at each of the respective levels. In other words, in the present embodiment, the nozzle surfaces of the head should be wiped and cleaned at least once with a wiping web having a high liquid absorption capability, and the nozzle surfaces of the heads should be wiped and cleaned finally with a wiping web having a low liquid absorption capability.

Furthermore, in the present embodiment, the liquid absorption capability is adjusted by controlling the suctioning force from the pressing holes, and therefore it is desirable that the absorption capacity of the wiping web itself should be low (this is because if the absorption capacity is high, then wiping traces will occur in the second wiping action).

Other Embodiments of Second Mode

Furthermore, the head cleaners according to the present embodiment respectively comprise a used region determination sensor 1122, but this used region determination sensor 1122 does not necessarily have to be provided, and it is also possible to locate the wiping web in a desired position by controlling the amount of winding out and winding back of the wiping web. By providing used region determination sensors 1122, it is possible to achieve accurate positional location, as well as being able to determine the presence or absence of the wiping webs.

Moreover, in the present example, in order to dissolve the adhering material caused by the ink, cleaning liquid is applied previously to the nozzle surfaces 30C, 30M, 30Y and 30K in order to wet the nozzle surfaces 30C, 30M, 30Y and 30K, but there are no particular restrictions on the method of wetting the nozzle surfaces 30C, 30M, 30Y and 30K. For example, it is also possible to use ink as a wetting liquid. In this case, ink is caused to seep out from the nozzles formed on the nozzle surfaces 30C, 30M, 30Y and 30K, so as to wet the nozzle surfaces 30C, 30M, 30Y and 30K. Furthermore, in this case, the nozzle surfaces 30C, 30M, 30Y and 30K are sealed with a cap, the internal pressure of the cap is reduced, and the ink is suctioned onto the nozzle surfaces 30C, 30M, 30Y and 30K and thus caused to seep out from the nozzles. Alternatively, the ink is caused to seep out onto the nozzle surfaces by applying pressure to the flow channels from the ink tanks to the heads.

Furthermore, in the series of embodiments described above, a case where the nozzle surface of a line head is wiped and cleaned is described, but the application of the present invention is not limited to this. The invention can also be applied similarly to a case of wiping and cleaning the nozzle surface of a so-called shuttle scanning type of head.

In the series of embodiments described above, the heads are moved so as to wipe and clean the nozzle surfaces of the heads, but it is also possible to wipe and clean the nozzle surfaces of the heads by moving the head cleaning apparatus.

Third Mode

Next, desirable embodiments of a third mode of the present invention will be described. Explanation for elements that are the same as or similar to those in the first mode and the second mode described above is omitted in the third mode.

As shown in FIG. 12, nozzle rows 32 are formed in the lengthwise direction of the head 16 in the nozzle surface 30 (30C, 30M, 30Y and 30K) of the head 16 (16C, 16M, 16Y and 16K).

Each of the heads 16 which are installed on a head supporting frame 40 is disposed with the nozzle rows 32 which are formed in the nozzle surface 30 arranged perpendicularly with respect to the direction of conveyance of the paper 12. Ink droplets are ejected perpendicularly from the nozzle rows 32 formed in the nozzle surface 30 toward the outer circumferential surface of the image formation drum 14.

In the example of the head 16 shown in FIG. 12, nozzles rows 32 are formed by arranging nozzles 34, 34, . . . in a staggered matrix configuration on the nozzle surface 30. By adopting an arrangement of this kind for the nozzles 34, 34, . . . , it is possible to reduce the effective pitch between the nozzles 34 as projected to the lengthwise direction of the head 16 (namely, a direction perpendicular to the conveyance direction of the paper; in other words, the breadthways direction of the paper), and therefore a high-density configuration of the nozzles 34 can be achieved.

The head supporting frame 40 where the heads 16C, 16M, 16Y and 16K are installed is provided movably in a direction parallel to the rotating shaft 18 of the image formation unit 14 (namely, in the lengthwise direction of the heads 16C, 16M, 16Y and 16K installed thereon) and is composed in such a manner that the heads 16C, 16M, 16Y and 16K can be withdrawn to a prescribed maintenance position. This point is described below.

The image formation unit 10 has the composition described above. In this image formation unit 10, paper 12 is received onto the image formation drum 14 from a previous step via the conveyance drum 26, and is conveyed in rotation while being held by suction on the circumferential surface of the image formation drum 14. The paper 12 passes below the heads 16C, 16M, 16Y and 16K during this conveyance and ink droplets are ejected from the heads 16C, 16M, 16Y and 16K onto the recording surface of the paper as the paper passes, thereby forming a color image on the recording surface. After having completed image recording, the paper 12 is transferred from the image formation drum 14 to the conveyance drum 28 and is conveyed to a subsequent step.

The driving of the heads 16C, 16M, 16Y and 16K (ink ejection) and the driving of the image formation unit 14, and the like, are controlled by a system controller, which is not illustrated. This system controller performs overall control of the operations of the whole inkjet recording apparatus and controls the driving of the respective units in accordance with a prescribed control program.

Movement Mechanism of Head Supporting Frame

As described above, the head supporting frame 40 is provided movably in the direction parallel to the rotating shaft 18 of the image formation drum 14. Below, the movement mechanism of the head supporting frame 40 will be described.

This head supporting frame 40 is supported slidably via sliders 52, 52 on a pair of guide rails 50, 50 which are arranged in parallel with the rotating shaft 18 of the image formation drum 14. The head supporting frame 40 slides in a direction parallel to the rotating shaft 18 of the image formation drum 14 by sliding along the guide rails 50, 50.

Furthermore, a nut section 56 which screws onto a screw bar 54 is coupled to the head supporting frame 40. The screw bar 54 is arranged in parallel with the guide rail 50 and the respective end portions thereof are supported rotatably on bearings 58, 58 which are provided in the main body frame of the inkjet recording apparatus. A head feed motor 60 is coupled to this screw bar 54, which is driven to rotate by the head feed motor 60. The head supporting frame 40 slides along the guide rails 50, 50 by driving the head feed motor 60 and turning the screw bar 54. In other words, the head supporting frame 40 slides in a direction parallel to the axis of rotation of the image formation drum 14.

A system controller, which is not illustrated, causes the heads 16C, 16M, 16Y and 16K to move from a prescribed image formation position to a maintenance position by controlling the driving of the head feed motor 60 and controlling the movement of the head supporting frame 40. Alternatively, the heads are moved from the maintenance position to the image formation position.

When disposed in the image formation position, the heads 16C, 16M, 16Y and 16K are arranged about the periphery of the image formation drum 14, as indicated by the solid lines in FIG. 2, and are able to record an image onto paper 12 conveyed in rotation by the image formation drum 14.

On the other hand, when the heads are disposed in the maintenance position, as indicated by the dotted lines in FIG. 2, then the heads are withdrawn from the periphery of the image formation drum 14. By this means, it is possible to carry out maintenance of both the image formation drum 14 and the heads 16C, 16M, 16Y and 16K.

A moisturizing unit 62 for moisturizing the heads 16C, 16M, 16Y and 16K is provided in this maintenance position. When not used for a long period of time, the nozzle surfaces 30C, 30M, 30Y and 30K of the heads 16C, 16M, 16Y and 16K are kept moist by the moisturizing unit 62, thereby preventing ejection failures due to drying.

A head cleaning apparatus 70 for wiping and cleaning the nozzle surfaces 30C, 30M, 30Y and 30K of the heads 16C, 16M, 16Y and 16K is provided between the image formation position and the maintenance position.

The nozzle surfaces 30C, 30M, 30Y and 30K of the heads 16C, 16M, 16Y and 16K are wiped and cleaned by means of a wiping web (ink absorbing body) being pressed and abutted respectively against the nozzle surfaces 30C, 30M, 30Y and 30K in the process of moving the heads from the image formation position to the maintenance position (or moving the heads from the maintenance position to the image formation position). Below, the composition of the head cleaning apparatus 70 will be described.

Composition of Head Cleaning Apparatus

As shown in FIG. 3, the head cleaning apparatus 70 comprises cleaning liquid application nozzles 80C, 80M, 80Y and 80K and head cleaners 100C, 100M, 100Y and 100K. The cleaning liquid application nozzles 80C, 80M, 80Y and 80K and the head cleaners 100C, 100M, 100Y and 100K are provided so as to correspond to the heads 16C, 16M, 16Y and 16K, and are installed on a supporting frame which is not illustrated. The head cleaning apparatus 70 is disposed at a prescribed installation position set between the image formation position and the maintenance position, by attaching the supporting frames on which the cleaning liquid application nozzles 80C, 80M, 80Y and 80K and the head cleaners 100C, 100M, 100Y and 100K are installed to a main body frame (not illustrated) of the inkjet recording apparatus.

Composition of Cleaning Liquid Application Nozzles

The cleaning liquid application nozzles 80C, 80M, 80Y and 80K are provided so as to oppose the nozzle surfaces 30C, 30M, 30Y and 30K of the corresponding heads 16C, 16M, 16Y and 16K. These cleaning liquid application nozzles 80C, 80M, 80Y and 80K have emission ports corresponding to the width of the nozzle surfaces 30C, 30M, 30Y and 30K and emit cleaning liquid toward the nozzle surfaces 30C, 30M, 30Y and 30K of the corresponding heads 16C, 16M, 16Y and 16K.

Figure 32:
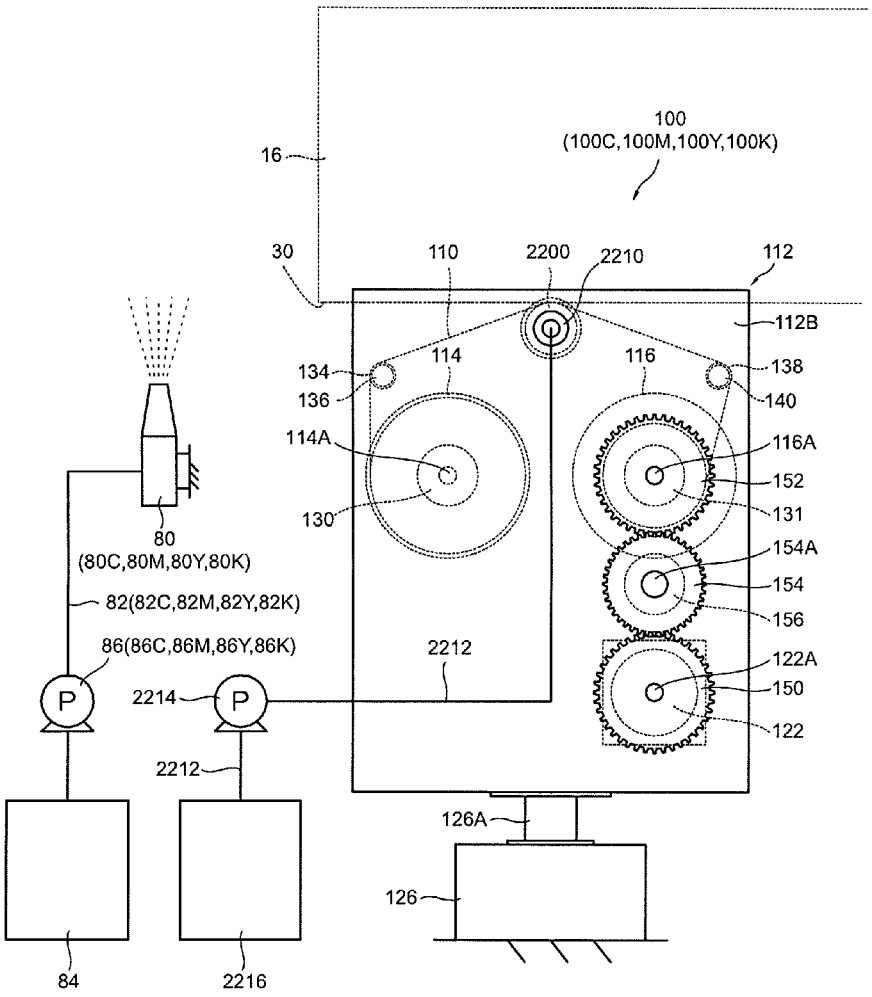
FIG. 32 is a rear view diagram of the head cleaner according to the third mode.

As shown in FIG. 32, the cleaning liquid is supplied from a cleaning liquid tank 84 via a cleaning liquid supply pipe 82 (82C, 82M, 82Y, 82K) and by driving a cleaning liquid spray pump 86 (86C, 86M, 86Y and 86K) provided at an intermediate point of the cleaning liquid supply pipe 82, cleaning liquid is sprayed from the corresponding cleaning liquid application nozzle 80C, 80M, 80Y and 80K.

Cleaning liquid is applied to the nozzle surfaces 30C, 30M, 30Y and 30K by spraying cleaning liquid from the cleaning liquid application nozzles 80C, 80M, 80Y and 80K toward the nozzle surfaces 30C, 30M, 30Y and 30K while the heads 16C, 16M, 16Y and 16K are moved from the image formation position to the maintenance position (or from the maintenance position to the image formation position).

The system controller controls the application of cleaning liquid to the nozzle surfaces 30C, 30M, 30Y and 30K by controlling the driving of the cleaning liquid spraying pump and the head feed motor 60.

Composition of Head Cleaner

The head cleaners 100C, 100M, 100Y and 100K are provided so as to oppose the nozzle surfaces 30C, 30M, 30Y and 30K of the corresponding heads 16C, 16M, 16Y and 16K, and respectively press and abut a wiping web 110 formed in a band shape against the nozzle surface 30C, 30M, 30Y and 30K of the corresponding head 16C, 16M, 16Y and 16K by means of a pressing roller 2200. The nozzle surfaces 30C, 30M, 30Y and 30K of the heads 16C, 16M, 16Y and 16K are wiped and cleaned by means of the respective wiping webs 110 being pressed and abutted against the nozzle surfaces 30C, 30M, 30Y and 30K in the process of moving the heads from the image formation position to the maintenance position (or moving the heads from the maintenance position to the image formation position).

The head cleaners 100C, 100M, 100Y and 100K each have the same composition and therefore the composition of one head cleaner 100 will be described here.

Figure 31:
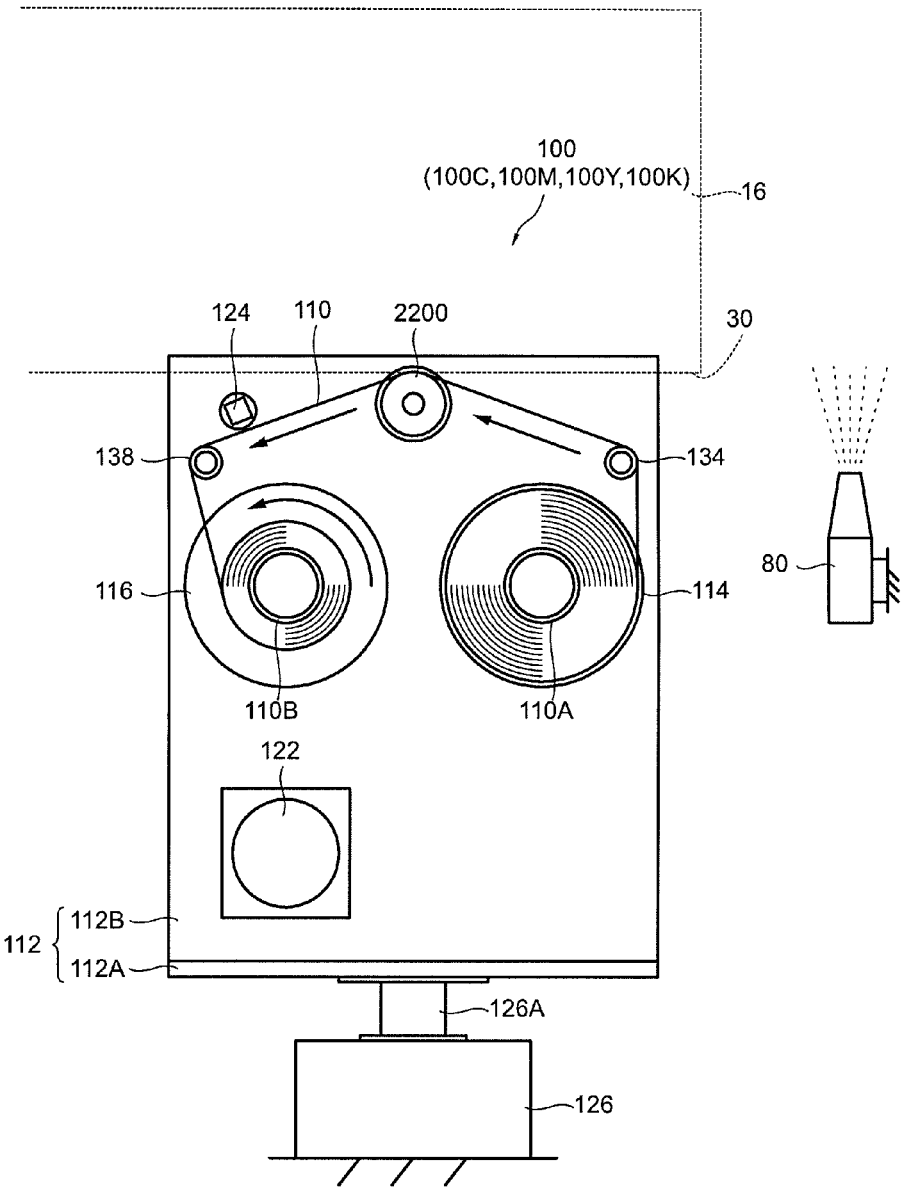
FIG. 31 is a front view diagram of a head cleaner according to the third mode.
Figure 33:
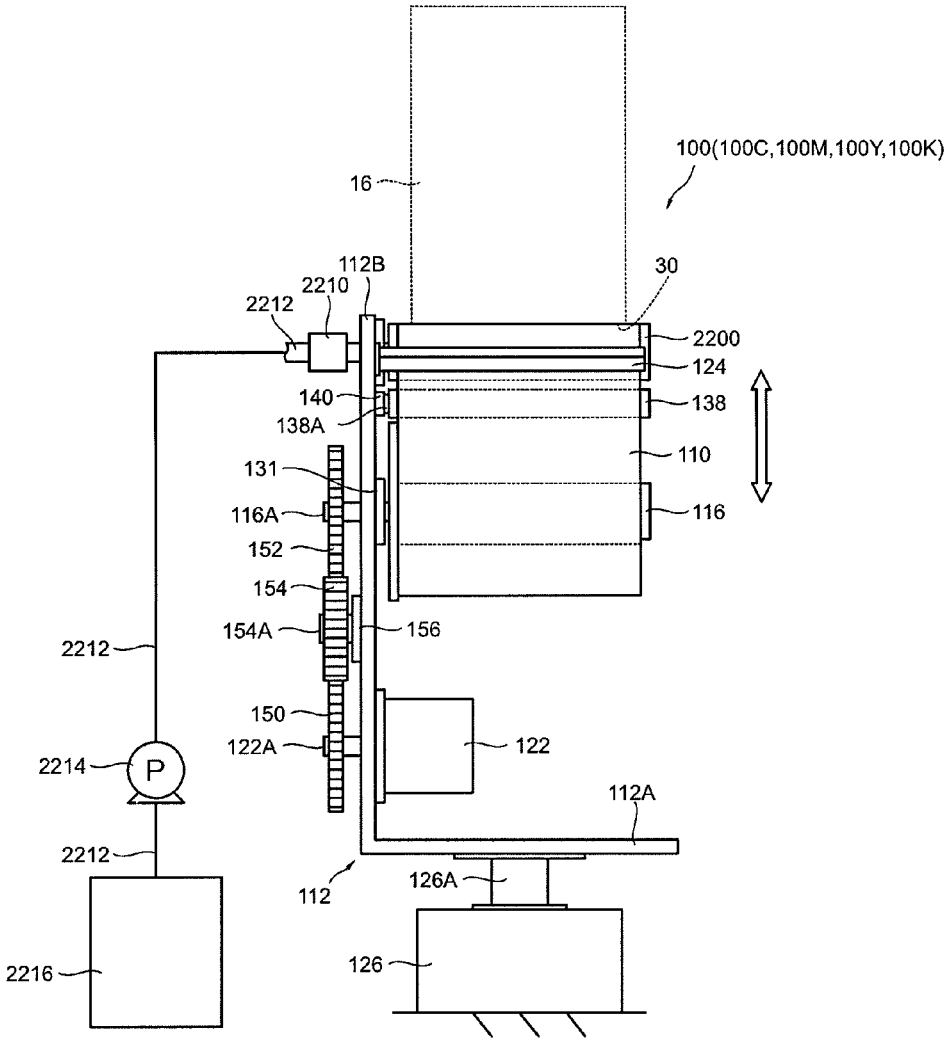
FIG. 33 is a side view diagram of the head cleaner according to the third mode.

FIG. 31 is a front view diagram of a head cleaner, FIG. 32 is a rear view diagram of a head cleaner, and FIG. 33 is a side view diagram of a head cleaner.

As shown in FIGS. 31 to 33, the head cleaner 100 wipes and cleans the nozzle surface 30 of the head 16 by wrapping a band-shaped wiping web 110 about a pressing roller 2200 and pressing and abutting the wiping web 110 wrapped about the pressing roller 2200 against the nozzle surface 30 (30C, 30M, 30Y and 30K) of the corresponding head 16 (16C, 16M, 16Y and 16K).

This head cleaner 100 principally comprises a main body frame 112, a pay-out reel 114 which pays out a wiping web 110, a take-up reel 116 which takes up the wiping web 110, a pressing roller 2200 which presses and abuts the wiping web 110 against the nozzle surface 30 of the head 16, a take-up motor 122 which takes up the wiping web 110 onto the take-up reel 116 by driving the take-up reel 116 to rotate, a used region determination sensor 1124 which determines a used region of the wiping web 110, and an elevator cylinder 126 which causes the main body frame 112 to advance or retract perpendicularly with respect to the nozzle surface 30 of the head 16.

The main body frame 112 is formed in an L shape and is constituted by a bottom surface section 112A provided in parallel with the nozzle surface 30 of the head 16 and a wall surface section 112B provided perpendicularly with respect to the bottom surface section 112A.

The pay-out reel 114 is provided perpendicularly with respect to the wall surface section 112B of the main body frame 112 (namely, in parallel with the nozzle surface of the corresponding head), and the axle section 114A of the reel is supported rotatably on a bearing 130 provided on the inner side of the wall surface section 112B of the main body frame 112. As described below, a winding core 110A on the pay-out side of the wiping web 110 is installed on the pay-out reel 114.

Similarly to the pay-out reel 114, the take-up reel 116 is provided perpendicularly with respect to the wall surface section 112B of the main body frame 112, and the axle section 116A of the reel is supported rotatably on a bearing 131 provided on the inner side of the wall surface section 112B of the main body frame 112. As described below, a winding core 110B on the take-up side of the wiping web 110 is installed on the take-up reel 116.

The take-up reel 116 and the pay-out reel 114 are disposed in parallel in the lateral direction at a uniform spacing apart.

The pressing roller 2200 is disposed above an intermediate position between the pay-out reel 114 and the take-up reel 116, and the wiping web 110 which travels between the pay-out reel 114 and the take-up reel 116 is wrapped about the pressing roller 2200. This pressing roller 2200 is provided perpendicularly with respect to the wall surface section 112B of the main body frame 112.

Figure 34:
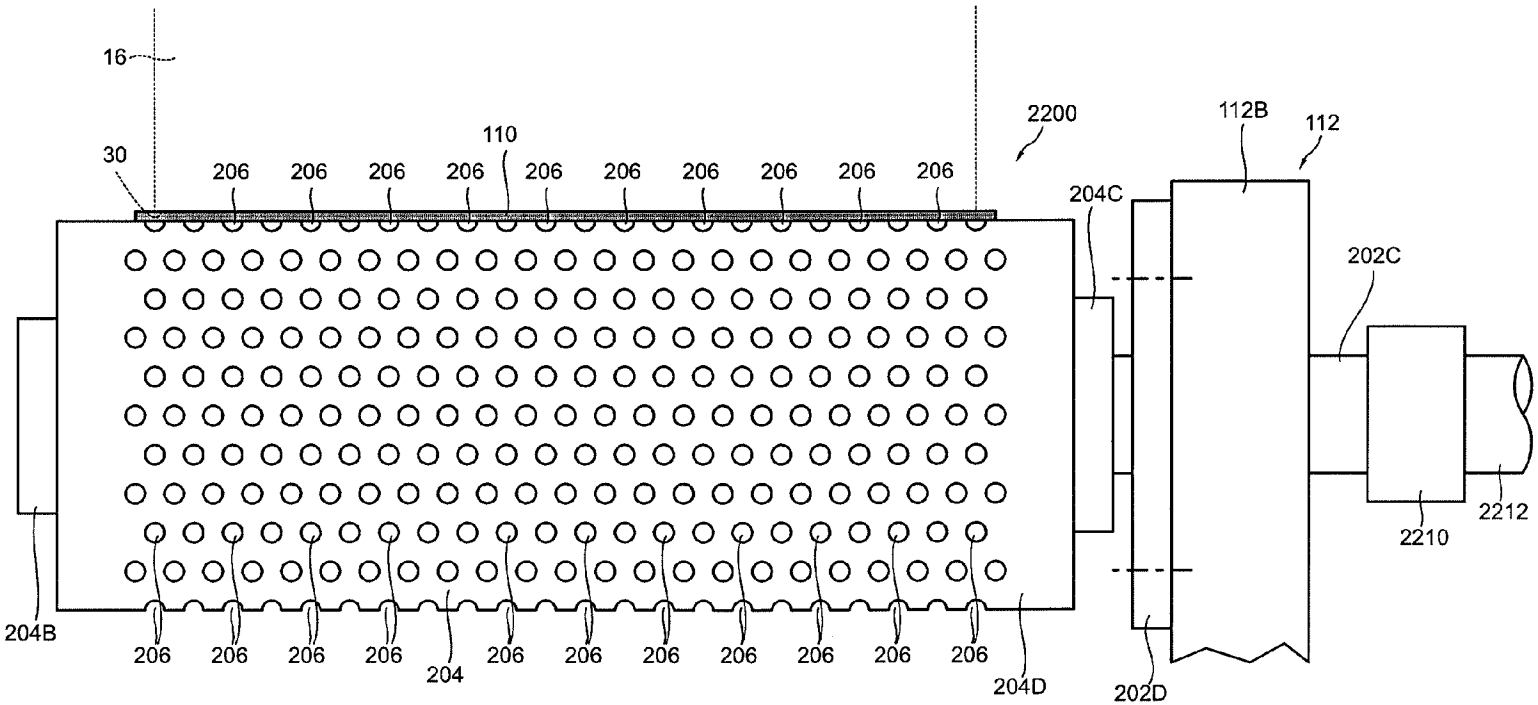
FIG. 34 is a front view diagram of a pressing roller according to the third mode.
Figure 35:
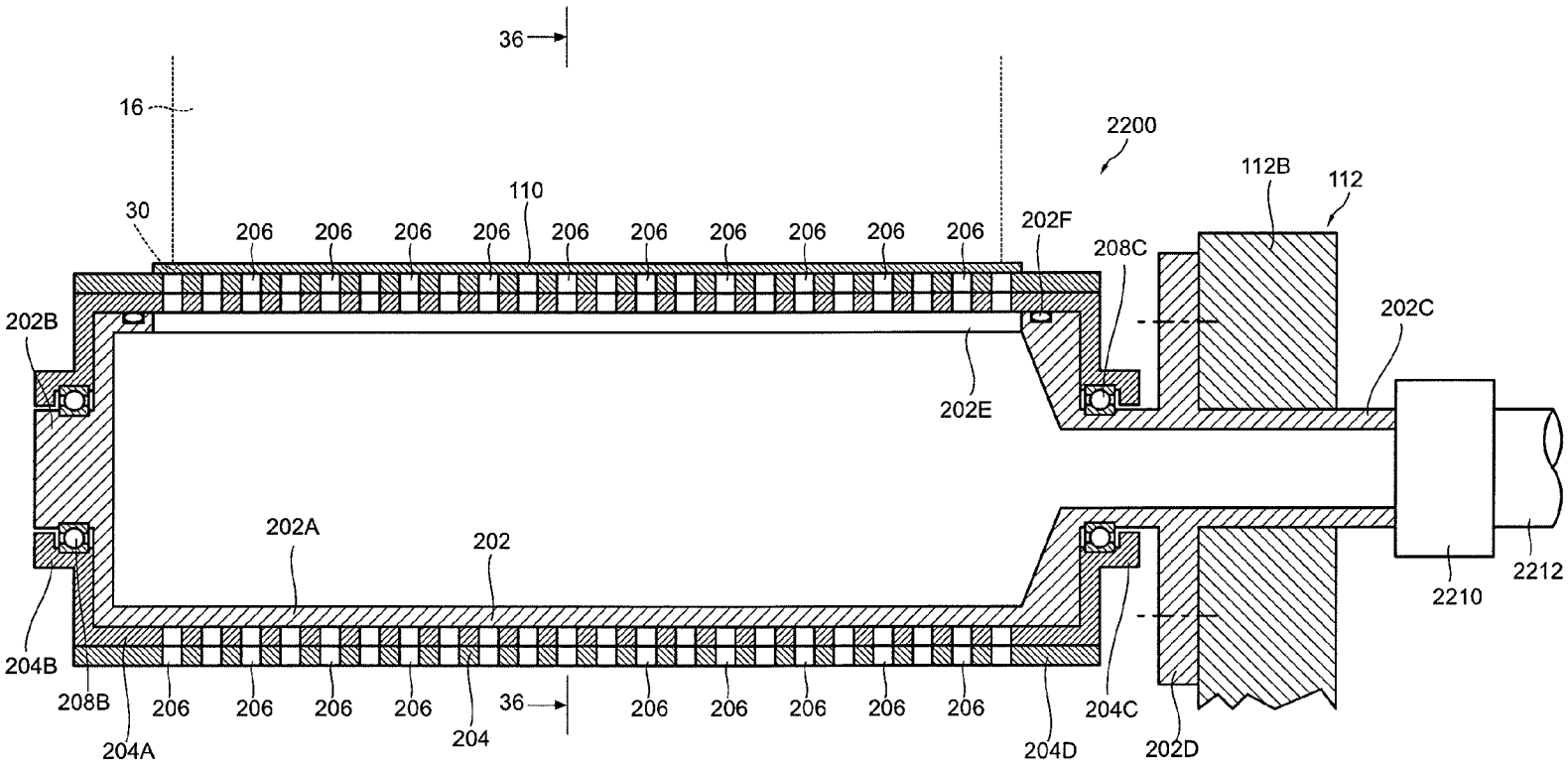
FIG. 35 is a cross-sectional front view diagram of the pressing roller according to the third mode.
Figure 36:
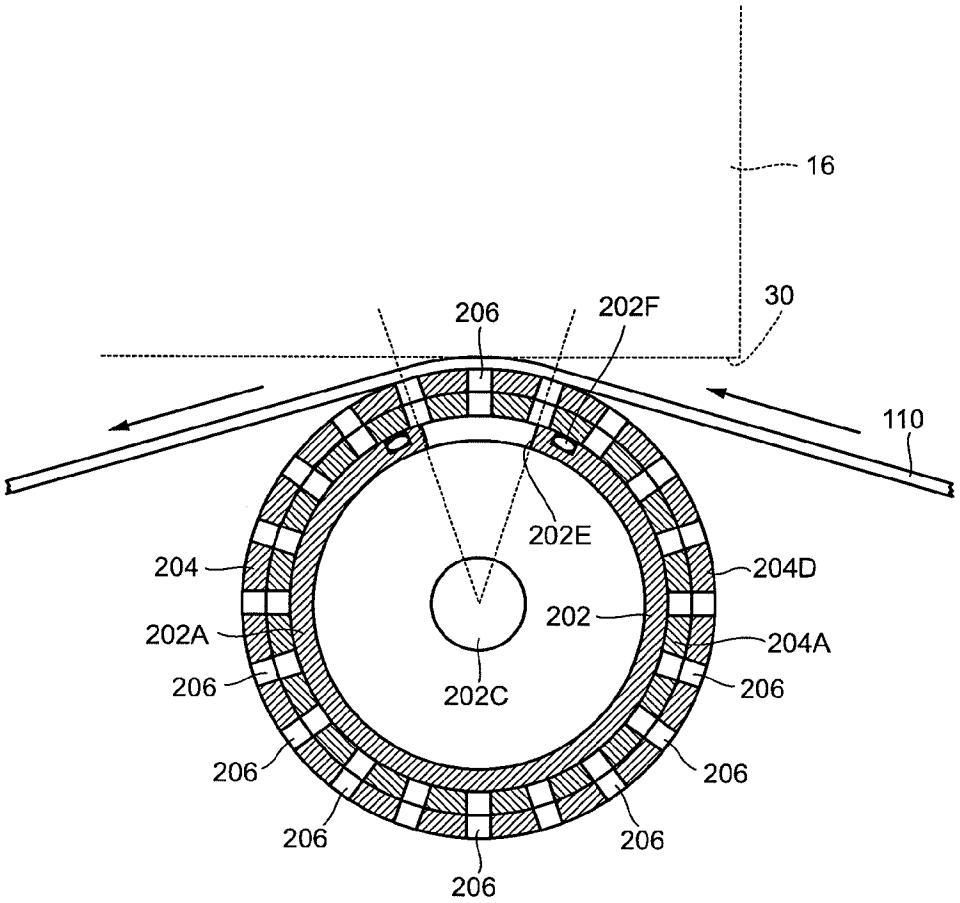
FIG. 36 is a cross-sectional view along 36-36 in FIG. 35.

FIG. 34 is a front view diagram of the pressing roller 2200 and FIG. 35 is a cross-sectional diagram of same. Furthermore, FIG. 36 is a cross-sectional diagram along 36-36 in FIG. 35.

As shown in the drawings, the pressing roller 2200 has a double-tube structure comprising an inner tube 202 and an outer tube 204, and a plurality of suction holes 206 are formed in the circumferential surfaces thereof.

The inner tube 202 is made of stainless steel, or the like, and is constituted by a trunk section 202A formed in a round cylindrical shape, axle sections 202B and 202C formed to project at either end of the trunk section 202A, and a flange section 202D which is formed on the axle section 202C on the base end side.

The trunk section 202A is formed to have a prescribed outer diameter, and an opening section 202E is formed through a prescribed angular range in the top portion thereof. This opening section 202E is formed so as to correspond to the wrapping angle of the wiping web 110 when the web is wrapped about the outer circumference of the pressing roller 2200, and a packing member 203F is installed in this circumferential portion.

The axle section 202B on the front end side is formed in a round bar shape and is formed so as to project by a prescribed amount from the center of the end face on the front end side of the trunk section 202A.

The axle section 202C on the base end side is formed in a round tube shape and is formed so as to project by a prescribed amount from the center of the end face on the base end side of the trunk section 202A. The inner circumference of this axle section 202C connects with the inner circumference of the trunk section 202A.

The flange section 202D is provided at an intermediate point of the axle section 202C on the base end side, and is formed integrally with the axle section 202C so as to be perpendicular with respect to the axle section 202C. The inner tube 202 is installed on a wall surface section 112B of the main body frame 112 by means of the axle section 202C on the base end side thereof being inserted into a pressing roller installation hole 112*b* formed on the wall surface section 112B of the main body frame 112, as well as the flange section 202D thereof being fixed by screws (not illustrated) to the wall surface section 112B of the main body frame 112. The inner tube 202, which is installed in this way, is attached perpendicularly with respect to the side surface section 112B of the main body frame 112.

The outer tube 204 is made of stainless steel, or the like, and is constituted by a trunk section 204A formed in a round cylindrical shape, axle sections 204B and 204C formed to project at either end of the trunk section 204A, and an elastic coating 204D which is coated over the outer circumference of the trunk section 204A.

The trunk section 204A is formed in a round cylindrical shape, and the inner diameter thereof is formed to substantially the same diameter as the outer diameter of the trunk section 202A of the inner tube 202. The trunk section 204A of the outer tube 204 is fitted onto the outer circumference of the trunk section 202A of the inner tube 202, and is provided slidably in the circumferential direction about the periphery of the trunk section 204A.

The axle sections 204B and 204C on either side are formed in a round tube shape and are formed so as to project by a prescribed amount from the center of the end face on either side of the trunk section 204A. The axle sections 204B and 204C of the inner tube 202 are supported rotatably on the outer circumference of the axle sections 202B and 202C via bearings 208B and 208C. The outer tube 204 is supported rotatably on the outer circumference of the inner tube 202 via these bearings 208B and 208C.

The elastic coating 204D is constituted by an elastic body, such as polyurethane, olefin, or the like, and is formed to a prescribed thickness on the outer circumference of the trunk section 204A. The wiping web 110 is pressed and abutted against the nozzle surface 30 of the head 16 via this elastic coating 204D. By this means, it is possible to press and abut the wiping web 110 against the nozzle surface 30 of the head 16 in a suitable fashion.

A plurality of the suction holes 206 are formed in a prescribed arrangement pattern (in the present example, a staggered matrix pattern) on the outer circumference of the outer tube 204, with a prescribed diameter (for example, a diameter of 1 mm approximately). These suction holes 206 are formed so as to pass through to the interior of the outer tube 204.

As described above, the outer tube 204 is provided slidably in the circumferential direction about the outer circumferential part of the inner tube 202. On the other hand, an opening section 202E is formed only in the top section of the inner tube 202. Consequently, the suction holes 204 which are formed in the outer tube 206 are connected to the interior of the inner tube 202 only when positioned above the opening section 202E formed in the inner tube 202.

A wiping web 110 is wrapped with a prescribed wrapping angle about the outer circumference of the outer tube 204 of the pressing roller 2200 having the composition described above. The portion of the wiping web 110 wrapped about the outer circumference of the outer tube 204 (wrapped portion) is suctioned onto the pressing roller 2200 by suctioning air from the interior of the inner tube 202 and thereby setting the interior of the inner tube 202 to a negative pressure. By suctioning the wrapped portion (namely, the pressing portion) in this way, the liquid absorption capability of the wrapped portion of the wiping web 110 is raised. Furthermore, by adjusting the internal pressure of the pressing roller 2200 by adjusting the air suctioning force, it is possible to adjust the liquid absorption capability in the wrapped portion.

The air inside the inner tube 202 is suctioned via the axle section 202C on the base end side of the inner tube 202. The axle section 202C on the base end side of the inner tube 202 is provided so as to pass through the wall surface section 112B of the main body frame 112 and a suction pipe 2212 is connected to the front end thereof via a joint 2210.

As shown in FIG. 32, the suction pipe 2212 is connected to a recovery tank 2216 via a suction pipe 2212. The air inside the inner tube 202 is suctioned, thereby creating a negative pressure inside the tube, by driving the suction pump 2214.

The system controller controls the absorption capability of the wiping web 110 by controlling the internal pressure of the pressing roller 2200 (namely, suctioning force), through controlling the driving of this suction pump 2214.

The wiping web 110 paid out from the pay-out reel 114 is wrapped about the pressing roller 2200 via a pay-out guide roller 134 which is disposed between the pay-out reel 114 and the pressing roller 2200. The pay-out guide roller 134 is provided perpendicularly with respect to the wall surface section 112B of the main body frame 112, and an axle section 134A of the roller is supported rotatably on a bearing 136 provided on the inner side of the wall surface section 112B of the main body frame 112.

Furthermore, the wiping web 110 wrapped about the pressing roller 2200 is wrapped onto the take-up reel 116 via an installation guide roller 138 which is disposed between the pressing roller 2200 and the take-up reel 116. The take-up guide roller 138 is provided perpendicularly with respect to the wall surface section 112B of the main body frame 112, and an axle section 138A of the roller is supported rotatably on a bearing 140 provided on the inner side of the wall surface section 112B of the main body frame 112.

The take-up motor 122 is disposed below the take-up reel 116 and is installed perpendicularly on the inner side of the wall surface section 112B of the main body frame 112. The output axle 122A of the take-up motor 122 is provided so as to project to the outer side of the wall surface section 112B, and a take-up drive gear 150 is fixed to the front end of this axle.

The axle section 116A of the take-up reel 116 is provided so as to project to the outer side of the wall surface section 112B, and a take-up passive gear 152 is fixed to the front end of this axle. This take-up passive gear 152 meshes with the take-up drive gear 150 via a take-up idle gear 154.

The take-up idle gear 154 is disposed on the outer side of the wall surface section 112B of the main body frame 112, and an axle section 154A thereof is supported rotatably on a bearing 156 provided on the outer side of the wall surface section 112B of the main body frame 112.

When the take-up motor 122 is driven, the take-up drive gear 150 is rotated and this rotation is transmitted to the take-up passive gear 152 via the take-up idle gear 154. By this means, the take-up reel 116 is turned in a direction which takes up the wiping web 110.

A used region determination sensor 124 is arranged between the pressing roller 2200 and the take-up guide roller 138 and determines the used region of the wiping web 110 traveling between same. The used region is determined by determining the wet region of the wiping web 110, for instance. In other words, the used region becomes wet due to absorbing ink or cleaning liquid and therefore the used region is determined by determining this wet region. The used region determination sensor 124 is constituted by a photosensor comprising a light emitting section and a light receiving section, for example, and determines the used region (wet region) of the wiping web 110 by receiving the reflected light of the light which is emitted toward the wiping web 110 from the light emitting section. The system controller controls the used region determination sensor 124 and carries out processing for determining the used region.

Figure 37A:
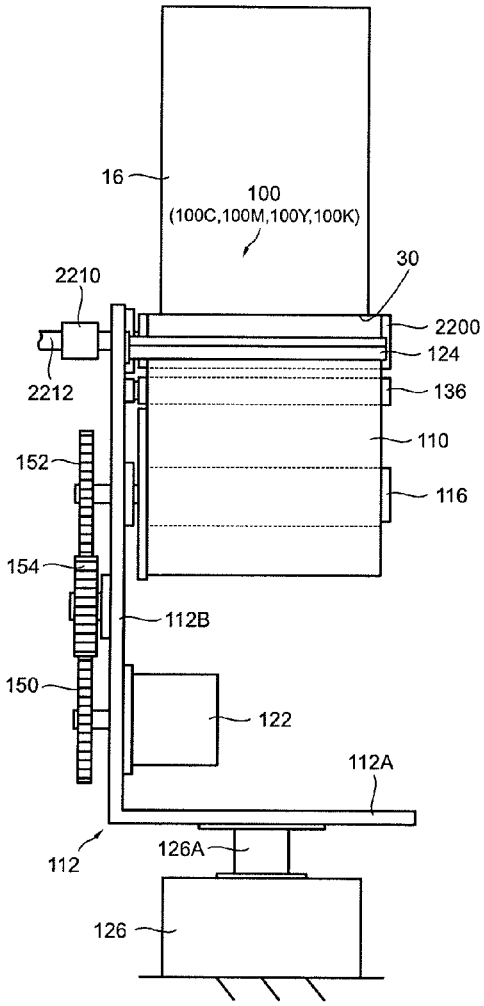
FIGS. 37A and 37B are illustrative diagrams of a raising and lowering operation of the head cleaner according to the third mode.
Figure 37B:
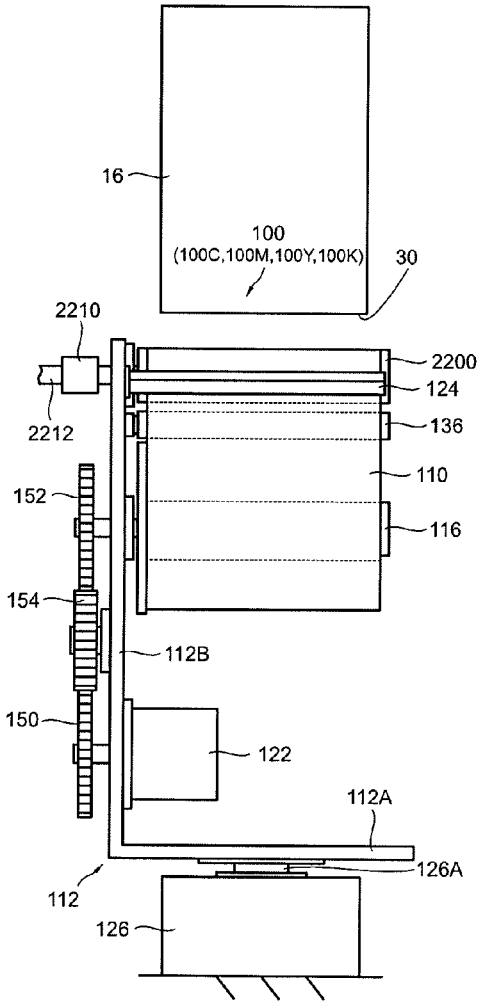

An elevator cylinder 126 is fixed to the head cleaning apparatus main body (not illustrated), and a main body frame 112 is fixed to the front end of the rod 126A. The main body frame 112 is advanced and retracted perpendicularly to the nozzle surface 30 of the corresponding head 16, by driving this elevator cylinder 126. By advancing and retracting the main body frame 112 with respect to the nozzle surface 30, the pressing roller 2200 is moved between a prescribed "pressing position" and "withdrawn position", as shown in FIGS. 37A and 37B.

The wiping web 110 wrapped about the pressing roller 2200 is pressed and abutted against the nozzle surface 30 of the corresponding head 16, when the pressing roller 2200 is disposed at the pressing position. When the pressing roller 2200 is disposed at the withdrawn position, the wiping web 110 is withdrawn from the nozzle surface 30 of the corresponding head 16. More specifically, the wiping web 110 is separated from the nozzle surface 30 so as not to make contact with the nozzle surface 30.

The system controller controls the abutment and withdrawal of the wiping web 110 with respect to the nozzle surface 30 by controlling the operation of the elevator cylinder 126.

The head cleaner 100 has the composition described above.

The wiping web 110 is a woven or braided structure of ultra-thin long fibers of polyester, acrylic, nylon, or the like, having a diameter of approximately 2 micron, and is formed in a band shape having a prescribed width (a width corresponding to the nozzle surface of the head which is to be wiped).

The wiping web 110 is supplied in a state where the respective ends thereof are attached to the winding cores 110A and 110B, and the web is wound up in the form of a roll on one of the winding cores (the pay-out side winding core) 110A. The wiping web 110 is installed on the head cleaner 100, as described below.

Firstly, the winding core 110A on the pay-out side is installed on the pay-out reel 114. The wiping web 110 installed on the pay-out reel 114 is paid out a small amount at a time and wrapped in sequence about the pay-out guide roller 134, the pressing roller 2200 and the take-up guide roller 138, and the winding core on the front end (the take-up side winding core) 110B is installed on the take-up reel 116. By this means, the wiping web 110 is installed on the head cleaner 100.

The head cleaner 100 on which the wiping web 110 is installed winds the wiping web 110 up from the pay-out reel 114 to the take-up reel 116 by driving the winding motor 122 to rotate. By this means, the wiping web 110 which is wrapped about the pressing roller 2200 is caused to travel.

The wiping web 110 wrapped about the pressing roller 2200 travels in parallel with the direction of movement of the head 16, and travels in the opposite direction when the head 16 is moved from the image formation position to the maintenance position. Furthermore, the wiping web 110 travels in the same direction when the head 16 is moved from the maintenance position to the image formation position.

The system controller cleans the nozzle surface 30 of the head 16, by controlling the driving of the wind-back motor 120, the take-up motor 122, the elevator cylinder 126 and the head feed motor 60.

Head Cleaning Method

Next, a cleaning method for a head using the head cleaning apparatus 70 according to the present embodiment will be described.

The cleaning of the heads 16C, 16M, 16Y and 16K is carried out by wiping with a wiping web 110 after applying a cleaning liquid to the whole area of the nozzle surfaces 30C, 30M, 30Y and 30K. In the head cleaning apparatus 70 of the present embodiment, the operation of wiping the nozzle surfaces 30C, 30M, 30Y and 30K with the wiping webs 110 is carried out in two separate actions. More specifically, a first action involves wiping with a wiping web 110 in a state of high liquid absorption capability by suctioning the wiping web 110 by the pressing roller 2200, and a second action involves wiping with a wiping web 110 in state of low liquid absorption capability by weakening the suctioning force used to suction the wiping web 110, or by not suctioning the wiping web 110.

In this way, by wiping the nozzle surfaces 30C, 30M, 30Y and 30K in two separate wiping actions, it is possible to prevent wiping traces and wiping omissions. More specifically, large liquid droplets present on the nozzle surface are removed, thereby preventing wiping omissions, by the first wiping action performed with the wiping web 110 in a state of high liquid absorption capability. In the subsequent second wiping action performed with the wiping web 110 in a state of low liquid absorption capability, the wiping traces produced by the first wiping action are removed, as well as preventing ink from being drawn out from the nozzle holes. By this means, it is possible to clean the nozzle surfaces 30C, 30M, 30Y and 30K without the occurrence of wiping traces or wiping omissions.

Below, a specific cleaning method for the heads 16C, 16M, 16Y and 16K using the head cleaning apparatus 70 according to the present embodiment will be described.

Firstly, cleaning liquid is applied to the nozzle surfaces 30C, 30M, 30Y and 30K of the heads 16C, 16M, 16Y and 16K in order to dissolve the adhering material created by the ink which is adhering to the nozzle surfaces 30C, 30M, 30Y and 30K.

The cleaning liquid is applied by moving the heads 16C, 16M, 16Y and 16K from the image formation position towards the maintenance position (or from the maintenance position towards the image formation position), as well as spraying cleaning liquid from the cleaning liquid application nozzles 80C, 80M, 80Y and 80K toward the nozzle surfaces 30C, 30M, 30Y and 30K of the heads 16C, 16M, 16Y and 16K. More specifically, the procedure is as follows. When the heads 16C, 16M, 16Y and 16K are moved from the image formation position toward the maintenance position, the heads 16C, 16M, 16Y and 16K pass over the cleaning liquid application nozzles 80C, 80M, 80Y and 80K and therefore cleaning liquid is sprayed from the cleaning liquid application nozzles 80C, 80M, 80Y and 80K in coordination with the passage of the heads 16C, 16M, 16Y and 16K. By this means, cleaning liquid is applied to the whole area of the nozzle surfaces 30C, 30M, 30Y and 30K, including the nozzle free regions.

The application of cleaning liquid may be carried out once, or a plurality of times. If cleaning liquid is applied a plurality of times, the heads 16C, 16M, 16Y and 16K are moved back and forth a plurality of times during application.

When the application of the cleaning liquid has been completed, the heads 16C, 16M, 16Y and 16K are returned temporarily to the image formation position. Thereupon, a first wiping and cleaning action (first cleaning step) is carried out.

As described above, this first wiping action is carried out using a wiping web in a state of high absorption capability. In other words, wiping is carried out by using a wiping web 110 in a state of raised absorption capability, by suctioning the air inside the pressing roller 2200 and setting the interior of the pressing roller 2200 to a negative pressure. More specifically, the procedure is as follows.

Firstly, an unused region of the wiping web is located in position. In other words, the wiping web 110 is located in position in such a manner that the unused region of the wiping web 110 is wrapped about the pressing roller 118. This step is carried out on the basis of the output from the used region determination sensor 124 and is performed by winding the wiping web 110 onto the take-up reel 116 until the wet region ceases to be determined by the used region determination sensor 124.

Figure 38A:
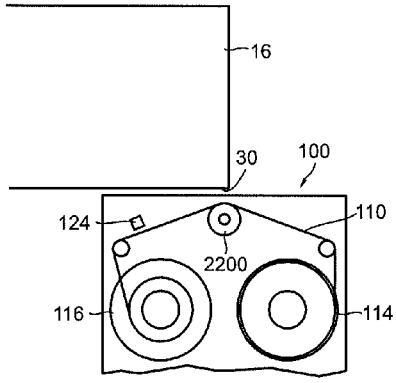

When this positional location of the unused region has been completed, the heads 16C, 16M, 16Y and 16K are conveyed toward the maintenance position. As the heads 16C, 16M, 16Y and 16K are moved toward the maintenance position, they are halted temporarily when the end portion on one side thereof (the end portion on the maintenance position side) arrives at the installation position of the pressing roller 2200, as shown in FIG. 38A. In this case, the pressing rollers 2200 of the cleaners 100C, 100M, 100Y and 100K are situated in a prescribed withdrawn position.

When the heads 16C, 16M, 16Y and 16K are halted, the elevator cylinders 126 are driven and the pressing rollers 2200 are moved to a pressing position. By this means, the wiping webs 110 wrapped about the pressing rollers 2200 are pressed and abutted against the nozzle surfaces 30C, 30M, 30Y and 30K of the heads 16C, 16M, 16Y and 16K (FIG. 38B (see FIG. 37A)).

When the wiping webs 110 wrapped about the pressing rollers 2200 are pressed and abutted against the nozzle surfaces 30C, 30M, 30Y and 30K of the heads 16C, 16M, 16Y and 16K, the suction pumps 2214 are driven, the air inside the pressing rollers 2200 is suctioned and the interiors of the pressing rollers 2200 are set to a negative pressure. As a result of this, the wiping webs wrapped about the pressing rollers 2200 (namely, the wiping webs which are pressed and abutted against the nozzle surfaces 30C, 30M, 30Y and 30K of the heads 16C, 16M, 16Y and 16K) are suctioned with a prescribed suctioning force.

Thereupon, the take-up motors 122 are driven, the wiping webs 110 are taken up onto the take-up reels 116 at a uniform speed, and the head feed motor 60 is driven and the heads 16C, 16M, 16Y and 16K are conveyed at a uniform speed toward the maintenance position. As a result, as shown in FIG. 38C, the wiping webs 110 are slid in contact with the nozzle surfaces 30C, 30M, 30Y and 30K of the heads 16C, 16M, 16Y and 16K, and the nozzle surfaces 30C, 30M, 30Y and 30K are wiped and cleaned by the traveling wiping webs 110.

In this case, the wiping webs 110 travel in the opposite direction to the direction of movement of the heads 16C, 16M, 16Y and 16K. Accordingly, it is possible to increase the relative differential velocity, and the cleaning effect can be improved.

Figure 38D:
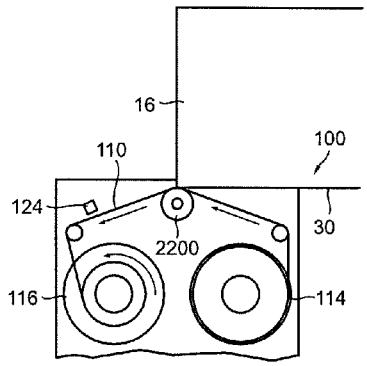
Figure 38B:
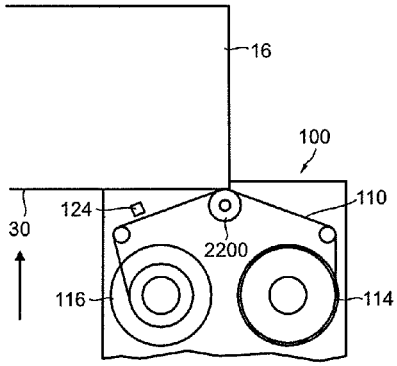

The heads 16C, 16M, 16Y and 16K which have been conveyed to the maintenance position are halted when the end portion on the other side (the end portion on the side of the image formation position) arrives at the installation position of the pressing roller 2200, as shown in FIG. 38D. The travel of the wiping webs 110 and the suctioning of air are also halted in synchronism with the halting of the conveyance of the heads 16C, 16M, 16Y and 16K.

By means of the above, the first wiping and cleaning action is completed. As described above, the first wiping and cleaning action is carried out while suctioning the wiping webs 110 and therefore it is possible to wipe the nozzle surfaces 30C, 30M, 30Y and 30K with wiping webs 110 in a state of high liquid absorption capability. By this means, it is possible to wipe and clean the nozzle surfaces 30C, 30M, 30Y and 30K without the occurrence of wiping omissions.

Figure 38E:
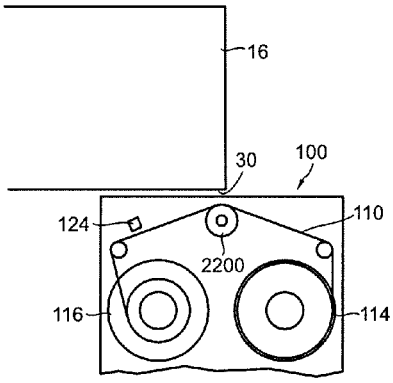
Figure 38C:
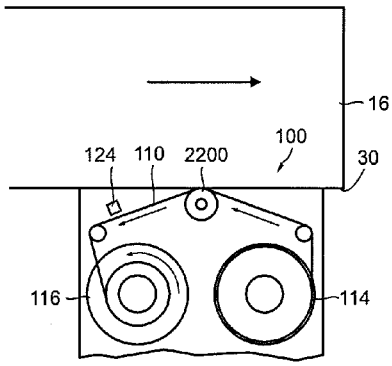

When the first wiping and cleaning action has been completed, the elevator cylinders 126 are driven and the pressing rollers 2200 are moved to a withdrawn position. Furthermore, the heads 16C, 16M, 16Y and 16K are returned toward the image formation position. As shown in FIG. 38E, the heads 16C, 16M, 16Y and 16K which have been returned toward the image formation position are halted when the end portion on the one side is situated at the installation position of the pressing roller 2200. When this conveyance of the heads 16C, 16M, 16Y and 16K has been halted, the second wiping and cleaning action is started.

Firstly, the elevator cylinders 126 are driven and the pressing rollers 2200 are moved to a pressing position. By this means, the wiping webs 110 wrapped about the respective pressing rollers 2200 are pressed and abutted against the nozzle surfaces 30C, 30M, 30Y and 30K of the heads 16C, 16M, 16Y and 16K.

When the respective wiping webs 110 wrapped about the pressing rollers 2200 are pressed and abutted against the nozzle surfaces 30C, 30M, 30Y and 30K of the heads 16C, 16M, 16Y and 16K, the take-up motors 122 are driven and the wiping webs 110 are wound up onto the take-up reels 116 at a uniform speed. Accordingly, the wiping webs 110 wrapped about the pressing rollers 2200 (namely, the wiping webs which are pressed and abutted against the nozzle surfaces 30C, 30M, 30Y and 30K of the heads 16C, 16M, 16Y and 16K) travel toward the take-up reels 116.

Figure 38F:
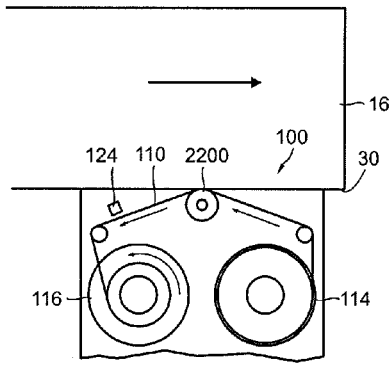

Furthermore, simultaneously with the driving of the take-up motors 122, the head feed motor 60 is driven and the heads 16C, 16M, 16Y and 16K are conveyed toward the maintenance position at a uniform speed. As a result, as shown in FIG. 38F, the wiping webs 110 are slid in contact with the nozzle surfaces 30C, 30M, 30Y and 30K of the heads 16C, 16M, 16Y and 16K, and the nozzle surfaces 30C, 30M, 30Y and 30K are wiped and cleaned by the traveling wiping webs 110.

In this case, the wiping webs 110 travel in the opposite direction to the direction of movement of the heads 16C, 16M, 16Y and 16K. Accordingly, it is possible to increase the relative differential velocity, and the cleaning effect can be improved.

Furthermore, in contrast to the first wiping and cleaning action, this second wiping and cleaning action is carried out without suctioning the wiping webs 110. By this means, it is possible to wipe the nozzle surfaces 30C, 30M, 30Y and 30K of the heads 16C, 16M, 16Y and 16K by using wiping webs 110 having a low liquid absorption capability.

The heads 16C, 16M, 16Y and 16K which have been conveyed to the maintenance position are halted when the end portion on the other side arrives at the installation position of the pressing rollers 2200 (see FIG. 38D). The travel of the wiping webs 110 is halted in synchronism with the halting of the conveyance of the heads 16C, 16M, 16Y and 16K.

By means of the above, the second wiping and cleaning action is completed. As described above, the second wiping and cleaning action is carried out without suctioning the wiping webs 110 and therefore it is possible to wipe the nozzle surfaces 30C, 30M, 30Y and 30K with wiping webs 110 in a state of low liquid absorption capability. By this means, it is possible to wipe and clean the nozzle surfaces 30C, 30M, 30Y and 30K of the heads 16C, 16M, 16Y and 16K without drawing out ink from the nozzles (without the occurrence of wiping traces). Furthermore, if wiping traces have occurred in the first wiping and cleaning action, it is possible to wipe away these traces effectively.

When the second wiping and cleaning action has been completed, the heads 16C, 16M, 16Y and 16K are conveyed directly toward the maintenance position.

On the other hand, in the head cleaners 100C, 100M, 100Y and 100K, the elevator cylinders 126 are driven and the pressing rollers 2200 are disposed in the withdrawn position. After this, the head cleaners 100C, 100M, 100Y and 100K carry out location of an unused region for the next cleaning process, according to requirements.

By means of the steps described above, the cleaning of the nozzle surfaces 30C, 30M, 30Y and 30K of the heads 16C, 16M, 16Y and 16K is completed.

As described above, in a head cleaning apparatus 70 according to the present embodiment, the absorption capability of the wiping webs 110 which wipe and clean the nozzle surfaces 30C, 30M, 30Y and 30K of the heads 16C, 16M, 16Y and 16K is switched and the nozzle surfaces 30C, 30M, 30Y and 30K of the heads 16C, 16M, 16Y and 16K are wiped and cleaned in two separate actions. More specifically, in a first action, the nozzle surfaces 30C, 30M, 30Y and 30K of the heads 16C, 16M, 16Y and 16K are wiped and cleaned with wiping webs 110 in a state of high absorption capability by suctioning the wiping webs 110, and in a second action, the nozzle surfaces 30C, 30M, 30Y and 30K of the heads 16C, 16M, 16Y and 16K are wiped and cleaned with wiping webs 110 in a state of low absorption capability by not suctioning the wiping webs 110. By this means, it is possible to clean the nozzle surfaces 30C, 30M, 30Y and 30K without the occurrence of wiping traces or wiping omissions.

Furthermore, it is possible to increase the range of selection of the wiping web which can be used, by switching the absorption capability of the wiping web 110 by suctioning in this way.

In the present embodiment, the first wiping and cleaning action which is carried out while suctioning the wiping webs 110 is implemented just once, but this first action may also be carried out a plurality of times. In this case, the heads 16C, 16M, 16Y and 16K are moved back and forth a plurality of times, while the wiping webs 110 in a suctioned state remain pressed and abutted against the nozzle surfaces 30C, 30M, 30Y and 30K of the heads 16C, 16M, 16Y and 16K. Similarly, the second wiping and cleaning action, which is performed without suctioning the wiping webs 110, may also be carried out a plurality of times.

Furthermore, in the present embodiment, when carrying out the second wiping and cleaning action, the wiping webs 110 are not suctioned, but this action may also be carried out while suctioning the wiping webs 110. More specifically, the second wiping and cleaning action may be carried out by pressing and abutting the wiping webs 110 against the nozzle surfaces 30C, 30M, 30Y and 30K of the heads 16C, 16M, 16Y and 16K while suctioning the wiping webs 110 with a suctioning force of a level which avoids drawing out ink from the nozzles. Therefore, in this case, the wiping webs 110 must necessarily be suctioned by setting the suctioning force to a weaker force than that during the first wiping and cleaning action.

Desirably, the suctioning forces applied to the wiping webs 110 in the first and second actions are set by carrying out a wiping test in advance, and setting a suctioning force of a level which avoids the occurrence of wiping omissions for the first action, and setting a suctioning force of a level which avoids drawing out of ink from the nozzles for the second action.

Furthermore, the liquid absorption capability during wiping is adjusted by controlling the suctioning force from the pressing holes, and therefore it is desirable that the inherent absorption capacity of the wiping web should be low (this is because if the absorption capacity is high, then wiping traces will occur in the second wiping action). The required absorption capacity varies depending on the properties of the ink and the nozzle diameter, but in the present embodiment, a value of 100 mm or less according to the JISL1018 Byreck method is considered suitable.

Furthermore, similarly to the setting of the suctioning force, the wiping webs used may also be selected by carrying out a wiping test in advance and using a web having an absorption capability of a level which avoids drawing ink out from the nozzles when the nozzle surface is wiped without suctioning via the suction holes.

Furthermore, in the present example, the wiping webs 110 are made to travel in the opposite direction to the direction of movement of the heads 16C, 16M, 16Y and 16K when carrying out the second wiping and cleaning action using reduced absorption capability, but this wiping and cleaning action may also be carried out with the webs traveling in the same direction as the heads. In this case, the wiping webs 110 are pressed and abutted against the nozzle surfaces 30C, 30M, 30Y and 30K of the heads 16C, 16M, 16Y and 16K which are moving toward the maintenance position, while the wiping webs 110 are taken up onto the take-up reels 116. By this means, it is possible to wipe and clean the nozzle surfaces 30C, 30M, 30Y and 30K while causing the wiping webs 110 to travel in the same direction as the movement of the heads 16C, 16M, 16Y and 16K.

Furthermore, it is also possible to carry out two wiping and cleaning actions by pressing and abutting the wiping webs 110 against the nozzle surfaces 30C, 30M, 30Y and 30K of the heads 16C, 16M, 16Y and 16K in a state where the wiping webs 110 have been halted and are not traveling.

Further Embodiments of the Head Cleaner of Third Mode

In the embodiment described above, the nozzle surfaces 30C, 30M, 30Y and 30K of the heads 16C, 16M, 16Y and 16K are wiped and cleaned in two actions by switching the suctioning force applied to the wiping webs 110, but it is also possible to complete wiping and cleaning in one action by optimizing the suctioning force applied to the wiping webs 110. More specifically, by adjusting the suctioning force applied to the wiping webs 110 in accordance with the diameter of the nozzles formed in the nozzle surfaces 30C, 30M, 30Y and 30K of the heads 16C, 16M, 16Y and 16K and the properties of the ink, and the like, the nozzle surfaces 30C, 30M, 30Y and 30K of the heads 16C, 16M, 16Y and 16K can be cleaned while preventing both wiping omissions and wiping traces, in a single wiping and cleaning action. In this case, a wiping test is carried out previously and the suctioning force applied to the wiping webs 110 is optimized (the suctioning force is set to a level which prevents the occurrence of wiping omissions and wiping traces by means of a single wiping and cleaning action).

This optimization of the suctioning force applied to the wiping webs 110 is premised on the inclusion of a high-performance suction pump which is capable of adjusting the suctioning force with a high degree of accuracy. On the other hand, by adopting a composition in which the wiping and cleaning is carried out a plurality of times by switching the suctioning force, it is possible to set and control the suctioning capacity of the suction pump in an approximate fashion, and therefore costs can be reduced.

Moreover, in the embodiment described above, the wiping webs 110 are pressed and abutted against the nozzle surfaces 30C, 30M, 30Y and 30K of the heads 16C, 16M, 16Y and 16K by wrapping the wiping webs 110 about the pressing rollers 2200 and pressing and abutting the pressing rollers 2200 against the nozzle surfaces 30C, 30M, 30Y and 30K of the heads 16C, 16M, 16Y and 16K, but there are no particular restrictions on the device which presses and abuts the wiping webs 110 against of the nozzle surfaces 30C, 30M, 30Y and 30K of the heads 16C, 16M, 16Y and 16K.

Figure 39:
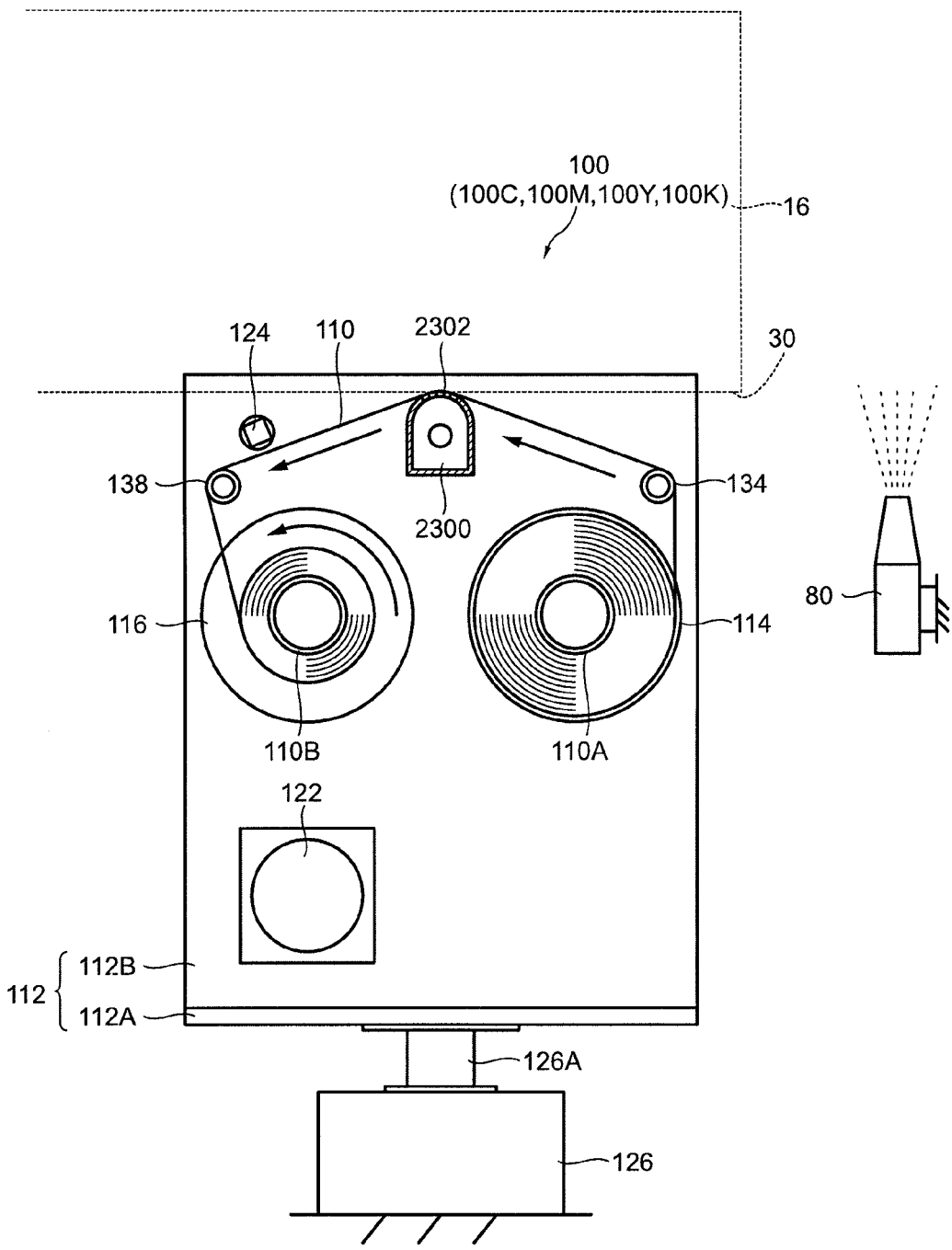

For example, as shown in FIG. 39, it is also possible to adopt a composition in which each wiping web 110 is wrapped about a circular arc-shaped guide surface 2302 formed on a guide member 2300 fixed to the main body frame 112, and by pressing and abutting the guide members 2300 against the nozzle surfaces 30C, 30M, 30Y and 30K of the heads 16C, 16M, 16Y and 16K, the wiping webs 110 are pressed and abutted against the nozzle surfaces 30C, 30M, 30Y and 30K of the heads 16C, 16M, 16Y and 16K. In this case also, a plurality of suction holes are formed in the circular arc-shaped guide surface 2302 of the guide member 2300, in such a manner that the wiping webs 110 wrapped thereabout can be suctioned. Furthermore, the guide surfaces 2302 are coated with an elastic body.

If the wiping webs 110 are each wrapped about a guide member 2300 which does not rotate in this way, then when the wiping webs 110 are pressed and abutted against the nozzle surfaces 30C, 30M, 30Y and 30K of the heads 16C, 16M, 16Y and 16K, the guide member 2300 does not need to have a double-tube structure and therefore the composition can be simplified.

Furthermore, if using a guide member that is not rotated in this way, the guide surface does not necessarily have to be a circular arc-shaped surface, and it is also possible to form a plate-shaped guide surface provided in parallel with each of the nozzle surfaces 30C, 30M, 30Y and 30K and to press and abut a wiping web 110 wrapped about this guide surface respectively against the nozzle surfaces 30C, 30M, 30Y and 30K of the heads 16C, 16M, 16Y and 16K. By this means, the wiping webs 110 can be caused to make face-to-face contact with the nozzle surfaces 30C, 30M, 30Y and 30K of the heads 16C, 16M, 16Y and 16K.

Furthermore, in the embodiment described above, wiping webs 110 formed in a band-shape are used and are pressed and abutted against the nozzle surfaces 30C, 30M, 30Y and 30K of the heads 16C, 16M, 16Y and 16K while causing the wiping webs 110 to travel, but the mode of the wiping members used is not limited to this. It is also possible to adopt a composition in which the nozzle surfaces 30C, 30M, 30Y and 30K of the heads 16C, 16M, 16Y and 16K are wiped and cleaned by sliding wiping members formed in a cloth shape over the nozzle surfaces 30C, 30M, 30Y and 30K of the heads 16C, 16M, 16Y and 16K. In this case also, the nozzle surfaces 30C, 30M, 30Y and 30K of the heads 16C, 16M, 16Y and 16K are wiped and cleaned while suctioning the wiping members in a first wiping action, and the nozzle surfaces 30C, 30M, 30Y and 30K of the heads 16C, 16M, 16Y and 16K are wiped and cleaned while suctioning the wiping members at a weaker suctioning force than in the first action, or without suctioning the wiping members, in a second wiping action.

By wiping the nozzle surfaces 30C, 30M, 30Y and 30K of the heads 16C, 16M, 16Y and 16K by using wiping webs 110 formed in a band shape and while causing the wiping webs 110 to travel, it is possible to wipe and clean the nozzle surfaces 30C, 30M, 30Y and 30K of the heads 16C, 16M, 16Y and 16K by using a clean part of the web at all times, and therefore the cleaning effect can be further enhanced.

Furthermore, the head cleaners 100C, 100M, 100Y and 100K according to the present embodiment respectively comprise a used region determination sensor 124, but this used region determination sensor 124 does not necessarily have to be provided, and it is also possible to locate the wiping web 110 in a desired position by controlling the amount of winding out and winding back of the wiping web 110. By providing used region determination sensors 124, it is possible to achieve accurate positional location, as well as being able to determine the presence or absence of the wiping webs 110.

Moreover, in the present example, in order to dissolve the adhering material caused by the ink, cleaning liquid is applied previously to the nozzle surfaces 30C, 30M, 30Y and 30K in order to wet the nozzle surfaces 30C, 30M, 30Y and 30K, but there are no particular restrictions on the method of wetting the nozzle surfaces 30C, 30M, 30Y and 30K. For example, it is also possible to use ink as a wetting liquid. In this case, ink is caused to seep out from the nozzles formed on the nozzle surfaces 30C, 30M, 30Y and 30K, so as to wet the nozzle surfaces 30C, 30M, 30Y and 30K. Furthermore, in this case, the nozzle surfaces 30C, 30M, 30Y and 30K are sealed with a cap, the internal pressure of the cap is reduced, and the ink is suctioned onto the nozzle surfaces 30C, 30M, 30Y and 30K and thus caused to seep out from the nozzles. Alternatively, the ink is caused to seep out onto the nozzle surfaces by applying pressure to the flow channels from the ink tanks to the heads.

Furthermore, in the series of embodiments described above, a case where the nozzle surface of a line head is wiped and cleaned is described, but the application of the present invention is not limited to this. The invention can also be applied similarly to a case of wiping and cleaning the nozzle surface of a so-called shuttle scanning type of head.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A head cleaning apparatus which wipes and cleans a nozzle surface of a head with a band-shaped liquid absorbing body, by pressing and abutting a pressing member on which the liquid absorbing body that is paid out from a pay-out reel and taken up onto a take-up reel, and travels between the pay-out reel and the take-up reel is wrapped against the nozzle surface of the head, and sliding the pressing member over the nozzle surface of the head, the head cleaning apparatus comprising:

a liquid deposition device which deposits liquid on the liquid absorbing body on an upstream side of the pressing member in terms of a direction of travel of the liquid absorbing body so as to wet the liquid absorbing body with the liquid; and a control device which controls the travel of the liquid absorbing body, sliding of the pressing member and deposition of the liquid by the liquid deposition device, wherein the control device implements control in such a manner that, after the nozzle surface of the head is wiped and cleaned with an unused non-wet region of the liquid absorbing body, a wet region is formed on the liquid absorbing body by depositing the liquid on the liquid absorbing body from the liquid deposition device, and the nozzle surface of the head is wiped and cleaned with the wet region.

2. The head cleaning apparatus as defined in claim 1, wherein an amount of the liquid deposited by the liquid deposition device is altered in accordance with a relative speed differential between the head and the liquid absorbing body.

3. The head cleaning apparatus as defined in claim 1, further comprising a wet region determination device which determines the wet region of the liquid absorbing body.

4. The head cleaning apparatus as defined in claim 1, wherein the liquid deposition device includes a nozzle having a spray port corresponding to a width of the liquid absorbing body, and wherein the liquid deposition device wets the liquid absorbing body by spraying the liquid from the spray port to the liquid absorbing body.

5. The head cleaning apparatus as defined in claim 2, further comprising the wet region determination device which determines a wet region of the liquid absorbing body.

6. The head cleaning apparatus as defined in claim 2, wherein the liquid deposition device includes a nozzle having a spray port corresponding to a width of the liquid absorbing body, and wherein the liquid deposition device wets the liquid absorbing body by spraying the liquid from the spray port to the liquid absorbing body.

7. The head cleaning apparatus as defined in claim 3, wherein the liquid deposition device is a nozzle having a spray port corresponding to a width of the liquid absorbing body, and the liquid is sprayed onto the liquid absorbing body to wet the liquid absorbing body.

8. The head cleaning apparatus as defined in claim 5, wherein the liquid deposition device includes a nozzle having a spray port corresponding to a width of the liquid absorbing body, and wherein the liquid deposition device wets the liquid absorbing body by spraying the liquid from the spray port to the liquid absorbing body.

* * * * *